US006818374B2

(12) United States Patent
Oikawa et al.

(10) Patent No.: US 6,818,374 B2
(45) Date of Patent: Nov. 16, 2004

(54) SILVER HALIDE PHOTOGRAPHIC LIGHT-SENSITIVE MATERIALS AND METHOD FOR DEVELOPMENT OF THE SAME

(75) Inventors: Tokuju Oikawa, Minami-ashigara (JP); Tadashi Ito, Minami-ashigara (JP); Katsuyuki Watanabe, Minami-ashigara (JP); Mitsunori Hirano, Minami-ashigara (JP); Yasutomo Kawanishi, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 17 days.

(21) Appl. No.: 10/392,832

(22) Filed: Mar. 21, 2003

(65) Prior Publication Data

US 2003/0235792 A1 Dec. 25, 2003

(30) Foreign Application Priority Data

Mar. 22, 2002 (JP) ..... 2002-081631
Mar. 22, 2002 (JP) ..... 2002-081632

(51) Int. Cl.[7] ..... G03C 1/09; G03C 1/295

(52) U.S. Cl. ..... 430/264; 430/600; 430/604; 430/605

(58) Field of Search ..... 430/264, 600, 430/604, 605

(56) References Cited

U.S. PATENT DOCUMENTS 4,994,365 A * 2/1991 Looker et al. ..... 430/264
5,279,919 A * 1/1994 Okamura et al. ..... 430/264
5,284,732 A * 2/1994 Nii et al. ..... 430/264
5,316,890 A * 5/1994 Okamura et al. ..... 430/264
5,378,578 A * 1/1995 Hoshimiya et al. ..... 430/264
5,695,909 A * 12/1997 Oya et al. ..... 430/264
5,939,233 A * 8/1999 Husain et al. ..... 430/264
5,985,508 A * 11/1999 Ito et al. ..... 430/264
5,989,774 A * 11/1999 Loccufier et al. ..... 430/264
5,998,087 A * 12/1999 Loccufier et al. ..... 430/264
6,017,674 A * 1/2000 Ezoe et al. ..... 430/264
6,245,480 B1 * 6/2001 Bogie et al. ..... 430/264
6,355,394 B1 * 3/2002 Loccufier et al. ..... 430/264
6,361,920 B1 * 3/2002 Loccufier et al. ..... 430/264

* cited by examiner

*Primary Examiner*—Richard L. Schilling
(74) *Attorney, Agent, or Firm*—Birch, Stewart, Kolasch & Birch, LLP

(57) ABSTRACT

Disclosed are a silver halide photographic light-sensitive material comprising silver halide containing a metal complex having a cyanide ligand in a silver halide emulsion layer and comprising a hydrazine compound having an onium group in the molecule, and a method of developing the silver halide photographic light-sensitive material with a developer having a pH of 9.0–11.0. The silver halide photographic light-sensitive material of the present invention can provide high sensitivity, high processing stability and high contrast images.

18 Claims, 1 Drawing Sheet

SILVER HALIDE PHOTOGRAPHIC LIGHT-SENSITIVE MATERIALS AND METHOD FOR DEVELOPMENT OF THE SAME

TECHNICAL FIELD

The present invention relates to a silver halide photographic light-sensitive material. In particular, the present invention relates to an ultrahigh contrast negative type photographic light-sensitive material suitable as a silver halide photographic light-sensitive material used for a photomechanical process. The present invention also relates to a method for development of a silver halide photographic light-sensitive material.

RELATED ART

In photomechanical processes used in the field of graphic arts, used is a method in which photographic images of continuous tone are converted into so-called dot images in which variable image density is represented by sizes of dot areas, and such images are combined with photographed images of characters or line originals to produce printing plates. For silver halide photographic light-sensitive materials used for such a purpose, ultrahigh contrast photographic characteristic enabling clear distinction between image portions and non-image portions has been required in order to obtain favorable reproducibility of characters, line originals and dot images.

As a system responding to such a requirement of ultrahigh contrast photographic characteristic, there has been known the so-called lithographic development method in which a silver halide light-sensitive material comprising silver chlorobromide is treated with a hydroquinone developer having an extremely low effective concentration of sulfite ions to obtain images of high contrast. However, in this method, the developer is extremely unstable against oxidation by air since the sulfite ion concentration in the developer is extremely low, and therefore a lot of developer must be replenished in order to stably maintain the developer activity.

As image forming systems in which the instability of the image formation according to the lithographic development method is eliminated and light-sensitive materials are processed with a developer showing good storage stability to obtain ultrahigh contrast photographic characteristic, there can be mentioned those described in, for example, U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,681,836, 5,650,746 and so forth. These are systems in which a silver halide photographic light-sensitive material of surface latent image type containing a hydrazine compound is processed with a developer containing hydropuinone/metol or hydroquinone/phenidone as main developing agents and 0.15 mol/l or more of sulfite preservative and having pH of 11.0–12.3 to form ultrahigh contrast negative images having a gamma of 10 or higher. According to these systems, photographic characteristics of ultrahigh contrast and high sensitivity can be obtained, and because sulfite can be added to the developer at a high concentration, stability of the developer to air oxidation is markedly improved compared with the conventional lithographic developers.

In order to form sufficiently ultrahigh contrast images with use of a hydrazine compound, it is necessary to perform processing with a developer having pH of 11 or higher, usually 11.5 or higher. Although it becomes possible to increase the stability of the developer by use of a sulfite preservative at a high concentration, it is necessary to use such a developer of high pH as described above in order to obtain ultrahigh contrast photographic images, and the developer is likely to suffer from air oxidation and instable even with the presence of the preservative. Therefore, various attempts have been made in order to realize ultrahigh images with a lower pH to further improve stability of the developer.

For example, U.S. Pat. No. 4,269,929 (Japanese Patent Laid-open Publication (Kokai, henceforth referred to as "JP-A") No. 61-267759), U.S. Pat. No. 4,737,452 (JP-A-60-179734), U.S. Pat. Nos. 5,104,769, 4,798,780, JP-A-1-179939, JP-A-1-179940, U.S. Pat. Nos. 4,998,604, 4,994,365 and JP-A-8-272023 disclose methods of using a highly active hydrazine compound and a nucleation accelerator in order to obtain ultrahigh images by using a developer having pH of less than 11.0.

However, silver halide photographic light-sensitive materials used for such image-forming Systems have a problem concerning processing stability such as fluctuation of sensitivity caused by change of activities of the hydrazine compound and the nucleation accelerator due to exhaustion of processing solutions. As means for improving processing stability, use of an emulsion providing higher contrast can be mentioned. However, it has a problem that use of an emulsion providing higher contrast results in reduction of sensitivity. Therefore, it has been desired to develop a technique that can provide high sensitivity and superior processing stability.

Considering these problems of the conventional techniques, an object of the present invention is to provide a silver halide photographic light-sensitive material that provides high contrast, high sensitivity and favorable processing stability. Another object of the present invention is to provide a development method for use in processing of a light-sensitive material providing high contrast images in an automatic developing machine, which shows little fluctuation of photographic performance and no silver staining during running even with a small replenishing amount of a developer.

SUMMARY OF THE INVENTION

As a result of various researches of the inventors of the present invention, it was found that the aforementioned objects could be achieved by a silver halide photographic light-sensitive material defined in the following (1) to (4).

(1) A silver halide photographic light-sensitive material comprising at least one silver halide emulsion layer on a support, wherein the silver halide emulsion layer contains silver halide containing a metal complex having a cyanide ligand, and the silver halide photographic light-sensitive material contains a hydrazine compound having an onium group in the molecule.

(2) A silver halide photographic light-sensitive material comprising at least one silver halide emulsion layer on a support, wherein the silver halide emulsion layer contains silver halide containing a Group VIII metal compound, and the silver halide photographic light-sensitive material contains a hydrazine compound having an onium group in the molecule represented by the following formula (1):

Formula (1)

(1)

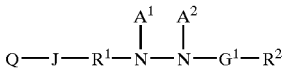

wherein $R^1$ represents an arylene group or a divalent heterocyclic group, Q represents an onium group, J represents a divalent bridging group, $—G^1—R^2$ represents $—COCF_2H$ or $—COCF_2CF_2COOM$, where M represents a hydrogen atom or a counter cation, and both of $A^1$ and $A^2$ represent a hydrogen atom, or one of them represents a hydrogen atom, and the other represents an acyl group, a sulfonyl group or an oxalyl group.

(3) A monochromatic silver halide photographic light-sensitive material which is developed with a developer having a pH of 9.0–11.0 and a replenishing amount of 330 $mL/m^2$ or less for the developer, wherein the monochromatic silver halide photographic light-sensitive material has one or more hydrophilic colloid layers on a support, at least one of the hydrophilic colloid layers is a silver halide emulsion layer, and the monochromatic silver halide photographic light-sensitive material contains at least one kind of a hydrazine compound having an onium group in the molecule.

(4) A monochromatic silver halide photographic light-sensitive material which is developed with a developer having a pH of 9.0–11.0, wherein the monochromatic silver halide photographic light-sensitive material has one or more hydrophilic colloid layers on a support, at least one of the hydrophilic colloid layers is a silver halide emulsion layer, and the monochromatic silver halide photographic light-sensitive material contains at least one kind of a hydrazine compound having an onium group in the molecule represented by the following formula (1):

Formula (1)

(1)

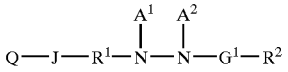

wherein $R^1$ represents an arylene group or a divalent heterocyclic group, Q represents an onium group, J represents a divalent bridging group, $—G^1—R^2$ represents $—COCF_2H$ or $—COCF_2CF_2COOM$, where M represents a hydrogen atom or a counter cation, and both of $A^1$ and $A^2$ represent a hydrogen atom, or one of them represents a hydrogen atom, and the other represents an acyl group, a sulfonyl group or an oxalyl group.

The hydrazine compound having an onium group in the molecule used in the present invention is preferably a compound represented by the following formula (1-a) or (1-b):

Formula (1-a)

(1-a)

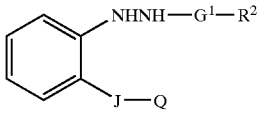

Formula (1-b)

(1-b)

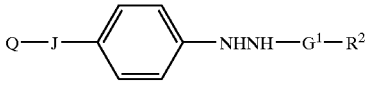

wherein $—G^1—R^2$ represents $—COCF_2H$ or $—COCF_2CF_2COOM$, where M represents a hydrogen atom or a counter cation, J represents an alkylene group, and Q represents a pyridinium group or a quinolinium group.

The present invention also provides a method for development of silver halide photographic light-sensitive material, which comprises developing the aforementioned silver halide photographic light-sensitive material with a developer having a pH of 9.0–11.0. In the development method of the present invention, the developer is preferably replenished in an amount of 330 $mL/m^2$ or less.

BEST MODE FOR CARRYING OUT THE INVENTION

Figure 1:
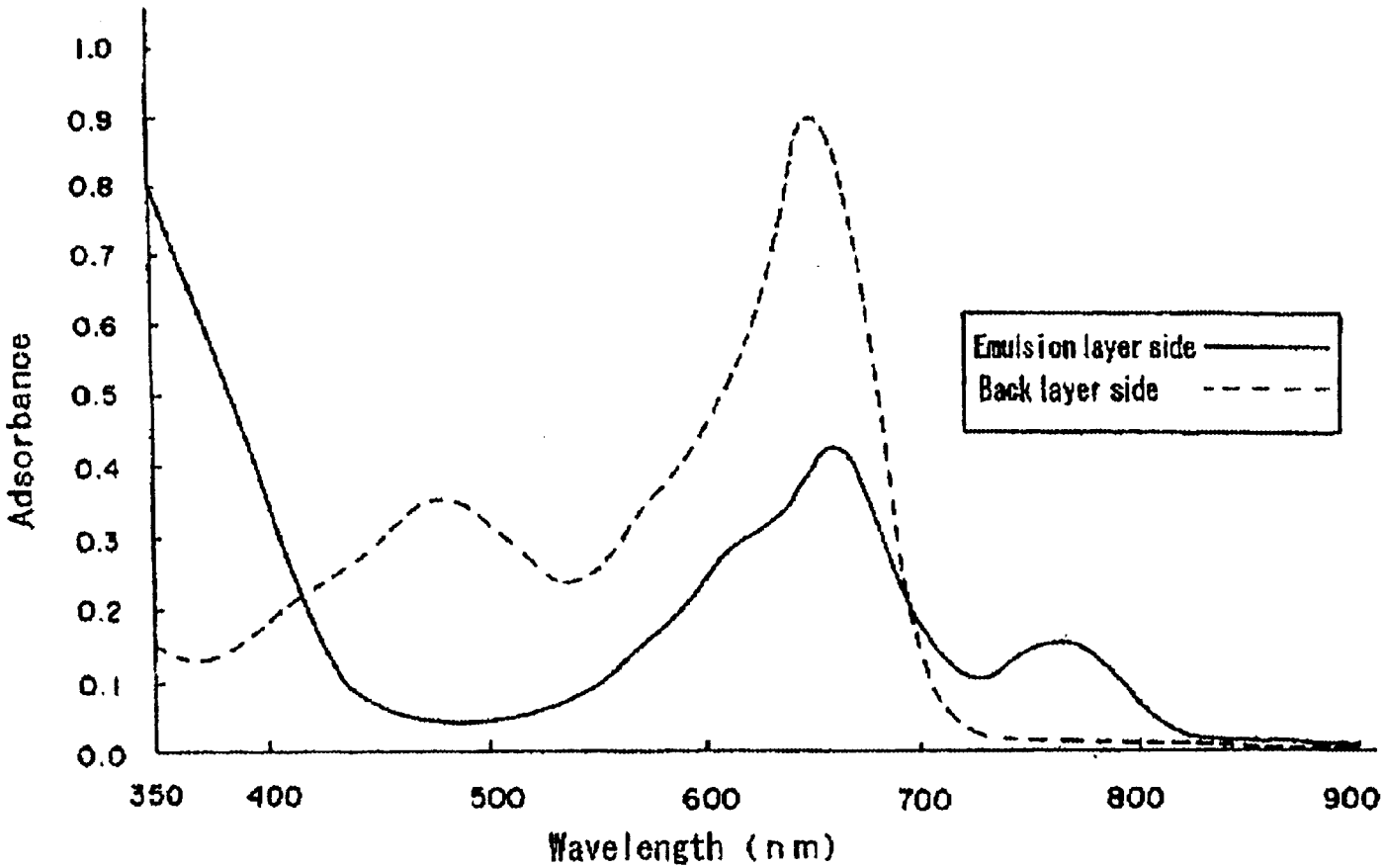
FIG. 1 shows absorption spectra for emulsion layer side and back layer side of a silver halide photographic light-sensitive material according to an embodiment of the present invention. The longitudinal axis represents absorbance (graduated in 0.1), and the transverse axis represents wavelength of from 350 nm to 950 nm. The solid line represents the absorption spectrum of the emulsion layer side, and the broken line represents the absorption spectrum of the back layer side.

The silver halide photographic light-sensitive material of the present invention will be explained in detail hereafter. In the present specification, ranges indicated with "-" mean ranges including the numerical values before and after "-" as the minimum and maximum values, respectively.

The silver halide photographic light-sensitive material of the present invention comprises at least one silver halide emulsion layer on a support. The silver halide photographic light-sensitive material of the present invention contains a hydrazine compound having an onium group in the molecule. The hydrazine compound having an onium group in the molecule is preferably a compound represented by the formula (1) or (2)

(1)

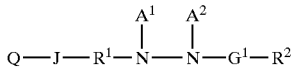

(2)

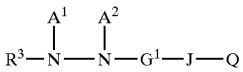

In the formula (1), the arylene group represented by $R^1$ is a substituted or unsubstituted arylene group having preferably 6–30 carbon atoms, more preferably 6–20 carbon atoms, in total. Examples include a phenylene group, a naphthylene group and so forth, and a phenylene group is particularly preferred. The divalent heterocyclic group represented by $R^1$ is a substituted or unsubstituted 5- or 6-membered aromatic heterocyclic ring containing at least one of N, O and S and preferably 2–30 carbon atoms, more preferably 2–20 carbon atoms, in total. Examples include pyridine ring, pyrimidine ring, oxazole ring, thiazole ring, quinoline ring, isoquinoline ring and so forth, and pyridine ring is particularly preferred.

$R^1$ may have one or more substituents. Examples of the substituent include, for example, a halogen atom (fluorine atom, chlorine atom, bromine atom or iodine atom), an alkyl group (linear, branched or cyclic alkyl group, including a bicycloalkyl group and an active methine group), an alkenyl group, an alkynyl group, an aryl group, a heterocyclic group (substitution position is not particularly limited), an acyl group, an alkoxycarbonyl group, an aryloxycarbonyl group, a heterocyclyloxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group or a salt thereof, an oxalyl group, an oxamoyl group, a cyano group, a carbonimidoyl group, a formyl group, a hydroxy group, an alkoxyl group (including a group containing a repeating unit of ethyleneoxy group or propyleneoxy group), an aryloxy group, a heterocyclyloxy group, an acyloxy group, an (alkoxy- or aryloxy)carbonyloxy group, a carbamoyloxy group, a sulfonyloxy group, an amino group, an (alkyl-, aryl- or heterocyclyl)amino group, an acylamino group, a sulfonamido group, a ureido group, a thioureido group, an N-hydroxyureido group, an imido group, an (alkoxy- or aryloxy) carbonylamino group, a sulfamoylamino group, a semicarbazido group, a thiosemicarbazido group, a hydrazino group, an ammonio group, an oxamoylamino group, an N-(alkyl or aryl) sulfonylureido group, an N-acylureido group, an N-acylsulfamoylamino group, a hydroxyamino group, a nitro group, an isocyano group, an imino group, a mercapto group, an (alkyl-, aryl- or heterocyclyl)thio group, an (alkyl-, aryl- or heterocyclyl) dithio group, an (alkyl- or aryl)sulfonyl group, an (alkyl- or aryl)sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group, a silyl group and so forth. The active methine group means a methine group substituted with two of electron-withdrawing groups. The electron-withdrawing group herein used means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. Two of the electron-withdrawing groups may bond to each other to form a ring structure. Further, a salt means a compound containing a cation such as cations of alkali metals, alkaline earth metals and heavy metals or organic cations such as ammonium ions and phosphonium ions. These substituents may be further substituted with these substituents. When two or more of these groups exist, they may be the same or different, and the substituents may bond to each other to form a ring.

$R^1$ in the formula (1) is preferably an arylene group, more preferably a phenylene group, particularly preferably an unsubstituted phenylene group.

In the formulas (1) and (2), Q represents an onium group, and examples include onium groups of nitrogen atom, phosphorus atom and sulfur atom. It is preferably a group represented by any of the following formulas (3) to (7).

Formula (3) to (7)

(3)

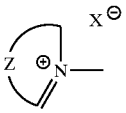

(4)

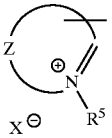

(5)

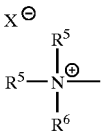

(6)

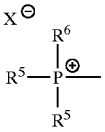

(7)

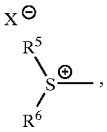

In the formulas (3) to (7), $R^5$ represents a substituted or unsubstituted aliphatic group, aryl group or heterocyclic group, Z represents an atomic group required to form a nitrogen-containing heteroaromatic ring together with a nitrogen atom in the formula, and $X^-$ represents a counter anion.

In the formulas (4) to (7), the aliphatic group represented by $R^5$ is a linear, branched or cyclic substituted or unsubstituted alkyl group, alkenyl group or alkynyl group having preferably 1–30 carbon atoms, more preferably 1–20 carbon atoms, in total. Examples include methyl group, ethyl group, hexyl group, 2-ethylhexyl group, benzyl group, dodecyl group, stearoyl group, 4-chlorobutyl group, cyclohexyl group, tert-butyl group, ethenyl group, ethynyl group and so forth, and preferred is an alkyl group. The aryl group represented by $R^5$ is a substituted or unsubstituted aryl group having preferably 6–30 carbon atoms, more preferably 6–20 carbon atoms, in total. Examples include phenyl group, 4-cyanophenyl group, 4-butylphenyl group, 2-naphthyl group and so forth, and particularly preferred is a phenyl group.

The heterocyclic group represented by $R^5$ is a substituted or unsubstituted 5- or 6-membered aromatic or non-aromatic heterocyclic group containing at least one of N, O and S, preferably a nitrogen-containing heteroaromatic ring (e.g., pyridine ring, quinoline ring, isoquinoline ring, imidazole ring etc.). $R^5$ may be further substituted with one or more other substituents, and the substituents can be selected from the groups mentioned as the substituents of $R^1$ in the formula (1). $R^5$ is more preferably an aliphatic group or an aryl group, particularly preferably an alkyl group or a phenyl group. Further, $R^5$ in the formulas (5) to (7) may be the same or different, and may bond to each other to form a ring.

In the formulas (3) and (4), the nitrogen-containing heteroaromatic ring formed by Z and the nitrogen atom is preferably a 5- or 6-membered substituted or unsubstituted nitrogen-containing heteroaromatic ring. This may be condensed to another ring (e.g., benzene ring, naphthalene ring, pyridine ring, thiophene ring, furan ring, pyrrole ring etc.). Examples of this nitrogen-containing heteroaromatic ring include oxazole ring, benzoxazole ring, thiazole ring, benzothiazole ring, pyridine ring, pyrimidine ring, quinoline ring, isoquinoline ring, quinazoline ring, acridine ring, imidazole ring, benzimidazole ring and so forth, preferred are pyridine ring, quinoline ring and isoquinoline ring, and particularly preferred is pyridine ring. Z may have one or more substituents, and for example, those mentioned as the substituents of $R^1$ in the formula (1) can be used.

In the formulas (1) and (2), Q is more preferably a group represented by the formula (3), (4) or (6), particularly preferably a group represented by the formula (3) or (4).

$X^-$ represents a counter anion, and examples include, for example, a halogen ion (chlorine, bromine, iodine etc.), a carboxylate ion (trifluoroacetate, pentachlorobenzoate etc.), a sulfonate ion (methanesulfonate, toluenesulfonate etc.), a sulfate ion, a perchlorate ion, a carbonate ion, a nitrate ion, a boron tetrafluoride ion, $PF^{6-}$ etc. Preferred are a halogen ion, a carboxylate ion and a sulfonate ion. When $X^-$ forms an intramolecular salt, it represents a counter anion portion.

In the formulas (1) and (2), the divalent bridging group represented by J is a group consisting of —$CH_2$—, —CH═CH—, —C≡C—, —$C_6H_4$—, —NH—, —O—, —S—, —CO—, —SO—, —$SO_2$—, —PO—, —CH═N— or a combination of these bridging groups. Examples of the combination include —CONH—, —$SO_2$NH—, —NHCONH—, —CONH$SO_2$—, —COO—, —($CH_2CH_2O$)n- (n=1–10), —$CH_2O$—, —($CH_2$)n- (n=2–20), —$CH_2$—$C_6H_4$— (bonding at any of o, m and p-position), combinations of these and combinations of these and the aforementioned bridging groups.

In the formula (1), it is particularly preferred that the atom in J directly bonding to $R^1$ is not a nitrogen atom.

In the formulas (1) and (2), the bridging group represented by J has preferably 1–20 carbon atoms, more preferably 2–10 carbon atoms, in total. These bridging groups may have one or more substituents instead of hydrogen atoms, and as the substituents, those mentioned as the substituents of $R^1$ in the formula (1) can be used. A particularly preferred bridging group represented by J is an alkylene group.

In the formulas (1) and (2), $G^1$ represents —CO—, —$SO_2$—, —SO—, —COCO—, thiocarbonyl group, iminomethylene group or —P(O) ($G^2R^4$)—, where $G^2$ represents a single bond, —O— or —$NR^4$—, and $R^4$represents a hydrogen atom, an aliphatic group, an aryl group or a heterocyclic group.

In the formula (1), $R^2$ represents a hydrogen atom, an alkyl group (preferably a linear, branched or cyclic substituted or unsubstituted alkyl group having 1–10 carbon atoms in total, for example, methyl group, difluoromethyl group, trifluoromethyl group, dichloromethyl group, pentafluoroethyl group, benzyl group, o-hydroxybenzyl group, methoxymethyl group, benzenesulfonylmethyl group, hydroxymethyl group, benzenesulfonylaminomethyl group, —$CF_2CF_2$COOK etc.), an aryl group (preferably a substituted or unsubstituted aryl group having 6–20 carbon atoms in total, for example, phenyl group, hydroxymethylphenyl group, chlorophenyl group etc.), a heterocyclic group (preferably a substituted or unsubstituted 5- or 6-membered aromatic or non-aromatic heterocyclic ring group containing at least one of N, O and S, for example, pyridyl group, thienyl group, furyl group, imidazolyl group, piperidyl group, pyrrolidyl group etc.), an alkoxyl group (preferably a substituted or unsubstituted alkoxyl group having 1–10 carbon atoms in total, for example, methoxy group, ethoxy group, butoxy group etc.), an aryloxy group (preferably a substituted or unsubstituted aryloxy group having 6–20 carbon atoms in total, for example, phenoxy group etc.), an amino group (preferably a substituted amino group having 1–10 carbon atoms in total, for example, methylamino group, dimethylamino group, phenylamino group etc.) or a carbamoyl group. $R^2$ may have one or more substituents, and as the substituents, those mentioned as the substituents of $R^1$ can be used.

In the formula (1), it is more preferred that the group represented by $G^1$ is —CO—, and the group represented by $R^2$ is an alkyl group that does not contain an onium group or a carbamoyl group that does not contain an onium group. In the formula (1), the group represented by —$G^1$—$R^2$ is particularly preferably —$COCF_2H$ or —$COCF_2CF_2$COOM (M represents a hydrogen atom or a counter cation).

In the formula (2), the aryl group represented by $R^3$ is a substituted or unsubstituted aryl group having preferably 6–30 carbon atoms, more preferably 6–20 carbon atoms, in total, for example, a phenyl group, a naphthyl group etc., particularly preferably a phenyl group. The heterocyclic group represented by $R^3$ is preferably a substituted or unsubstituted 5- or 6-membered aromatic heterocyclic ring containing at least one of N, O and S, for example, pyridine ring, pyrimidine ring, oxazole ring, thiazole ring, quinoline ring, isoquinoline ring or the like, particularly preferably pyridine ring. $R^3$ is preferably an aryl group, and a phenyl group is particularly preferred. $R^3$ may have one or more substituents, and as the substituents, those mentioned as the substituents of $R^1$ can be used.

In the formulas (1) and (2), both of $A^1$ and $A^2$ represent a hydrogen atom, or one of them represents a hydrogen atom, and the other represents an acyl group (e.g., acetyl group, benzoyl group etc.), a sulfonyl group (e.g., methanesulfonyl group, toluenesulfonyl group etc.) or an oxalyl group (e.g., ethoxyalyl group etc.). It is particularly preferred that both of $A^1$ and $A^2$ represent a hydrogen atom.

The hydrazine compound having an onium group in the molecule is preferably a compound represented by the formula (1), particularly preferably a compound represented by the aforementioned formula (1-a) or (1-b). In the formulas (1-a) or (1-b), —$G^1$—$R^2$ represents —$COCF_2H$ or —$COCF_2CF_2$COOM, where M represents a hydrogen atom or a counter cation, J represents an alkylene group, and Q represents a pyridinium group or a quinolinium group. Preferred specific examples of J and Q are similar to those mentioned above.

The compounds represented by the formula (1) or (2) have preferably 10–200 carbon atoms, more preferably 13–100 carbon atoms, particularly preferably 15–50 carbon atoms, in total. Further, a plurality of the compounds represented by the formula (1) or (2) may bond together through a bridging group to form a bis-compound or tris-compound, or a polymer structure having an average molecular weight of 500,000 or less.

The compounds represented by the formula (1) or (2) may contain an absorptive group capable of being absorbed onto silver halide. Examples of the absorptive group include an alkylthio group, an arylthio group, a thiourea group, a thioamido group, a mercaptoheterocyclic group, a triazole group and so forth, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049JP-A-61-170733, JP-A-61-270744, JP-A-62-948, JP-A-63-234244, JP-A-63-234245 and JP-A-63-234246. Further, these groups capable of being absorbed onto silver halide may be modified into a precursor thereof. Examples of the precursor include those groups described in JP-A-2-285344.

The compounds represented by the formula (1) or (2) may contain a ballast group or polymer that is usually used for immobile photographic additives such as couplers. In particular, those incorporated with a ballast group are preferred examples. The ballast group is a group relatively inert to photographic properties and having 8 or more carbon atoms, and can be selected from, for example, an alkyl group, an aralkyl group, an alkoxy group, a phenyl group, an alkylphenyl group, a phenoxy group, an alkylphenoxy group and so forth. Examples of the polymer include those described in, for example, JP-A-1-100530.

The compounds represented by the formula (1) or (2) may contain a group including a repeating unit of ethyleneoxy group or propyleneoxy group, an (alkyl-, aryl- or heterocyclyl)thio group or a dissociable group that can be dissociated with a base (a carboxy group, a sulfo group, an acylsulfamoyl group, a carbamoylsulfamoyl group etc.). In particular, those having a group containing a repeating unit of ethyleneoxy group or propyleneoxy group or an (alkyl-, aryl- or heterocyclyl)thio group are preferred examples.

Specific examples of the compounds of the formula (1) or (2) include, for example, those described as specific examples in U.S. Pat. No. 4,994,365, JP-A-5-45761, JP-A-5-34853, 5-45762, JP-A-5-45763, JP-A-5-45764, JP-A-5-150392, JP-A-5-204075, JP-A-5-204076, JP-A-5-216151, JP-A-5-33346G, JP-A-6-19032, JP-A-6-19031, JP-A-6-148777, JP-A-6-148778, JP-A-6-161010, JP-A-6-175253, JP-A-10-232456, JP-A-11-190887, DE3829078, DE4006032 and JP-A-4-96035.

Specific examples of the compounds represented by the formula (1) or (2) are illustrated below. However, the compounds represented by the formula (1) or (2) that can be used for the present invention are not limited to the following compounds.

(A-1)

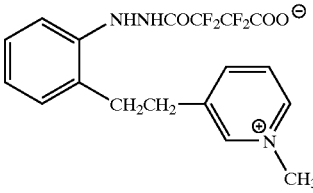

(A-2)

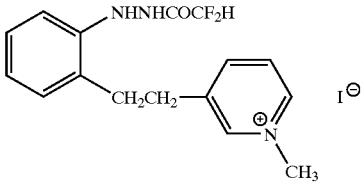

(A-3)

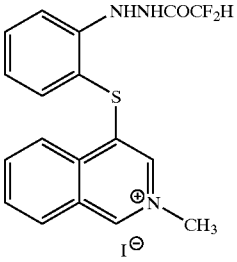

(A-4)

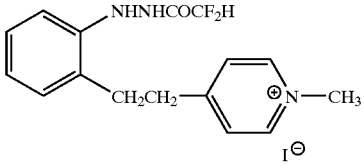

(A-5)

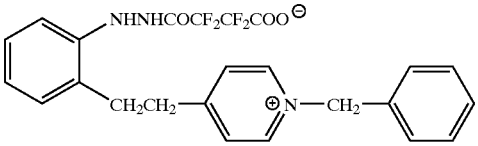

(A-6)

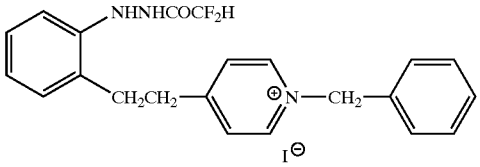

(A-7)

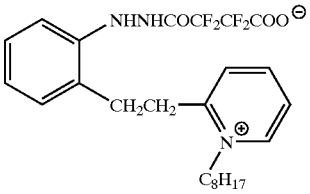

(A-8)

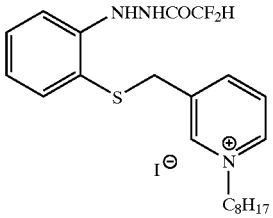

(A-9)

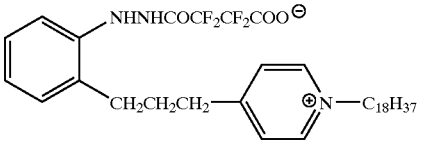

(A-10)

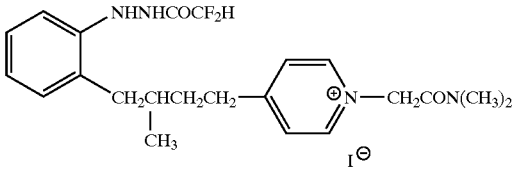

-continued
(A-11)
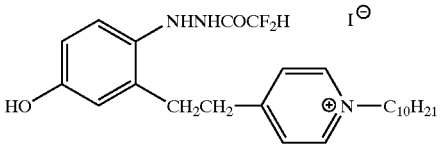
(A-12)
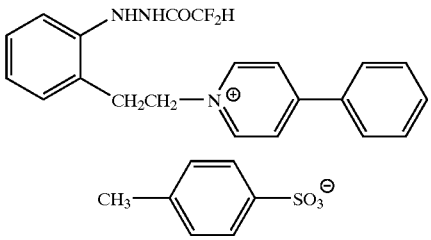
(A-13)
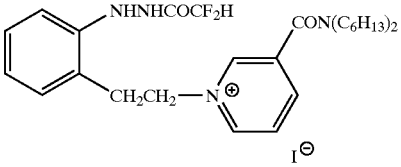
(A-14)
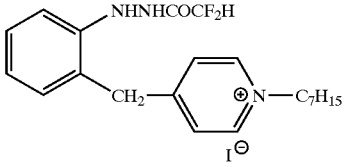
(A-15)
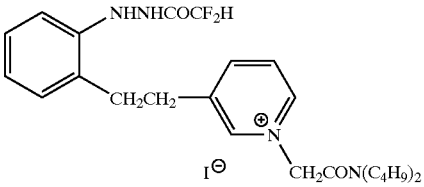
(A-16)
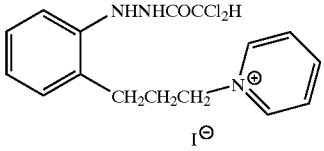
(A-17)
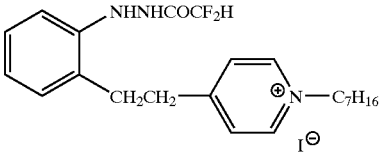
(A-18)
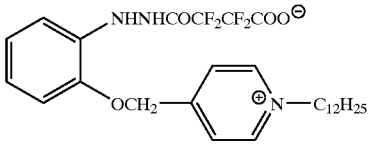
(A-19)
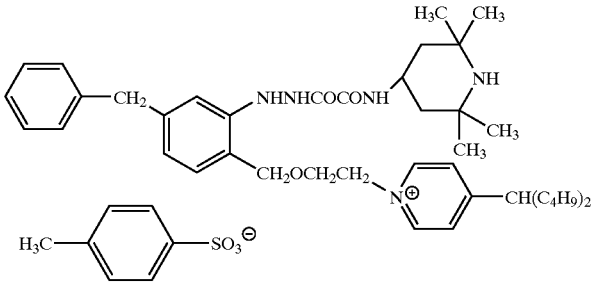
(A-20)
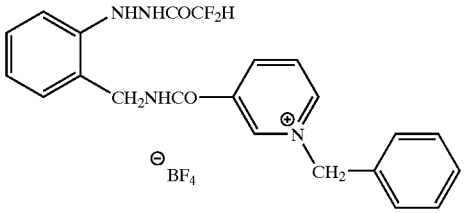
(A-21)
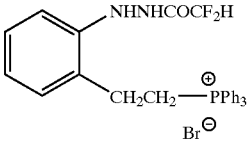
(A-22)
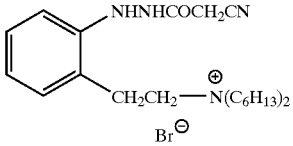
(A-23)
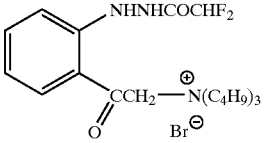
(A-24)
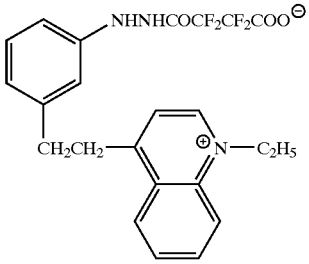

-continued
(A-25)
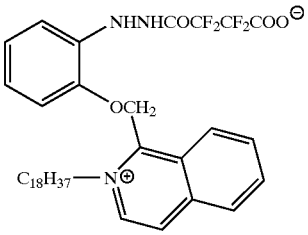
(A-26)
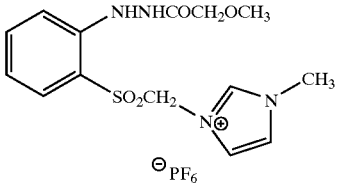
(A-27)
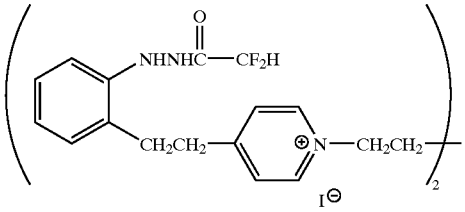
(A-28)
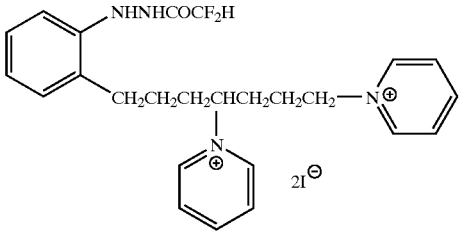
(A-29)
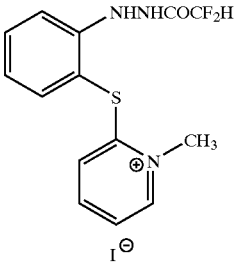
(A-30)
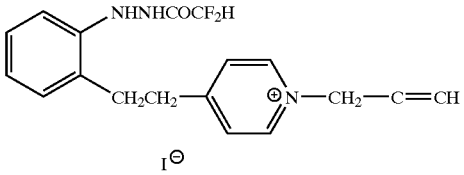
(A-31)
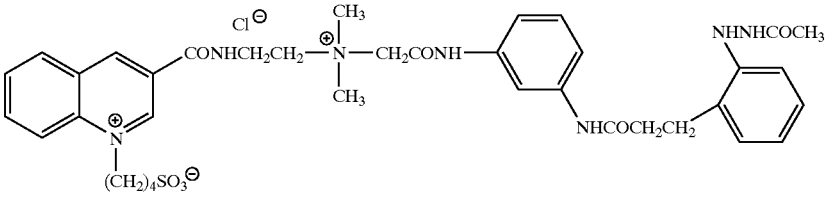
(A-32)
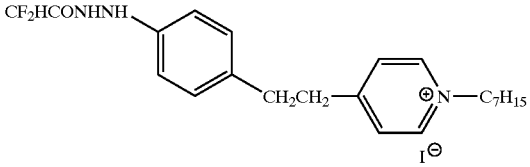
(A-33)
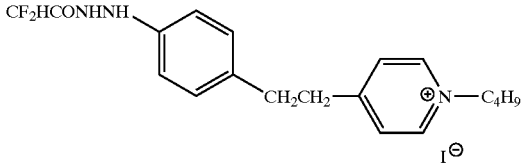
(A-34)
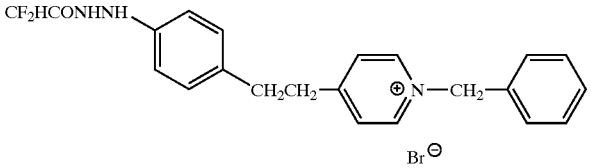
(A-35)
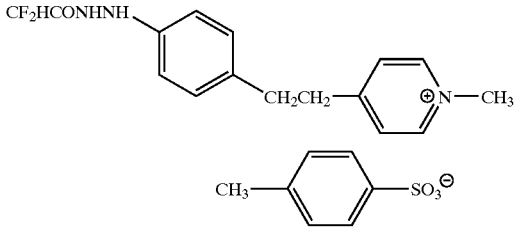
(A-36)
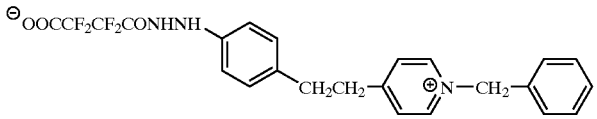
(A-37)
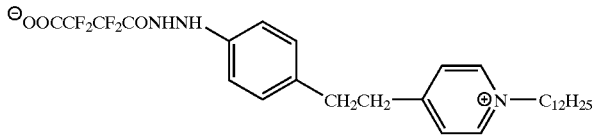

-continued
(A-38)
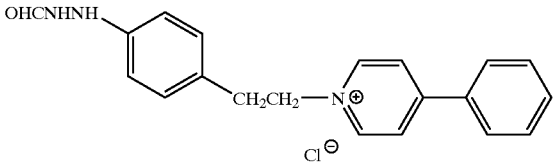
(A-39)
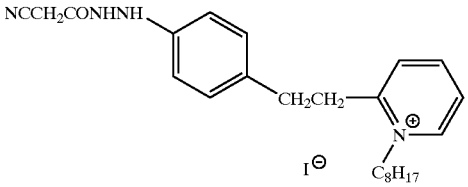
(A-40)
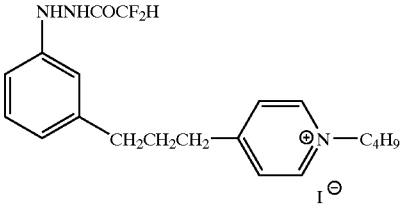
(A-41)
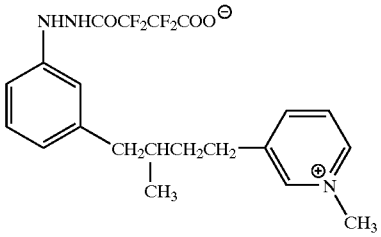
(A-42)
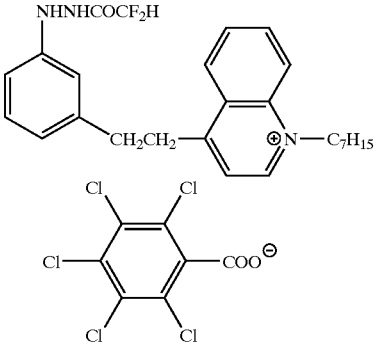
(A-43)
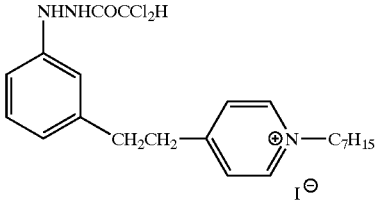
(A-44)
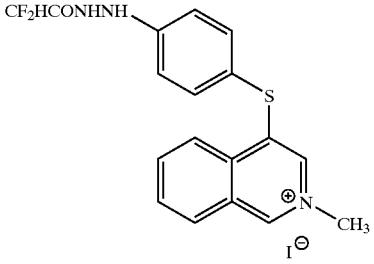
(A-45)
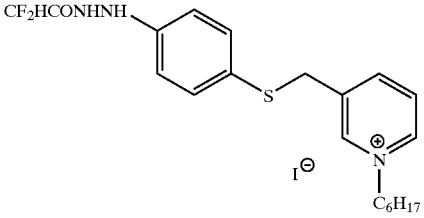
(A-46)
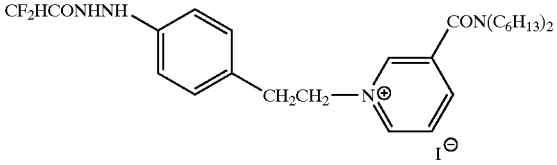
(A-47)
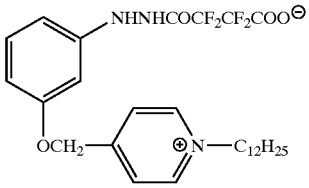

-continued
(A-48)
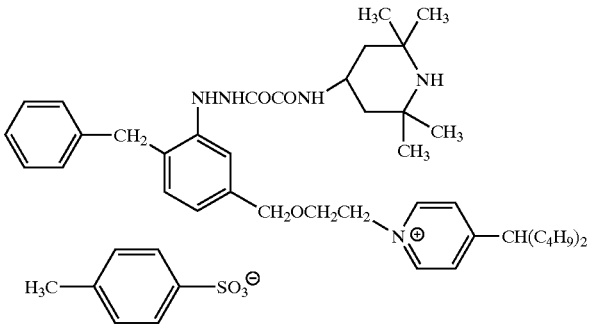
(A-49)
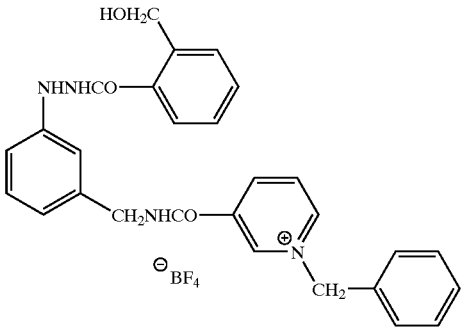
(A-50)
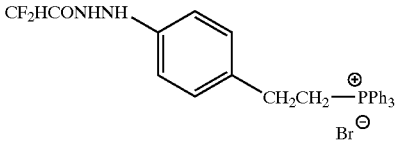
(A-51)
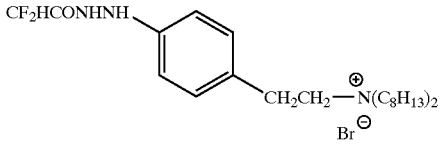
(A-52)
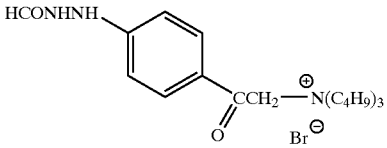
(A-53)
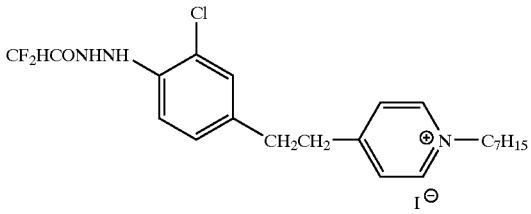
(A-54)
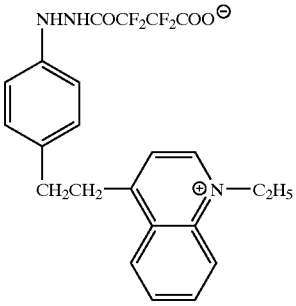
(A-55)
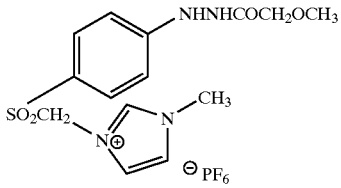
(A-56)
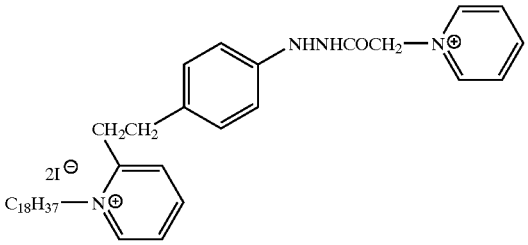
(A-57)
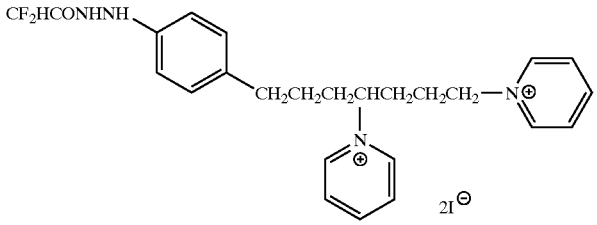
(A-58)
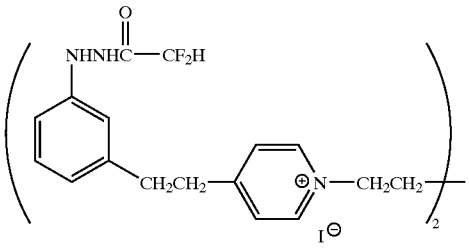
(A-59)
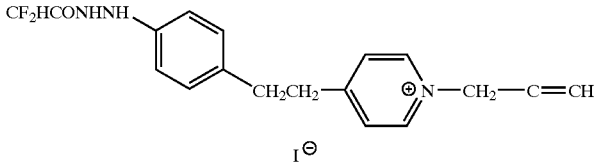

-continued
(A-60)
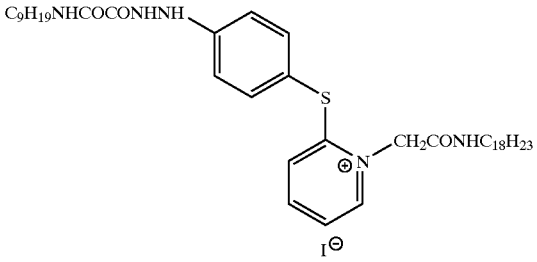
(A-61)
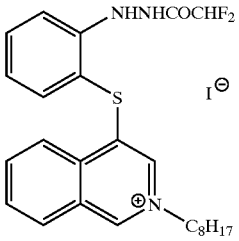
(A-62)
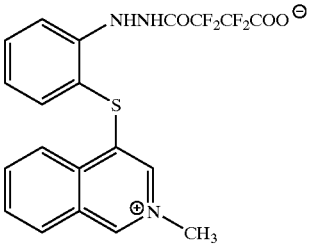
(A-63)
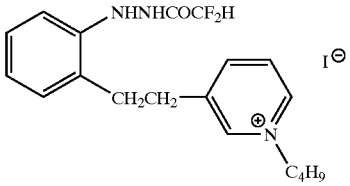
(A-64)
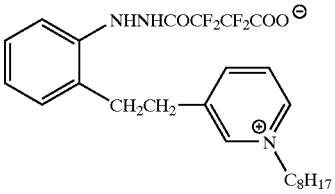
(A-65)
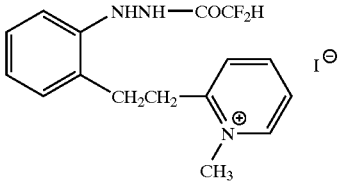
(A-66)
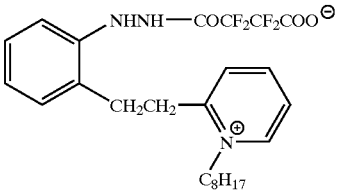
(A-67)
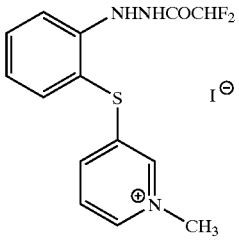
(A-68)
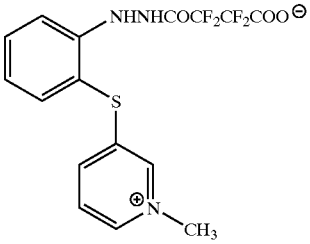
(A-69)
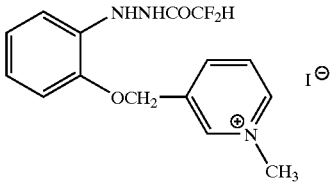
(A-70)
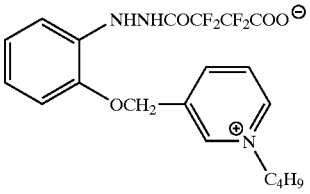
(A-71)
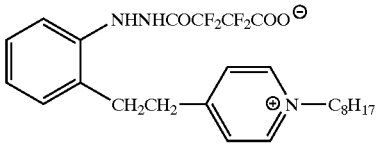

-continued
(A-72)
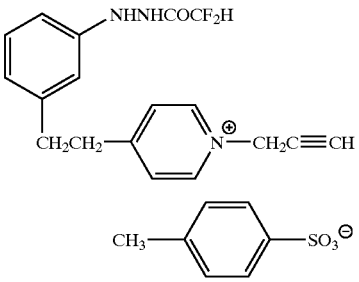
(A-73)
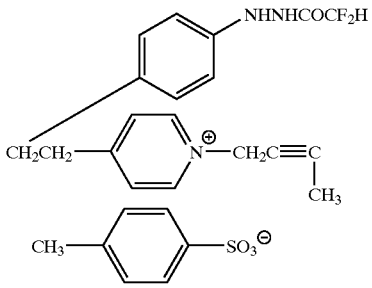
(A-74)
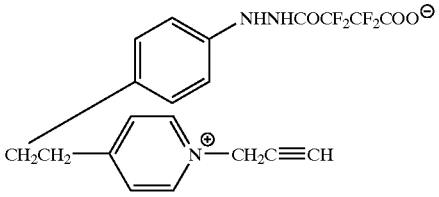
(A-75)
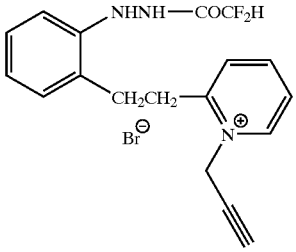
(A-76)
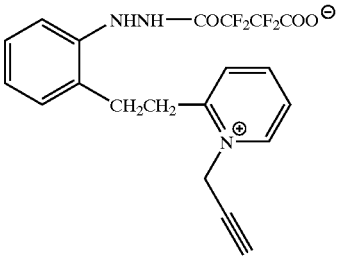
(A-77)
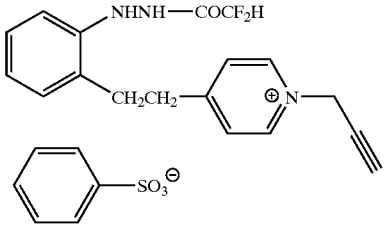
(A-78)
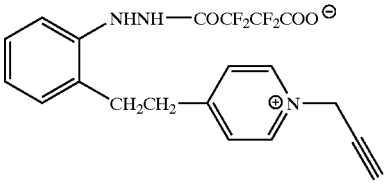
(A-79)
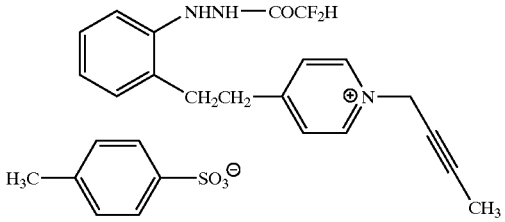
(A-80)
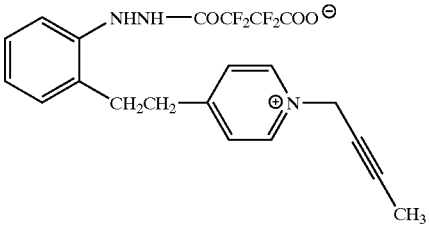
(A-81)
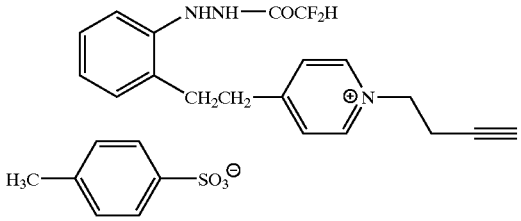
(A-82)
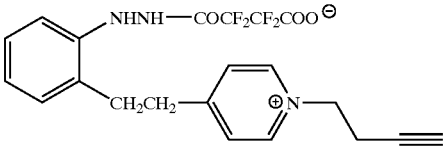
(A-83)
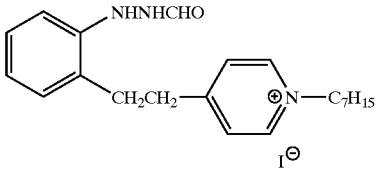

-continued
(A-84)
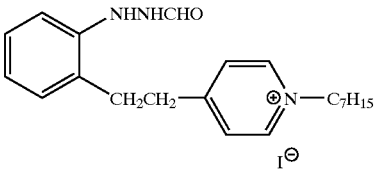
(A-85)
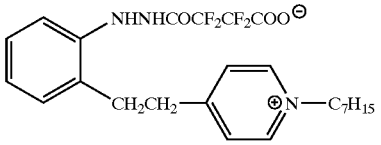
(A-86)
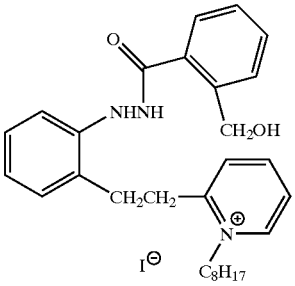
(A-87)
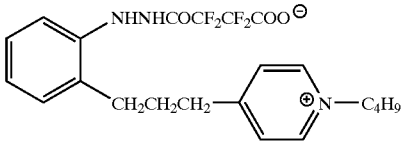
(A-88)
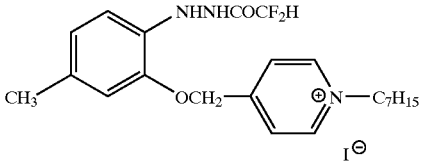
(A-89)
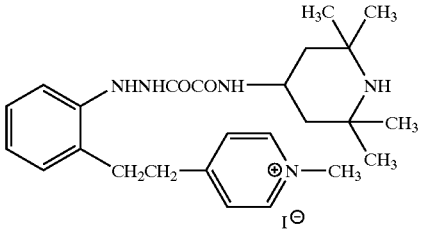
(A-90)
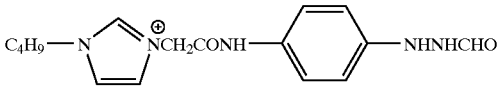
(A-91)
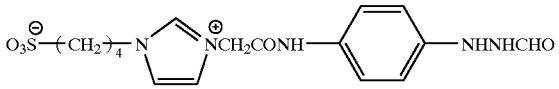
(A-92)
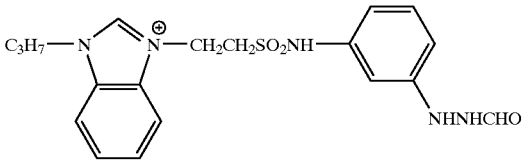
(A-93)
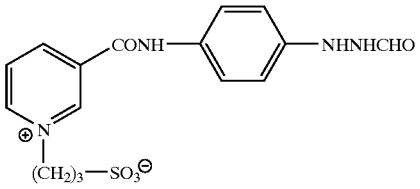
(A-94)
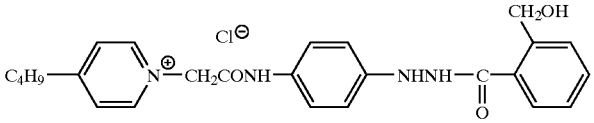
(A-95)
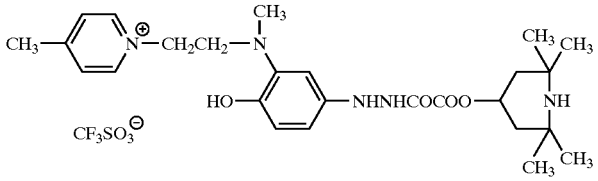
(A-96)
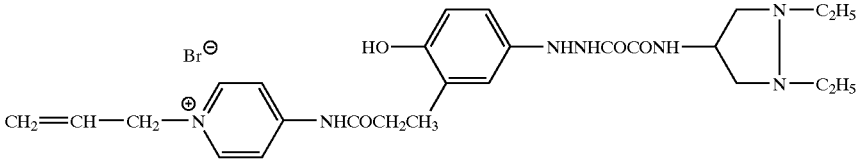
(A-97)
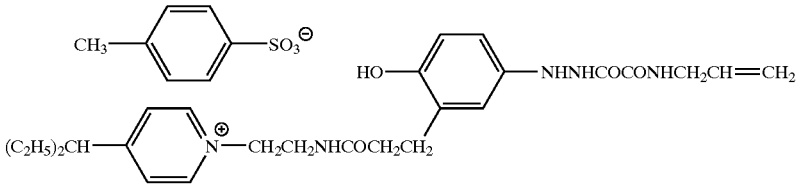

-continued
(A-98)
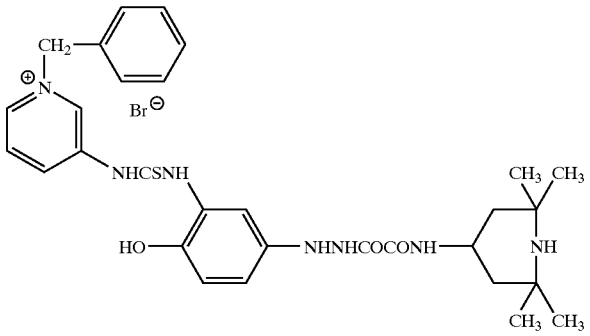
(A-99)
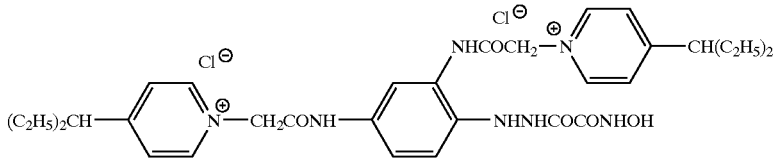
(A-100)
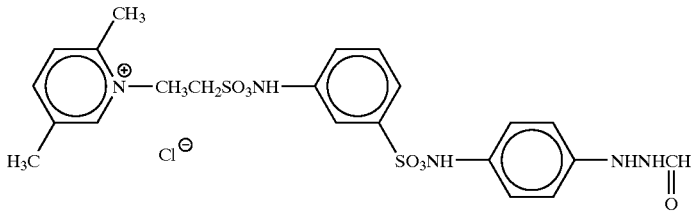
(A-101)
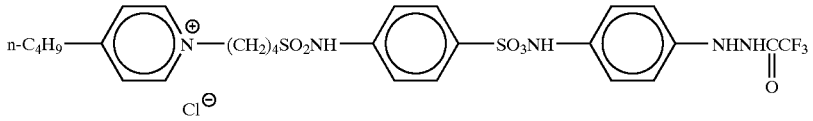
(A-102)
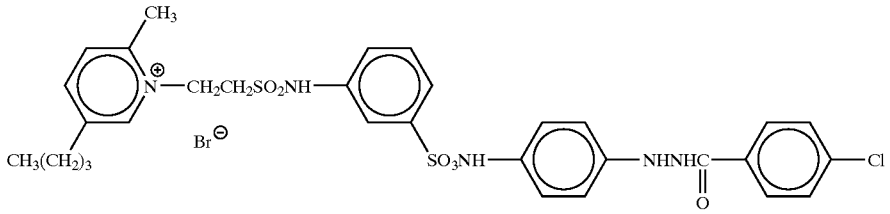
(A-103)
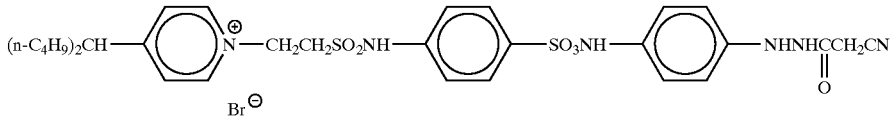
(A-104)
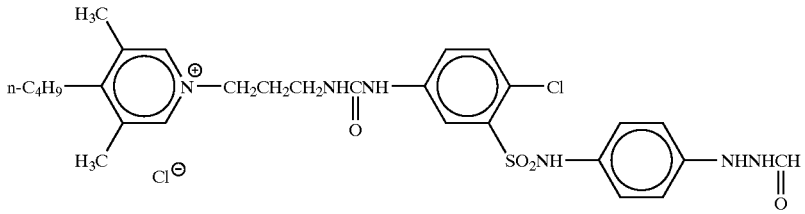

-continued (A-105)

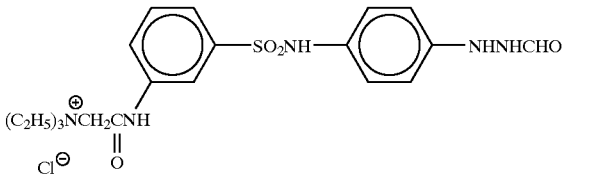

(A-106)

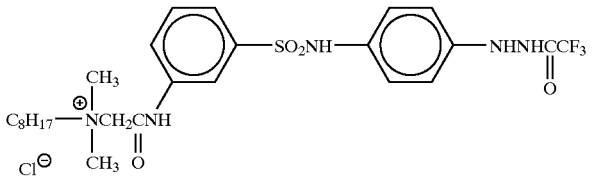

(A-107)

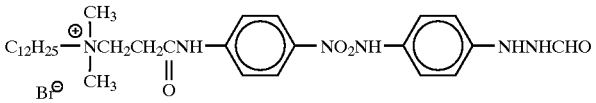

(A-108)

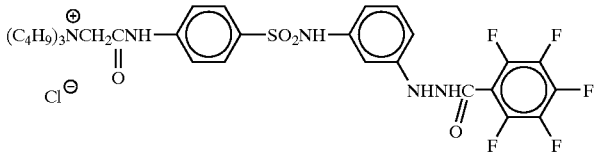

(A-109)

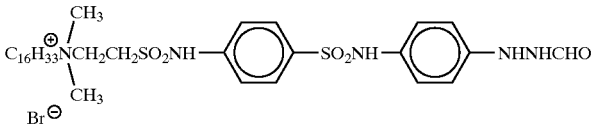

(A-110)

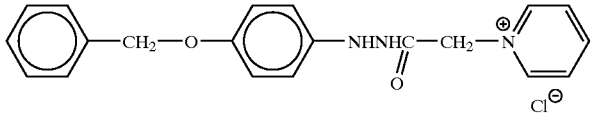

The hydrazine compounds having an onium group in the molecules may be dissolved in an appropriate water-miscible organic solvent, such as an alcohol (e.g., methanol, ethanol, propanol, fluorinated alcohol), ketone (e.g., acetone, methyl ethyl ketone), dimethylformamide, dimethyl sulfoxide, methyl cellosolve or the like, before use.

The hydrazine compounds having an onium group in the molecules may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of the hydrazine compounds may also be dispersed in water by means of ball mill, colloid mill or ultrasonic waves according to a method known as solid dispersion method and used.

In the present invention, the hydrazine compounds having an onium group in the molecules may be added to any layer on the silver halide emulsion layer side of the support. For example, it can be added to a silver halide emulsion layer or another hydrophilic colloid layer. However, it is preferably added to a silver halide emulsion layer or a hydrophilic colloid layer adjacent thereto. Further, two or more kinds of hydrazine compounds having an onium group in the molecules may be used in combination.

The addition amount of the hydrazine compounds having an onium group in the molecules in the present invention is preferably $1\times10^{-5}$ to $1\times10^{-2}$ mol, more preferably $1\times10^{-5}$ to $5\times10^{-3}$ mol, most preferably from $2\times10^{-5}$ to $5\times10^{-3}$ mol, per mol of silver halide.

In the present invention, the hydrazine compounds having an onium group in the molecules may be readily synthesized by a known method such as the method described in JP-A-10-232456.

Silver halide composition of the silver halide emulsion used for the silver halide photographic light-sensitive material of the present invention is not particularly limited, and an arbitrary composition selected from, for example, silver chloride, silver bromide, silver chlorobromide, silver iodobromide, silver iodochloride and silver chloroiodobromide may be used. In the present invention, silver chlorobromide or silver chloroiodobromide having a silver bromide content of 20 mol % or more is preferably used, silver chlorobromide or silver chloroiodobromide having a silver bromide content of 40 mol % or more is more preferably used, and silver chlorobromide or silver chloroiodobromide having a silver bromide content of 45–75 mol % is further preferably used. The form of silver halide grain may be any of cubic, tetradecahedral, octahedral, variable and tabular forms, but a form having an aspect ratio (diameter as circle/thickness) of 2 or less is preferred, and a cubic form is most preferred. The silver halide grains preferably have a mean grain size of 0.1–0.7 μm, more preferably 0.1–0.5 μm, and preferably has a narrow grain size distribution in terms of a variation coefficient, which is represented as {(Standard deviation of grain size)/(mean grain size)}×100, of preferably 15% or less, more preferably 10% or less.

The silver halide grains may have uniform or different phases for the inside and the surface layer. Further, they may have a localized layer having a different halogen composition inside the grains or as surface layers of the grains.

The photographic emulsion used for the present invention can be prepared by using the methods described in P. Glafkides, Chimie et Physique Photographique, Paul Montel (1967); G. F. Duffin, Photographic Emulsion Chemistry, The Focal Press (1966); V. L. Zelikman et al, Making and Coating Photographic Emulsion, The Focal Press (1964) and so forth.

That is, any of an acidic process and a neutral process may be used. In addition, a soluble silver salt may be reacted with a soluble halogen salt by any of the single jet method, double jet method and a combination thereof. A method of forming grains in the presence of excessive silver ions (so-called reverse mixing method) may also be used.

As one type of the double jet method, a method of maintaining the pAg constant in the liquid phase where silver halide is produced, that is, the so-called controlled double jet method, may also be used. Further, it is preferable to form grains using the so-called silver halide solvent such as ammonia, thioether or tetra-substituted thiourea. More preferred as the silver halide solvent is a tetra-substituted thiourea compound, and it is described in JP-A-53-82408 and JP-A-55-77737. Preferred examples of the thiourea compound include tetramethylthiourea and 1,3-dimethyl-2-imidazoli-dinethione. While the amount of the silver halide solvent to be added may vary depending on the kind of the compound used, the desired grain size and halide composition of silver halide to be desired, it is preferably in the range of from $10^{-5}$ to $10^{-2}$ mol per Mol of silver halide.

According to the controlled double jet method or the method of forming grains using a silver halide solvent, a silver halide emulsion comprising regular crystal form grains and having a narrow grain size distribution can be easily prepared, and these methods are useful for preparing the silver halide emulsion used for the present invention.

In order to achieve a uniform grain size, it is preferable to rapidly grow grains within the range of not exceeding the critical saturation degree by using a method of changing the addition rate of silver nitrate or alkali halide according to the grain growth rate as described in British Patent No. 1,535,016, Japanese Patent Publication (Kokoku, henceforth referred to as "JP-B") No. 48-36890 and JP-B-52-16364, or a method of changing the concentration of the aqueous solution as described in U.S. Pat. No. 4,242,445 and JP-A-55-158124.

The silver halide emulsion used for the present invention preferably contains a metal complex having one or more cyanide ligands in an amount of $1\times10^{-6}$ mol or more, more preferably $5\times10^{-6}$ to $1\times10^{-2}$ mol, particularly preferably $5\times10^{-6}$ to $5\times10^{-3}$ mol, per mol of silver in the silver halide.

The metal complex having one or more cyanide ligands used for the present invention is added in the form of a water-soluble complex salt. Particularly preferred complexes include hexa-coordinated complexes represented by the following formula.

$$[M(CN)_{n1}L_{6-n1}]^{n-}$$

In the formula, M represents a metal belonging to any one of Groups V to VIII, and Ru, Re, Os and Fe are particularly preferred. L represents a ligand other than cyanide, and halide ligand, nitrosyl ligand, thionitrosyl ligand and so forth are preferred. n1 represents an integer of 1–6, and n represents 0, 1, 2, 3 or 4. n1 is preferably 6. In these compounds, the counter ion does not play any important role, and an ammonium ion or alkali metal ion is used Specific examples of the complexes used for the present invention are mentioned below. However, complexes that can be used for the present invention are not limited to these.

| | |
|---|---|
| $[Re(NO)(CN)_5]^{2-}$ | $[Re(O)_2(CN)_4]^{3-}$ |
| $[Os(NO)(CN)_5]^{2-}$ | $[Os(CN)_6]^{4-}$ |
| $[Os(O)_2(CN)_4]^{4-}$ | |
| $[Ru(CN)_6]^{4-}$ | $[Fe(CN)_6]^{4-}$ |

The metal complex used for the present invention may present at any site in the silver halide grains. When silver halide crystals have a structure comprising a surface layer and a core, it preferably exists in the core.

In the present invention, it is preferred that silver halide has a structure comprising a core and a surface layer, and the core contains 99 mol % or less of silver in the silver halide crystals and the metal complex containing one or more cyanide complex. Further, it is more preferred that silver halide has a structure comprising a core and a surface layer, and the core contains 95 mol % or less of silver in the silver halide crystals and the metal complex containing one or more cyanide complex.

A silver halide emulsion preferably used for the present invention may contain a metal belonging to Group VIII. In particular, it is preferable to add a rhodium compound, iridium compound or ruthenium compound in order to achieve high contrast and low fog. Further, a hexacyanide metal complex such as $K_4[Fe(CN)_6]$, $K_4[Ru(CN)_6]$ and $K_3[Cr(CN)_6]$ is effectively doped to attain higher sensitivity.

As the rhodium compound used for the present invention, a water-soluble rhodium compound can be used. Examples thereof include rhodium(III) halide compounds and rhodium complex salts having a halogen, amine, oxalato, aquo or the like as a ligand, such as hexachlororhodium(III) complex salt, pentachloroaquorhodium complex salt, tetrachlorodiaquorhodium complex salt, hexabromorhodium(III) complex salt, hexaminerhodium(III) complex salt and trioxalatorhodium (III) complex salt. These rhodium compounds are dissolved in water or an appropriate solvent prior to use, and a method commonly used for stabilizing the rhodium compound solution, that is, a method of adding an aqueous solution of hydrogen halide (e.g., hydrochloric acid, hydrobromic acid, hydrofluoric acid etc.) or an alkali halide (e.g., KCl, NaCl, KBr, NaBr etc.), may be used. In place of using a water-soluble rhodium, separate silver halide grains that have been previously doped with rhodium may be added and dissolved at the time of preparation of silver halide.

The rhenium, ruthenium or osmium used for the present invention is added in the form of a water-soluble complex salt described in JP-A-63-2042, JP-A-1-285941, JP-A-2-20852, JP-A-2-20855 and so forth. Particularly preferred examples are six-coordinate complex salts represented by the following formula:

$$[ML_6]^{n-}$$

In the formula, M represents Ru, Re or Os, L represents a ligand, and n represents 0, 1, 2, 3 or 4. In this case, the counter ion plays no important role and an ammonium or alkali metal may be used. Preferred examples of the ligand include a halide ligand, a cyanide ligand, a cyan oxide ligand, a nitrosyl ligand, a thionitrosyl ligand and so forth. Specific examples of the complex that can be used for the present invention are shown below. However, the complex that can be used for the present invention is not limited to these.

| | |
|---|---|
| $[ReCl_6]^{3-}$ | $[ReBr_6]^{3-}$ |
| $[ReCl_5(NO)]^{2-}$ | $[Re(NS)Br_5]^{2-}$ |
| $[Re(NO)(CN)_5]^{2-}$ | $[Re(O)_2(CN)_4]^{3-}$ |
| $[ReCl_6]^{3-}$ | $[RuCl_4(H_2O)_2]^{-}$ |
| $[RuCl_5(NO)]^{2-}$ | $[RuBr_5(NS)]^{2-}$ |
| $[Ru(CO)_3Cl_3]^{2-}$ | $[Ru(CO)Cl_5]^{2-}$ |
| $[Ru(CO)Br_5]^{2-}$ | $[OsCl_6]^{3-}$ |
| $[OsCl_5(NO)]^{2-}$ | $[Os(NO)(CN)_5]^{2-}$ |
| $[Os(NS)Br_5]^{2-}$ | $[Os(CN)_6]^{4-}$ |
| $[Os(O)_2(CN)_4]^{4-}$ | |

The amount of these compounds is preferably $1\times10^{-9}$ to $1\times10^{-5}$ mol, particularly preferably $1\times10^{-8}$ to $1\times10^{-6}$ mol, per mole of silver halide.

The iridium compounds used in the present invention include hexachloroiridium, hexabromoiridium, hexaammine-iridium, pentachloronitrosyliridium and so forth. The iron compounds used in the present invention include potassium hexacyanoferrate(II) and ferrous thiocyanate.

The silver halide emulsion used for the present invention is preferably subjected to chemical sensitization. The chemical sensitization may be performed by using a known method such as sulfur sensitization, selenium sensitization, tellurium sensitization, noble metal sensitization or the like.

These sensitization methods may be used each alone or in any combination. When these sensitization methods are used in combination, preferable combinations include sulfur and gold sensitizations, sulfur, selenium and gold sensitizations, sulfur, tellurium and gold sensitizations and so forth.

The sulfur sensitization used in the present invention is usually performed by adding a sulfur sensitizer and stirring the emulsion at a high temperature of 40° C. or above for a predetermined time. The sulfur sensitizer may be a known compound, and examples thereof include, in addition to the sulfur compounds contained in gelatin, various sulfur compounds such as thiosulfates, thioureas, thiazoles and rhodanines, among which thiosulfate and thiourea compounds are preferred. As thiourea compounds, the particular tetra-substituted thiourea compounds described in U.S. Pat. No. 4,810,626 are particularly preferred. Although the amount of the sulfur sensitizer to be added varies depending on various conditions such as pH, temperature and grain size of silver halide at the time of chemical ripening, it is preferably $10^{-7}$ to $10^{-2}$ mole more preferably $10^{-5}$ to $10^{-3}$ mol, per mol of silver halide.

The selenium sensitizer used for the present invention may be a known selenium compound. That is, the selenium sensitization is usually performed by adding a labile and/or non-labile selenium compound and stirring the emulsion at a high temperature of 40° C. or above for a predetermined time. Examples of the labile selenium compound include those described in JP-n-44-15748, JP-B-43-13489, JP-A-4-109240 and JP-A-4-324855. Among these, particularly preferred are those compounds represented by formulas (VIII) and (IX) described in JP-A-4-324855.

The tellurium sensitizer that can be used for the present invention is a compound capable of producing silver telluride, presumably serving as a sensitization nucleus, on the surface or inside of silver halide grains. The rate of the formation of silver telluride in a silver halide emulsion can be examined according to the method described in JP-A-5-313284.

Specifically, there can be used the compounds described in U.S. Pat. Nos. 1,623,499, 3,320,069 and 3,772,031; British Patents Nos. 235,211, 1,121,496, 1,295,462 and 1,396,696; Canadian Patent No. 800,958; JP-A-4-204640, JP-A-4-271341, JP-A-4-333043, JP-A-5-303157; J. Chem. Soc. Chem. Commun., 635 (1980); ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986) ; and ibid., Vol. 2 (1987). The compounds represented by the formulas (II), (III) and (IV) described in JP-A-4-324855 are particularly preferred.

The amount of the selenium or tellurium sensitizer used for the present invention varies depending on silver halide grains used, chemical ripening conditions etc. However, it is generally about $10^{-8}$ to about $10^{-2}$ mol, preferably from about $10^{-7}$ to about $10^{-3}$ mol, per mol of silver halide. The conditions for chemical sensitization in the present invention are not particularly restricted. However, in general, pH is 5–8, pAg is 6–11, preferably 7–10 and temperature is 40–95° C., preferably 45–85° C.

Noble metal sensitizers that can be used for the present invention include gold, platinum, palladium, iridium etc., and gold sensitization is particularly preferred. Specific examples of the gold sensitizers used for the present invention include chloroauric acid, potassium chloroaurate, potassium aurithiocyanate, gold sulfide and so forth, which can be used in an amount of about $10^{-7}$ to about $10^{-2}$ mol per mol of silver halide.

As for the silver halide emulsion used for the present invention, production or physical ripening process for the silver halide grains may be performed in the presence of a cadmium salt, sulfite, lead salt, thallium salt or the like.

In the present invention, reduction sensitization may be used. Examples of the reduction sensitizer include stannous salts, amines, formamidinesulfinic acid, silane compounds and so forth.

To the silver halide emulsion used in the present invention, a thiosulfonic acid compound may be added according to the method described in EP293917A.

In the silver halide photographic light-sensitive material of the present invention, one to three kinds of silver halide emulsions are preferably used in combination. When two or more kinds of silver halide emulsions are used, those having different average grain sizes, different halogen compositions, those containing metal complexes of different amounts or types, those having different crystal habits, those subjected to chemical sensitizations with different conditions or those having different sensitivities are preferably used in combination. In order to obtain high contrast, it is especially preferable to coat an emulsion having higher sensitivity as it becomes closer to a support as described in JP-A-6-324426.

The light-sensitive silver halide emulsion used in the present invention may be spectrally sensitized with a sensitizing dye for comparatively long wavelength, i.e., blue light, green light, red light or infrared light, depending on the purpose of the light-sensitive material. As the sensitizing dyes, cyanine dyes, merocyanine dyes, complex cyanine dyes, complex merocyanine dyes, holopolar cyanine dyes, styryl dyes, hemicyanine dyes, oxonol dyes, hemioxonol dyes and so forth may be used.

Useful sensitizing dyes that can be used for the present invention are described in, for example, Research Disclosure, Item 17643, IV-A, page 23 (December, 1978); ibid., Item 18341X, page 437 (August, 1979) and references cited in the same.

In particular, sensitizing dyes having spectral sensitivity suitable for spectral characteristics of light sources in various scanners, image setters or photomechanical cameras can also be advantageously selected.

For example, A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, compounds of Examples 1 to 14 described in U.S. Pat. No. 2,161,331, and Compounds 1 to 7 described in West Germany Patent No. 936,071; B) for a helium-neon laser light source or red laser diode light source, Compounds I-1 to I-38 described in JP-A-54-18726, Compounds I-1 to I-35 described in JP-A-6-75322, Compounds I-1 to I-34 described in JP-A-7-287338, and Compounds 2-1 to 2-14, 3-(1) to 3-(14) and 4-1 to 4-6 described in Japanese Patent No. 2822138; C) for an LED light source, Dyes 1 to 20 described in JP-B-55-39818, Compounds I-1 to I-37 described in JP-A-62-284343, Compounds I-1 to I-34 described in JP-A-7-287338, and Compounds 2-1 to 2-14, 3-(1) to 3-(14) and 4-1 to 4-6 described in Japanese Patent No. 2822138; D) for a semiconductor laser light source, Compounds I-1 to I-12 described in JP-A-59-191032, Compounds I-1 to I-22 described in JP-A-60-80841, Compounds I-1 to I-29 described in JP-A-4-335342, and Compounds I-1 to I-18 described in JP-A-59-192242; and E) for a tungsten or xenon light source of a photomechanical camera, Compounds (1) to (19) represented by the formula (I) described in JP-A-55-45015, Compounds 4-A to 4-S, Compounds 5-A to 5-Q, Compounds 6-A to 6-T described in JP-A-6-242547, and Compounds I-1 to I-97 described in JP-A-9-160185 and so forth may be advantageously selected. However, the present invention is not limited to these compounds.

These sensitizing dyes may be used individually or in combination, and a combination of sensitizing dyes is often used for the purpose of, in particular, supersensitization. In combination with a sensitizing dye, a dye which itself has no spectral sensitization effect, or a material that absorbs substantially no visible light, but exhibits supersensitization effect may be incorporated into the emulsion.

Useful sensitizing dyes, combinations of dyes that exhibit supersensitization effect, and materials that show supersensitization effect are described in, for example, Research Disclosure, Vol. 176, 17643, page 23, Item IV-J (December 1978); JP-B-49-25500, JP-B-43-4933, JP-A-59-19032, JP-A-59-192242 mentioned above and so forth.

The sensitizing dyes used for the present invention may be used in a combination of two or more of them. The sensitizing dye may be added to a silver halide emulsion by dispersing it directly in the emulsion, or by dissolving it in a sole or mixed solvent of such solvents as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the sensitizing dye may be added to the emulsion by the method disclosed in U.S. Pat. No. 3,469,987, in which a dye is dissolved in a volatile organic solvent, the solution is dispersed in water or a hydrophilic colloid and the dispersion is added to the emulsion; the methods disclosed in JP-B-44-23389, JP-B-44-27555, JP-B-57-22091 and so forth, in which a dye is dissolved in an acid and the solution is added to the emulsion, or a dye is made into an aqueous solution in the presence of an acid or base and the solution is added to the emulsion; the method disclosed in, for example, U.S. Pat. Nos. 3,822,135 and 4,006,025, in which a dye is made into an aqueous solution or a colloid dispersion in the presence of a surfactant, and the solution or dispersion is added to the emulsion; the method disclosed in JP-A-53-102733 and JP-A-58-105141, in which a dye is directly dispersed in a hydrophilic colloid and the dispersion is added to the emulsion; or the method disclosed in JP-A-51-74624, in which a dye is dissolved by using a compound capable of red-shift and the solution is added to the emulsion. Ultrasonic waves may also be used for the preparation of the solution.

The sensitizing dye used for the present invention may be added to a silver halide emulsion at any step known to be useful during the preparation of emulsion. For example, the dye may be added at a step of formation of silver halide grains and/or in a period before desalting or at a step of desilverization and/or in a period after desalting and before initiation of chemical ripening, as disclosed in, for example, U.S. Pat. Nos. 2,735,766, 3,628,960, 4,183,756, 4,225,666, JP-A-58-184142, JP-A-60-196749 etc., or the dye may be added in any period or at any step before coating of the emulsion, such as immediately before or during chemical ripening, or in a period after chemical ripening but before coating, as disclosed in, for example, JP-A-58-113920. Further, a sole kind of compound alone or compounds different in structure in combination may be added as divided portions, for example, a part is added during grain formation, and the remaining during chemical ripening or after completion of the chemical ripening, or a part is added before or during chemical ripening and the remaining after completion of the chemical ripening, as disclosed in, for example, U.S. Pat. No. 4,225,666 and JP-A-58-7629. The kinds of compounds or the kinds of the combinations of compounds added as divided portions may be changed.

The addition amount of the sensitizing dye used for the present invention varies depending on the shape, size, halogen composition of silver halide grains, method and degree of chemical sensitization, kind of antifoggant and so forth, but the addition amount may be $4\times10^{-6}$ to $8\times10^{-3}$ mol per mol of silver halide. For example, when the silver halide grain size is 0.2–1.3 $\mu$m, the addition amount is preferably $2\times10^{-7}$ to $3.5\times10^{-6}$, more preferably $6.5\times10^{-7}$ to $2.0\times10^{-6}$ mol, per $m^2$ of the surface area of silver halide grains.

The silver halide photographic light-sensitive material of the present invention may contain a nucleation accelerator.

Examples of the nucleation accelerator used in the present invention include amine derivatives, onium salts, disulfide derivatives, hydroxymethyl derivatives and so forth. Specific examples thereof include the compounds represented by the formula (1), (2), (3) or (4) described in JP-A-2001-343725, specifically, Compounds A-1 to A-42, B-1 to B-41 and C-1 to C-14 described in the same; compounds described in JP-A-7-77783, page 48, lines 2 to 37, specifically, Compounds A-1) to A-73) described on pages 49 to 58 of the same; compounds mentioned in (Chemical formula 21), (chemical formula 22) and (Chemical formula 23) described in JP-A-7-84331, specifically, compounds described on pages 6 to 8 of the same; compounds represented by formulas [Na] and [Nb] described in JP-A-7-104426, specifically, Compounds Na-1 to Na-22 and Compounds Nb-1 to Nb-12 described on pages 16 to 20 of the same; compounds represented by the formulas (1), (2), (3), (4), (5), (6) and (7) described in JP-A-8-272023, specifically, Compounds 1-1 to 1-19, Compounds 2-1 to 2-22, Compounds 3-1 to 3-36, Compounds 4-1 to 4-5, Compounds 5-1 to 5-41, Compounds 6-1 to 6-58 and Compounds 7-1 to 7-38 mentioned in the same; and nucleation accelerators described in JP-A-9-297377, p.55, column 108, line 8 to p.69, column 136, line 44.

Specific examples of the nucleation accelerator used for the present invention are mentioned below. However, the nucleation accelerators that can be used for the present invention are not limited to the following compounds.

B-1

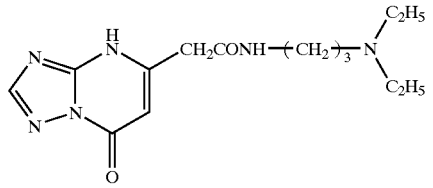

B-2

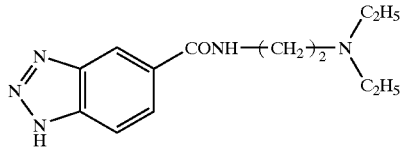

B-3

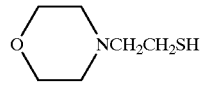

-continued

B-4

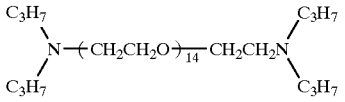

B-5

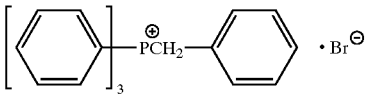

B-6

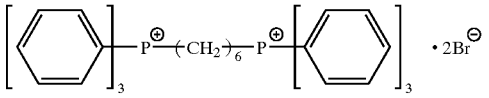

B-7

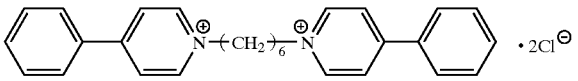

B-8

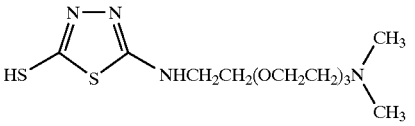

B-9

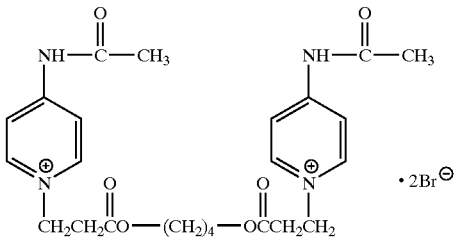

B-10

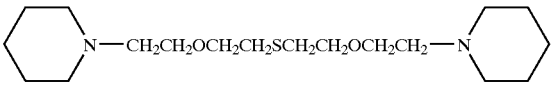

B-11

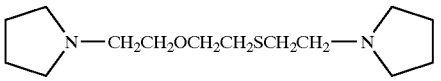

B-12

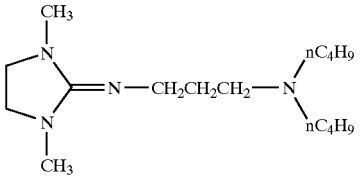

B-13

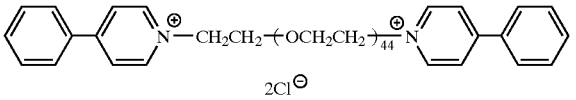

The nucleation accelerator that can be used in the present invention may be dissolved in an appropriate water-miscible organic solvent such as an alcohol (e.g., methanol, ethanol, propanol or a fluorinated alcohol), ketone (e.g., acetone or methyl ethyl ketone), dimethylformamide, dimethylsulfoxide or methyl cellosolve and used.

Alternatively, the nucleation accelerator may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of the nucleation accelerator may be dispersed in water by means of ball mill, colloid mill or ultrasonic waves according to a method known as solid dispersion method and used.

The nucleation accelerator that can be used in the present invention is preferably added to a non-photosensitive layer consisting of a hydrophilic colloid layer not containing silver halide emulsion provided on the silver halide emulsion layer side of the support, particularly preferably to a non-photosensitive layer consisting of a hydrophilic colloid layer between a silver halide emulsion layer and the support.

The nucleation accelerator is preferably used in the present invention in an amount of $1\times10^{-6}$ to $2\times10^{-2}$ mol, more preferably $1\times10^{-5}$ to $2\times10^{-2}$ mol, most preferably $2\times10^{-5}$ to $1\times10^{-2}$ mol, per mol of silver halide. It is also possible to use two or more kinds of nucleation accelerators in combination.

As a binder for the silver halide emulsion layer and other hydrophilic colloid layers used in the present invention, gelatin is preferably used, but it is also possible to use a polymer described in JP-A-10-268464, paragraph 0025. The amount of binder present in the whole hydrophilic colloid layer on the side having the silver halide emulsion layer is 3 g/m$^2$ or less (preferably 1.0–3.0 g/m$^2$), and the total amount of binder present in the whole hydrophilic colloid layer on the side having the silver halide emulsion layer and the whole hydrophilic colloid layer on the opposite side is 7.0 g/m$^2$ or less, preferably 2.0–7.0 g/m$^2$.

In the present invention, in order to control the surface roughness of the outermost layers of the silver halide light-sensitive material, inorganic and/or organic polymer fine particles (hereinafter, called a matting agent) are used in a hydrophilic colloid layer. The surface roughness of the outermost layer on the side having the silver halide emulsion layer of the light-sensitive material and the surface roughness of the outermost layer on the opposite side can be controlled by variously changing the average particle size of the matting agent and the amount thereof. Although the layer to which the matting agent is added can be any of the layers constituting the light-sensitive material, with respect to the side having the silver halide emulsion layer, it is preferable to add it to a layer positioned remoter from the support in order to prevent pinholes, and the outermost layer is particularly preferred.

The matting agent used in the present invention can be of any type of solid particles so long as it does not adversely affect the various photographic characteristics. Specific examples include those described in JP-A-10-268464, paragraphs 0009 to 0013 and JP-A-2-103536.

The average particle size of the matting agent used in the present invention is preferably 20 $\mu$m or less, particularly preferably in the range of 1–10 $\mu$m. The amount of matting agent is preferably 5–400 mg/m$^2$, particularly preferably 10–200 mg/m$^2$.

As for the surface roughness of the light-sensitive material of the present invention, at least one of the outermost surfaces of the side having the emulsion layer and the opposite side, preferably the both surfaces, have a Beck's smoothness of 4000 seconds or less, preferably 10–4000 seconds. The Beck's smoothness can be easily determined in accordance with Japanese Industrial Standard (JIS) P8119 and TAPPI Standard Method T479.

In the present invention, in order to improve settling of the matting agent during coating and drying of the silver halide light-sensitive material and improve pressure induced sensitivity fluctuation, curl balance, abrasion resistance and adhesion resistance during automatic transportation, exposure, development etc., colloidal inorganic particles can be used in the silver halide emulsion layer, intermediate layer, protective layer, back layer, back protective layer etc. Preferred examples of the colloidal inorganic particles include silica particles of elongated shape described in JP-A-10-268464, paragraphs 0008 to 0014, colloidal silica, the pearl-like (pearl necklace form) colloidal silica "Snowtex PS" manufactured by Nissan Chemical Industries, Ltd. and so forth.

The amount of colloidal inorganic particles used in the present invention is 0.01–2.0, preferably 0.1–0.6, in terms of a ratio based on dry weight relative to the binder (e.g. gelatin) in the layer to which they are added.

In the present invention, in order to improve the pressure induced sensitivity fluctuation etc., the polyhydroxybenzene compounds described in JP-A-3-39948, page 10, lower right column, line 11 to page 12, lower left column, line 5. More specifically, compounds (III)-1 to (III)-25 described in the same can be mentioned.

In the present invention, in order to improve brittleness, dimensional stability, pressure induced sensitivity fluctuation etc., polymer latex can be used. Examples of the polymer latex include polymer latexes formed from various types of monomers such as an alkyl acrylate and an alkyl methacrylate described in U.S. Pat. Nos. 2,763,652 and 2,852,382, JP-A-64-538, JP-A-62-115152, JP-A-5-66512, JP-A-5-80449, JP-B-60-15935, 6-64048, 5-45014 etc., polymer latexes formed by copolymerizing a monomer having an activated methylene group and a monomer such as an alkyl acrylate described in JP-B-45-5819, JP-B-46-22507, JP-A-50-73625, JP-A-7-152112, JP-A-8-137060 etc., polymer latexes having an active methylene group represented by the formula (I) described in JP-A-9-179228 and so forth. Particularly preferred are polymer latexes having a core/shell structure, in which the shell portion contains a repeating unit comprising an ethylenically unsaturated monomer having an active methylene group described in JP-A-9-179228, JP-A-8-248548, JP-A-8-208767, JP-A-8-220669 etc. These core/shell structure polymer latexes having an active methylene group in the shell portion can improve properties such as brittleness, dimensional stability and adhesion resistance between photographic light-sensitive materials without degrading the wet film strength of the light-sensitive material, and have improved shear stability of the latexes themselves.

The amount of polymer latex is 0.01–4.0, preferably 0.1–2.0, in terms of a ratio based on dry weight relative to the binder (e.g. gelatin) in the layer to which the latex is added.

In the present invention, in order to decrease pH of the coated film for the purpose of improving storage stability, pressure induced sensitivity fluctuation etc. of the silver halide light-sensitive material, the acidic polymer latex described in JP-A-7-104413, page 14, left column, line 1 to right column, line 30 is preferably used. More specifically, Compounds II-1) to II-9) described on page 15 of the same and the compounds having an acid group described in JP-A-2-103536, page 18, lower right column, line 6 to page 19, upper left column, line 1 are preferably used.

pH of the coated film on the side having the silver halide emulsion layer is preferably 6–4.

At least one of the layers constituting the silver halide light-sensitive material of the present invention can be an electroconductive layer having a surface resistivity of $10^{12}$ O or less in an atmosphere of 25° C. and 25% relative humidity.

Examples of the electroconductive material used in the present invention include the electroconductive materials described in JP-A-2-18542, page 2, lower left column, line 13 to page 3, upper right column, line 7, more specifically, the metal oxides described on page 2, lower right column, line 2 to line 10 of the same, and electroconductive macromolecular compounds of P-1 to P-7 described in the same, acicular metal oxides described in U.S. Pat. No. 5,575,957, JP-A-10-142738, paragraphs 0034 to 0043, JP-A-11-23,901, paragraphs 0013 to 0019 and so forth.

In the present invention, in addition to the aforementioned electroconductive material, the fluorine-containing surfactants described in JP-A-2-18542, page 4, upper right column, line 2 to page 4, lower right column, line 3 from the bottom, and JP-A-3-39948, page 12, lower left column, line 6 to page 13, lower right column, line 5 can be used together to further improve the antistatic properties.

In the present invention, the silver halide emulsion layer or other hydrophilic colloid layers can contain a coating aid, a dispersing and solubilizing agent for additives and various types of surfactant with purposes of improvement of lubrication, prevention of adhesion, improvement of photographic characteristics (for example, acceleration of development, impartation of higher contrast, sensitization, storage stability) etc. For example, the surfactants described in JP-A-2-12236, page 9, upper right column, line 7 to lower right column, line 3, PEG type surfactants described in JP-A-2-103536, page 18, lower left column, lines 4 to 7, more specifically, Compounds VI-1 to VI-15 described in the same, and fluorine-containing surfactants described in JP-A-2-18542, page 4, upper right column, line 2 to lower right column, line 3 from the bottom and JP-A-3-39948, page 12, lower left column, line 6 to page 13, lower right column, line 5 can be mentioned.

In the present invention, various types of lubricants can be used in order to improve transportation property in an automatic transportation apparatus, abrasion resistance, pressure induced sensitivity fluctuation of the silver halide light-sensitive material etc. For example, lubricants described in JP-A-2-103536, page 19, upper left column, line 15 to upper right column, line 15 and JP-A-4-214551, paragraphs 0006 to 0031 can be used.

In the present invention, as a plasticizer for coated films of the silver halide light-sensitive material, the compounds described in JP-A-2-103536, page 19, upper left column, line 12 to upper right column, line 15 can be used.

In the present invention, as a cross-linking agent for the hydrophilic binders, the compounds described in JP-A-2-103536, page 18, upper right column, line 5 to line 17 and JP-A-5-297508, paragraphs 0008 to 0011 can be used.

There are no particular limitations on various additives used in the silver halide photographic light-sensitive material of the present invention and, for example, those described below can be used: polyhydroxybenzene compounds described in JP-A-3-39948, page 10, right lower column, line 11 to page 12, left lower column, line 5, specifically, Compounds (III)-1 to (III)-25 described in the same; compounds that substantially do not have an absorption maximum in the visible region represented by the formula (I) described in JP-A-1-118832, specifically, Compounds I-1 to I-26 described in the same; antifoggants described in JP-A-2-103536, page 17, right lower column, line 19 to page 18, right upper column, line 4; plasticizers described in JP-A-2-103536; hardening agents described in JP-A-2-103536, page 18, right upper column, line 5 to line 17; compounds having an acid radical described in JP-A-2-103536, page 18, right lower column, line 6 to page 19, left upper column, line 1; water-soluble dyes described in JP-A-2-103536, page 17; solid dispersion dyes represented by the formulas (FA), (FA1), (FA2) and (FA3) described in JP-A-9-179243, specifically, Compounds F1 to F34 described in the same; Compounds (II-2) to (II-24), Compounds (III-5) to (III-18) and Compounds (IV-2) to (IV-7) described in JP-A-7-152112, and solid dispersion dyes described in JP-A-2-294638 and JP-A-5-11382; redox compounds capable of releasing a development inhibitor by oxidation described in JP-A-5-274816, preferably redox compounds represented by the formulas (R-1), (R-2) and (R-3) described in the same, specifically, Compounds R-1 to R-68 described in the same; and binders described in JP-A-2-18542, page 3, right lower column, line 1 to line 20.

The swelling ratio of the hydrophilic colloid layers including the emulsion layers and protective layers of the silver halide photographic light-sensitive material of the present invention is preferably in the range of 50–200%, more preferably 70–180%, further preferably 80–150%, particularly preferably 90–140%. The swelling ratio of the hydrophilic colloid layer can be determined in the following manner. The thickness ($d_0$) of the hydrophilic colloid layers including the emulsion layers and protective layers of the silver halide photographic light-sensitive material is measured and the swollen thickness ($\Delta d$) is measured after the silver halide photographic material is immersed in distilled water at 25° C. for one minute. Then, the swelling ratio is calculated from the following equation: Swelling ratio (%)= $(\Delta d/d_0)\times 100$.

The silver halide photographic light-sensitive material of the present invention preferably has a film surface pH of 6.0 or lower, more preferably 4.5–7.5, further preferably 4.8–6.0, for the side on which silver halide emulsion layer is coated. If it is less than 4.5, hardening of the emulsion layer tends to be delayed.

Examples of the support used for the present invention include, for example, baryta paper, polyethylene-laminated paper, polypropylene synthetic paper, glass plate, cellulose acetate, cellulose nitrate, polyester film such as polyethylene terephthalate film, supports comprising a styrene polymer having syndiotactic structure described in JP-A-7-234478 and U.S. Pat. No. 5,558,979, and supports comprising a polyester film coated with a vinylidene chloride copolymer described in JP-A-64-538, U.S. Pat. Nos. 4,645,731, 4,933,267, and Swedish Patent No. 4,954,430. These supports are suitably selected depending on use of the silver halide photographic light-sensitive material.

The light-sensitive material of the present invention is preferably subjected to a heat treatment at any time after coating and before development. Although the heat treatment can be carried out immediately after coating or after a certain period of time has passed, it is preferably carried out after a short period of time, for example, within 1 day. The heat treatment is carried out mainly in order to promote film hardening reaction so as to obtain film strength sufficient to withstand development. The heat treatment conditions should be appropriately determined depending on the type of hardening agent, amount thereof, pH of the film, required film strength etc. The heat treatment is preferably carried out at 30–60° C., more preferably 35–50° C., preferably for 30 minutes to 10 days.

Environment for rolling up the material into a roll, heat treatment and so forth for the silver halide light-sensitive material of the present invention are preferably determined according to the descriptions of JP-A-10-268464, paragraphs 0026 to 0032.

The silver halide photographic light-sensitive material of the present invention is preferably developed in the presence of a benzotriazole compound. The benzotriazole compound may be added to the light-sensitive material, or it may be added to the developer. When it is added to the light-sensitive material, it may be added to the silver halide emulsion layer side or the side opposite to the silver halide emulsion layer side, with respect to the support. It is preferably added to the silver halide emulsion layer side.

The benzotriazole compound used for the present invention may have any structure. Preferred benzotriazole compounds are the compounds shown below.

(1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-trichlorobenzotriazole
(11) 5-Carboxybenzotriazole
(12) 5-Sulfobenzotriazole
(13) 5-Methoxycarbonylbenzotriazole
(14) 5-Aminobenzotriazole
(15) 5-Butoxybenzotriazole
(16) 5-Ureidobenzotriazole
(17) Benzotriazole The most preferred benzotriazole compounds are benzotriazole and 5-methylbenzotriazole.

The amount of the benzotriazole compound is, when it is added to the silver halide photographic light-sensitive material, preferably $1\times10^{-4}$ to $1\times10^{-1}$ mol/mol of silver halide, particularly preferably $1\times10^{-3}$ to $7\times10^{-2}$ mol/mol of silver halide.

When it is added to the developer, it is preferably $7.5\times10^{-5}$ to $7.5\times10^{-3}$ mol/liter, particularly preferably $7.5\times10^{-5}$ to $5.0\times10^{-3}$ mol/liter.

Further, two or more kinds of benzotriazole compounds may be used together, or addition to the silver halide photographic light-sensitive material and addition to the developer may be used in combination.

Hereafter, the compounds of the formula (3), which can be preferably used in the present invention, will be explained in detail. In the formula (3), D and E each independently represents —CH═ group, —C($R^0$)═ group or a nitrogen atom, wherein $R^0$ represents a substituent, and $L^1$, $L^2$ and $L^3$ each independently represent a hydrogen atom, a halogen atom or an arbitrary substituent bonded to the ring at any of a carbon atom, a nitrogen atom, an oxygen atom, a sulfur atom and a phosphorus atom, and they may be the same or different. However, at least one of $L^1$, $L^2$, $L^3$ and $R^1$ represents an —SM group (wherein M represents an alkali metal atom, a hydrogen atom or an ammonium group). When E and D represent one nitrogen atom and one carbon atom, E represents a nitrogen atom, and D represents a carbon atom (—CH═ group or —C($R^0$)═ group).

Specific examples of the arbitrary substituent represented by $L^1$, $L^2$ or $L^3$ and the substituent represented by $R^0$ include a halogen atom (fluorine atom, chlorine atom, bromine atom or iodine atom) an alkyl group (including an aralkyl group, a cycloalkyl group, an active methine group etc.), an alkenyl group, an alkynyl group, an aryl group, a heterocyclic group, a heterocyclic group containing a quaternized nitrogen atom (e.g., pyridinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group having an ethyleneoxy group or a propyleneoxy group as a repeating unit), an aryloxy group, a heterocyclyloxy group, an acyloxy group, an (alkoxy- or aryloxy) carbonyloxy group, a carbamoyloxy group, a sulfonyloxy group, an amino group, an (alkyl-, aryl- or heterocyclyl)amino group, a hydroxylamino group, an N-substituted saturated or unsaturated nitrogen-containing heterocyclic group, an acylamino group, a sulfonamido group, a ureido group, a thioureido group, an imido group, an (alkoxy- or aryloxy)carbonylamino group, a sulfamoylamino group, a semicarbazido group, a thiosemicarbazido group, a hydrazino group, a quaternary ammonio group, an oxamoylamino group, an (alkyl- or aryl) sulfonylureido group, an acylureido group, an acylsulfamoylamino group, a nitro group, a mercapto group, an (alkyl-, aryl- or heterocyclyl)thio group, an (alkyl- or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a group having a phosphoric acid amide or phosphoric ester structure and so forth. These substituents may be further substituted by any of these substituents.

More preferred examples of the arbitrary substituent represented by $L^1$, $L^2$ or $L^3$ and the substituent represented by $R^0$ include a substituent having 0–15 carbon atoms, e.g., a chlorine atom, an alkyl group, an aryl group, a heterocyclic group, an acyl group, an alkoxycarbonyl group, a carbamoyl group, a carboxyl group or a salt thereof, a cyano group, an alkoxy group, an aryloxy group, an acyloxy group, an amino group, an (alkyl-, aryl- or heterocyclyl)amino group, a hydroxylamino group, an N-substituted saturated or unsaturated nitrogen-containing heterocyclic group, an acylamino group, a sulfonamido group, a ureido group, a thioureido group, a sulfamoylamino group, a nitro group, a mercapto group, an (alkyl-, aryl or heterocyclyl)thio group, a sulfo group or a salt thereof and a sulfamoyl group, further preferred are an alkyl group, an aryl group, a heterocyclic group, an alkoxycarbonyl group, a carbamoyl group, a carboxyl group or a salt thereof, an alkoxy group, an aryloxy group, an acyloxy group, an amino group, an (alkyl-, aryl- or heterocyclyl)amino group, a hydroxylamino group, an N-substituted saturated or unsaturated nitrogen-containing heterocyclic group, an acylamino group, a sulfonamido group, a ureido group, a thioureido group, a sulfamoylamino group, a mercapto group, an (alkyl-, aryl or heterocyclyl) thio group and a sulfo group or a salt thereof, and most preferred are an amino group, an alkyl group, an aryl group, an alkoxy group, an aryloxy group, an alkylamino group, an arylamino group, an alkylthio group, an arylthio group, a mercapto group, a carboxyl group or a salt thereof and a sulfo group or a salt thereof. In the formula (3), $L^1$, $L^2$, $L^3$ and $R^0$ may bond to each other to form a condensed ring in which a hydrocarbon ring, a heterocyclic ring or an aromatic ring is condensed.

In the formula (3), M represents an alkali metal atom, a hydrogen atom or an ammonium group. The alkali metal atom specifically includes Na, K, Li, Mg, Ca etc., and they exist as a counter cation of —$S^-$. M is preferably a hydrogen atom, an ammonium group, $Na^+$ or $K^+$, particularly preferably a hydrogen atom. Among the compounds represented by the formula (3), preferred are compounds represented by the following formula (3-A) or (3-B).

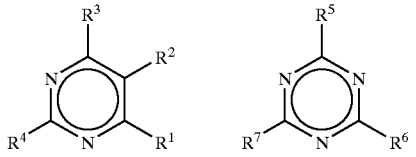

Hereafter, the compounds represented by the formula (3-A) will be explained in detail. $R^1$ to $R^4$ each independently represent a hydrogen atom, a halogen atom or an arbitrary substituent bonding to the ring at any of a carbon atom, a nitrogen atom, an oxygen atom, a sulfur atom or a phosphorus atom. They have the same meanings as those of $L^1$, $L^2$ and $L^3$ in the formula (3), and the preferred ranges are also the same. However, $R^1$ and $R^3$ do not represent a hydroxy group. $R^1$ to $R^4$ may be the same or different, but at least one of them represents an —SM group. M represents a hydrogen atom, an alkali metal atom, or an ammonium group. Further, $R^1$ and $R^2$ may bond to each other to form a condensed ring in which a hydrocarbon ring, a heterocyclic ring or an aromatic ring is condensed.

In the formula (3-A), at least one of $R^1$ to $R^4$ represents an —SM group, more preferably at least two of $R^1$ to $R^4$ represent an —SM group. When at least two of $R^1$ to $R^4$ represent an —SM group, preferably $R^4$ and $R^1$, or $R^4$ and $R^3$ represent an —SM group.

In the present invention, among the compounds represented by the formula (3-A), particularly preferred are compounds represented by the following formula (3-A-1), (3-A-2) or (3-A-3)

Formula (3-A-1)

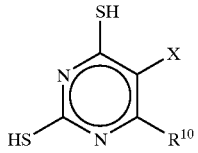

Formula (3-A-2)

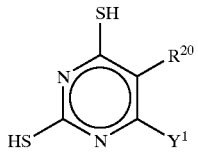

Formula (3-A-3)

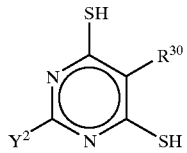

In the formula (3-A-1), $R^{10}$ represents a mercapto group, a hydrogen atom or an arbitrary substituent, and X represents a water-soluble group or a substituent substituted with a water-soluble group. In the formula (3-A-2), $Y^1$ represents a water-soluble group or a substituent substituted with a water-soluble group, and $R^{20}$ represents a hydrogen atom or an arbitrary substituent. In the formula (3-A-3), $Y^2$ represents a water-soluble group or a substituent substituted with a water-soluble group, and $R^{30}$ represents a hydrogen atom or an arbitrary substituent. However, $R^{10}$ and $Y^1$ do not represent a hydroxy group.

The compounds represented by the formula (3-A-1), (3-A-2) or (3-A-3) are explained in detail below. In the formula (3-A-1), $R^{10}$ represents a mercapto group, a hydrogen atom or an arbitrary substituent. The "arbitrary substituent" used herein includes the same substituents as those mentioned as $R^1$ to $R^4$ in the formula (3-A). $R^{10}$ preferably represents a mercapto group, a hydrogen atom or a group selected from the following substituents having 0–15 carbon atoms, i.e., an amino group, an alkyl group, an aryl group, an alkoxy group, an aryloxy group, an acylamino group, a sulfonamido group, an alkylthio group, an arylthio group, an alkylamino group, an arylamino group and so forth. In the formula (3-A-1), X represents a water-soluble group or a substituent substituted with a water-soluble group. The water-soluble group used herein means a group containing a sulfonic acid or a salt thereof, a carboxylic acid or a salt thereof, a salt such as an ammonio group or a dissociable group partly or completely dissociable with an alkaline developer, specifically a sulfo group (or a salt thereof), a carboxyl group (or a salt thereof), a hydroxyl group, a mercapto group, an amino group, an ammonio group, a sulfonamido group, an acylsulfamoyl group, a sulfonylsulfamoyl group, an active methine group or a substituent containing any of these groups. The active methine group mentioned in the present invention means a methyl group substituted with two electron-withdrawing groups, and specifically, groups of dicyanomethyl, a-cyano-a-ethoxycarbonylmethyl, a-acetyl-a-ethoxycarbonylmethyl and so forth can be mentioned. The substituent represented by X in the formula (3-A-1) is the aforementioned water-soluble group or a substituent substituted with the aforementioned water-soluble group, and the substituent include those having 0–15 carbon atoms, e.g., an alkyl group, an aryl group, a heterocyclic group, an alkoxyl group, an aryloxy group, a heterocyclyloxy group, an acyloxy group, an (alkyl-, aryl- or heterocyclyl) amino group, an acylamino group, a sulfonamido group, a ureido group, a thioureido group, an imido group, a sulfamoylamino group, an (alkyl-, aryl- or heterocyclyl)thio group, an (alkyl- or aryl)sulfonyl group, a sulfamoyl group, an amino group and so forth, and preferred are such groups as mentioned above having 1–10 carbon atoms, e.g., an alkyl group (in particular, methyl group substituted with an amino group), an aryl group, an aryloxy group, an amino group, an (alkyl-, aryl- or heterocyclyl)amino group, an (alkyl-, aryl- or heterocyclyl) thio group and so forth.

Among the compounds represented by the formula (3-A-1), more preferred are compounds represented by the following the formula (3-A-1-a).

Formula (3-A-1-a)

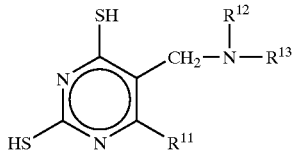

In the formula, $R^{11}$ has the same meaning as that of $R^{10}$ in the formula (3-A-1), and the preferred range thereof is also the same. $R^{12}$ and $R^{13}$ may be the same or different, and represent a hydrogen atom, an alkyl group, an aryl group or a heterocyclic group. However, at least one of $R^{12}$ and-$R^{13}$ has at least one water-soluble group. The water-soluble group used herein means a sulfo group (or a salt thereof), a carboxyl group (or a salt thereof), a hydroxyl group, a mercapto group, an amino group, an ammonio group, a sulfonamido group, an acylsulfamoyl group, a sulfonylsulfamoyl group, an active methine group or a substituent containing any of these groups, preferably a sulfo group (or a salt thereof), a carboxyl group (or a salt thereof), a hydroxyl group, an amino group or the like. $R^{12}$ and $R^{13}$ preferably represent an alkyl group or an aryl group. When $R^{12}$ and $R^{13}$ represent an alkyl group, the alkyl group is preferably a substituted or unsubstituted alkyl group having 1–4 carbon atoms, and the substituent is preferably a water-soluble group, particularly preferably a sulfo group (or a salt thereof), a carboxyl group (or a salt thereof), a hydroxyl group or an amino group. When $R^{12}$ and $R^{13}$ represent an aryl group, the aryl group is preferably a substituted or unsubstituted phenyl group having 6–10 carbon atoms, and the substituent is preferably a water-soluble group, particularly preferably a sulfo group (or a salt thereof), a carboxyl group (or a salt thereof), a hydroxyl group or an amino group. When $R^{12}$ and $R^{13}$ represent an alkyl group or an aryl group, they may bond to each other to form a cyclic structure, and the cyclic structure may form a saturated heterocyclic ring.

In the formula (3-A-2), $Y^1$ represents a water-soluble group or a substituent substituted with a water-soluble group, and has the same meaning as that of X in the formula (3-A-1). The water-soluble group or the substituent substituted with a water-soluble group represented by $Y^1$ in the formula (3-A-2) is more preferably an active methine group or any of the following group substituted with a water-soluble group, i.e., an amino group, an alkoxyl group, an aryloxy group, an alkylthio group, an arylthio group, an alkyl group and an aryl group. $Y^1$ is more preferably an active methine group or an (alkyl-, aryl- or heterocyclyl) amino group substituted with a water-soluble group, and the water-soluble group is particularly preferably a hydroxyl group, a carboxyl group or a salt thereof or a sulfo group or a salt thereof. Particularly preferred as $Y^1$ is an (alkyl-, aryl- or heterocyclyl) amino group substituted with a hydroxyl group, a carboxyl group (or a salt thereof) or a sulfo group (or a salt thereof), which is represented as a group of —$N(R^{01})(R^{02})$ group. $R^{01}$ and $R^{02}$ are groups having the same meanings as those of $R^{12}$ and $R^{13}$ in the formula (3-A), and the preferred ranges thereof are also the same.

In the formula (3-A-2), $R^{20}$ represents a hydrogen atom or an arbitrary substituent, and the "arbitrary substituent" herein used includes the same substituents mentioned as $R^1$ to $R^4$ in the formula (3-A). $R^{20}$ preferably represents a hydrogen atom or a group selected from the following substituents having 0–15 carbon atoms, i.e., a hydroxyl group, an amino group, an alkyl group, an aryl group, an alkoxyl group, an aryloxy group, an acylamino group, a sulfonamido group, an alkylthio group, an arylthio group, an alkylamino group, an arylamino group, a hydroxylamino group and so forth. $R^{20}$ most preferably represents a hydrogen atom.

In the formula (3-A-3), $Y^2$ represents a water-soluble group or a substituent substituted with a water-soluble group, and $R^{30}$ represents a hydrogen atom or an arbitrary substituent. $Y^2$ and $R^{30}$ in the formula (3-A-3) have the same meanings as those of $Y^1$ and $R^{20}$ in the formula (3-A-2), respectively, and the preferred ranges thereof are also the same.

The compounds represented by the formula (3-B) will be explained in detail below. $R^5$, $R^6$and $R^7$ in the formula (3-B) have the same meanings as those of $R^1$ to $R^4$ in the formula (3-A), and the preferred ranges thereof are also the same.

Among the compounds represented by the formula (3-B), particularly preferred are those represented by the formula (3-B-1)

Formula (3-B-1)

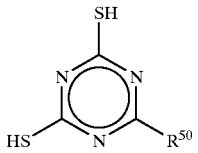

In the formula (3-B-1), $R^{50}$ has the same meaning as those of $R^5$ to $R^7$ in the formula (3-B), more preferably $R^{50}$ is a water-soluble group or a substituent substituted with a water-soluble group having the same meaning as that of the water-soluble group or substituent substituted with a water-soluble group represented by x, $y^1$ or $y^2$ in the formulas (3-A-1), (3-A-2) and (3-A-3). Further, among the compounds represented by the formula (3-B-1), most preferred are those represented by the formula (3-B-1-a).

Formula (3-B-1-a)

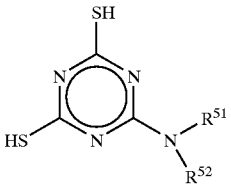

In the formula (3-B-1-a), $R^{51}$ and $R^{52}$ have the same meanings as those of $R^{12}$ and $R^{13}$ in the formula (3-A-1-a), and the preferred ranges thereof are also the same.

Specific examples of the compounds represented by the formula (3) are mentioned below. However, the compounds represented by the formula (3) that can be used in the present invention are not limited to these.

1.

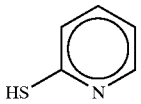

2.

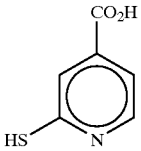

3.

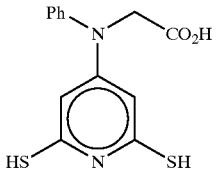

4.

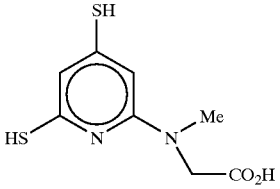

-continued

5.

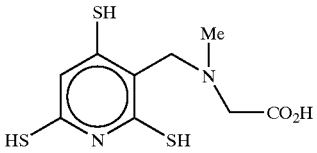

6.

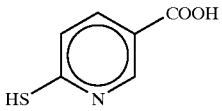

7.

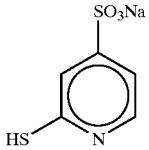

8.

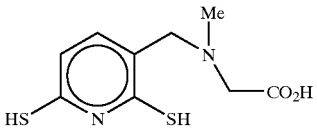

9.

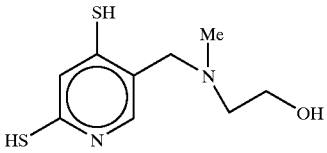

10.

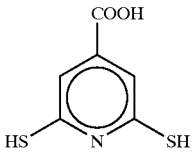

11.

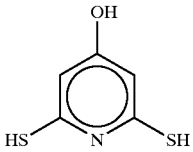

12.

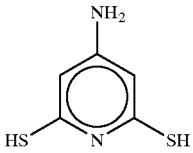

13.

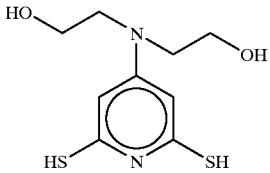

14.

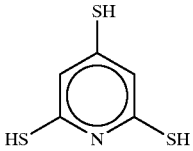

-continued
15.
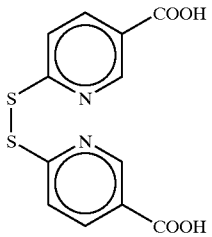
16.
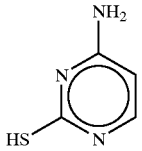
17.
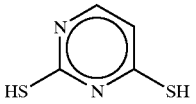
18.
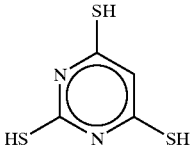
19.
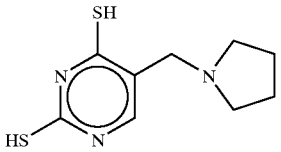
20.
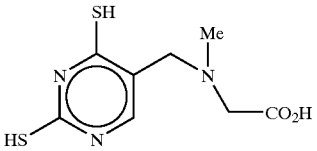
21.
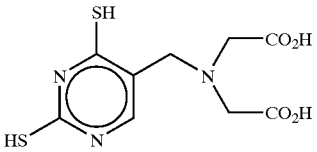
22.
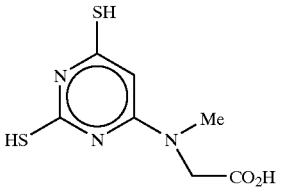
23.
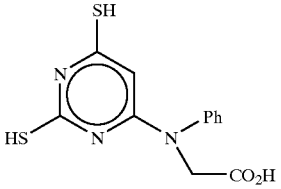
-continued
24.
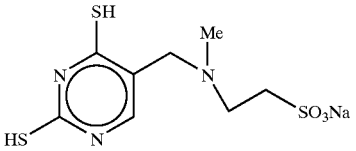
25.
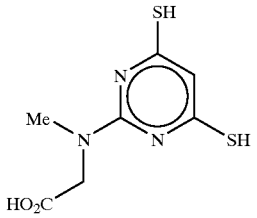
26.
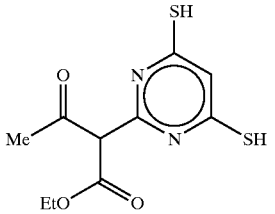
27.
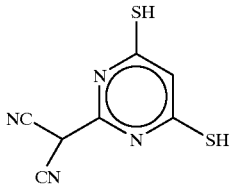
28.
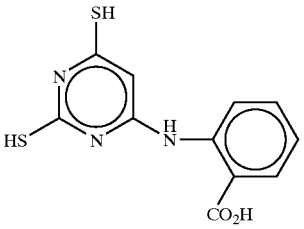
29.
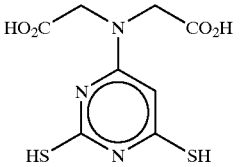
30.
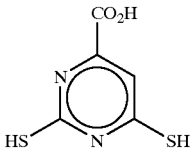
31.
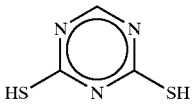

-continued
32.
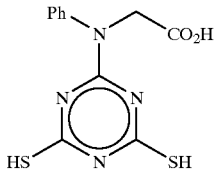
33.
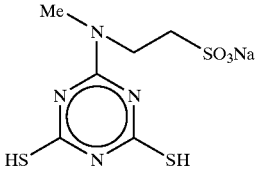
34.
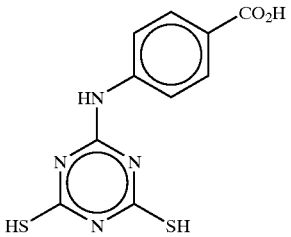
35.
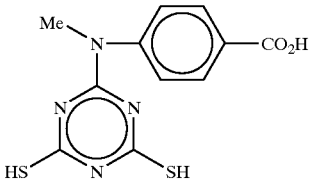
36.
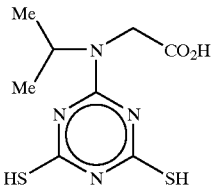
37.
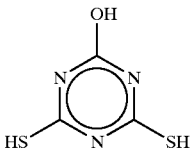
38.
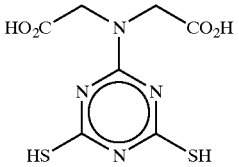
-continued
39.
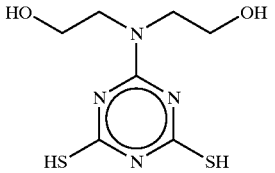
40.
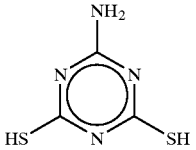
41.
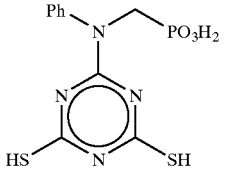
42.
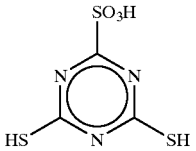
43.
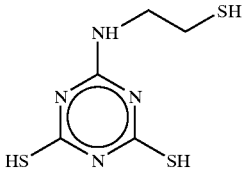
44.
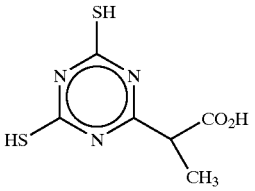
45.
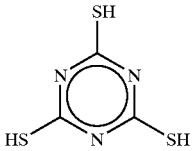
46.
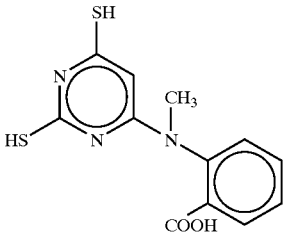
47.
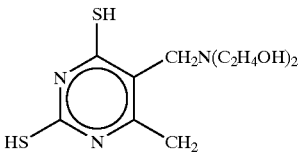

-continued

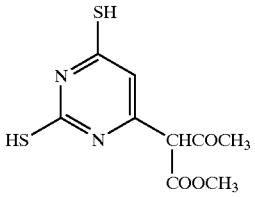

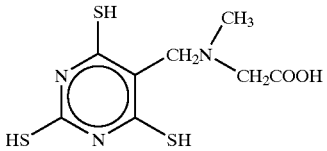

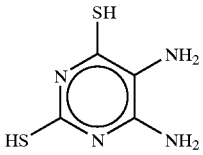

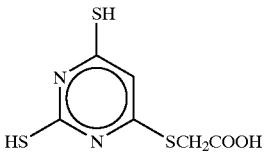

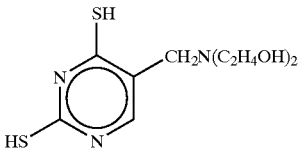

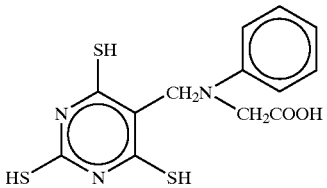

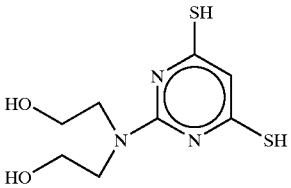

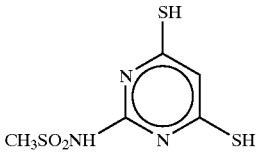

The compounds represented by the formula (3) are added to a hydrophilic colloid layer on the side opposite to the silver halide emulsion layer with respect to the support. If they are added to a silver halide emulsion layer side, performance concerning silver sludge may be degraded, or photographic properties may be affected. The amount is $1\times10^{-5}$ to $1\times10^{-2}$ mol/Mol of silver, preferably $1\times10^{-4}$ to $2\times10^{-3}$ mol/mol of silver.

48. In the formula (4), the alkyl group represented by Z is preferably an alkyl group having 1–30 carbon atoms, particularly preferably a straight, branched or cyclic alkyl group having 2–20 carbon atoms, and it may have a substituent in addition to the aforementioned substituent. The aromatic group represented by Z is preferably a monocyclic or condensed ring aromatic group having 6–32 carbon atoms, and it may have a substituent in addition to the aforementioned substituent. The heterocyclic group represented by $Z^1$ is preferably a monocyclic or condensed ring having 1–32 carbon atoms, which is a 5- or 6-membered ring containing 1–6 heteroatoms independently selected from nitrogen, oxygen and sulfur in one ring, and it may have a substituent in addition to the aforementioned substituent However, when the heterocyclic group is a tetrazole group, it does not have a substituted or unsubstituted naphthyl group as a substituent. Among the compounds represented by the formula (4), preferred are compounds wherein Z is a heterocyclic group having two or more nitrogen atoms.

49. The ammonio group is preferably an ammonia group having 20 or less carbon atoms, and the substituent thereof is a substituted or unsubstituted straight, branched or cyclic alkyl group (methyl group, ethyl group, benzyl group, ethoxypropyl group, cyclohexyl group etc.), a substituted or unsubstituted phenyl group or naphthyl group.

50. Among the compounds represented by the formula (4), preferred are those represented by the following formula (4-a).

51. Formula (4-a)

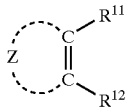

52.

53. In the formula, Z represents a group required to form a 5- or 6-membered unsaturated heterocyclic ring containing a nitrogen atom (pyrrole ring, imidazole ring, pyrazole ring, pyrimidine ring, pyridazine ring, pyrazine ring etc.), and it has at least one —SM group or thione group and at least one substituent selected from the group consisting of a hydroxyl group, a —COOM group, a $—SO_3M$ group, a substituted or unsubstituted amino group and a substituted or unsubstituted ammonio group. In the formula, $R^{11}$ and $R^{12}$ each independently represent a hydrogen atom, a —SM group, a halogen atom, an alkyl group (including one having a substituent), an alkoxyl group (including one having a substituent), a hydroxyl group, a —COOM group, a $—SO_3M$ group, an alkenyl group (including one having a substituent), an amino group (including one having a substituent), a carbamoyl group (including one having a substituent) or a phenyl group (including one having a substituent). $R^{11}$ and $R^{12}$ may together form a ring. The ring that can be formed is a 5- or 6-membered ring, preferably a nitrogen-containing heterocyclic ring. M has the same meaning as M defined in the aforementioned formula (4). Z is preferably a group that forms a heterocyclic compound containing two or more nitrogen atoms, and may have a substituent other than the aforementioned —SM group and thione group. Examples of the substituent include a halogen atom, a lower alkyl group (including one having a substituent, preferably one having 1–5 carbon atoms such as methyl group and ethyl group), a lower alkoxyl group (including one having a substituent, preferably one having 1–5 carbon atoms such as methoxy, ethoxy and butoxy) a lower alkenyl group (including one having a substituent, preferably one having 1–5 carbon atoms), a carbamoyl group, a phenyl group and so forth. Further, among the compounds represented by the formula (4-a), those represented by any one of the following formulas A to F are particularly preferred.

Formula A

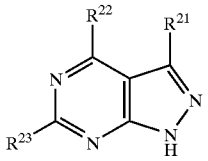

Formula B

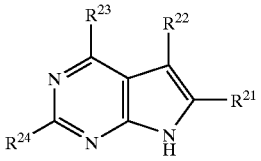

Formula C

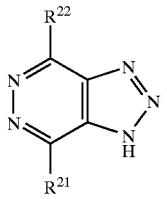

Formula D

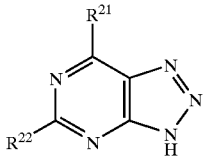

Formula E

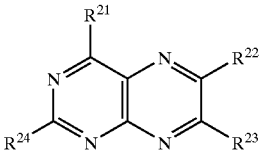

Formula F

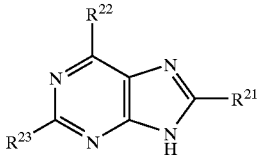

In the formula, $R^{21}$, $R^{22}$, $R^{23}$ and $R^{24}$ each independently represent a hydrogen atom, a —SM group, a halogen atom, a lower alkyl group (including one having a substituent, preferably one having 1–5 carbon atoms such as methyl group and ethyl group), a lower alkoxyl group (including one having a substituent, preferably one having 1–5 carbon atoms), a hydroxy group, a —$COOM^2$ group, —$SO_3M^5$ group, a lower alkenyl group (including one having a substituent, preferably one having 1–5 carbon atoms), an amino group, a carbamoyl group or a phenyl group, and at least one of them represents a —SM group. M, $M^2$ and $M^5$ each represent a hydrogen atom, an alkali metal atom or an ammonium group. In particular, as substituents other than the —SM group, a water-soluble group such as a hydroxy group, a —$COOM^2$ group, a —$SO_3M^5$ group and an amino group is particularly preferably contained.

The amino group represented by $R^{21}$, $R^{22}$, $R^{23}$ or $R^{24}$ represents a substituted or unsubstituted amino group, and the substituent is preferably a lower alkyl group. The ammonium is a substituted or unsubstituted ammonium group, preferably an unsubstituted ammonium group.

Specific examples of the compounds represented by the formula (4) are mentioned below. However, the compounds are not limited to these.

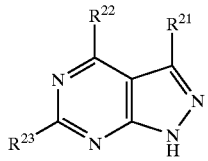

| | $R^{21}$ | $R^{22}$ | $R^{23}$ |
|---|---|---|---|
| 4-1 | H | OH | SH |
| 4-2 | H | SH | OH |
| 4-3 | OH | H | SH |
| 4-4 | OH | H | SH |
| 4-5 | H | $NH_2$ | SH |
| 4-6 | H | SK | $SO_3K$ |
| 4-7 | COOH | H | SH |

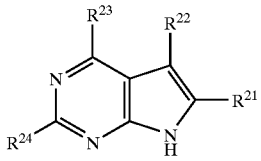

| | $R^{21}$ | $R^{22}$ | $R^{23}$ | $R^{24}$ |
|---|---|---|---|---|
| 4-8 | H | H | OH | SH |
| 4-9 | Cl | H | $NH_2$ | SH |
| 4-10 | SH | H | $NH_2$ | H |
| 4-11 | H | H | COOH | SH |
| 4-12 | OH | H | H | SH |
| 4-13 | H | H | OH | SH |
| 4-14 | SH | H | SH | $SO_3H$ |

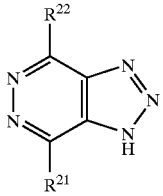

| | $R^{21}$ | $R^{22}$ |
|---|---|---|
| 4-15 | SH | OH |
| 4-16 | $NH_2$ | SH |
| 4-17 | SH | COOH |
| 4-18 | SH | $SO_3H$ |
| 4-19 | SH | OH |

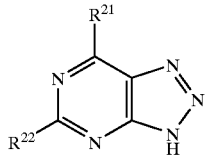

| | $R^{21}$ | $R^{22}$ |
|---|---|---|
| 4-20 | SH | COOH |
| 4-21 | $NH_2$ | SH |
| 4-22 | SH | COOH |
| 4-23 | SH | $SO_3H$ |
| 4-24 | SH | OH |

-continued

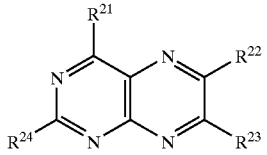

| | $R^{21}$ | $R^{22}$ | $R^{23}$ | $R^{24}$ |
|---|---|---|---|---|
| 4-25 | $NH_2$ | H | H | SH |
| 4-26 | COOH | H | SH | SH |
| 4-27 | OH | H | H | SH |
| 4-28 | H | $NH_2$ | H | SH |
| 4-29 | SH | COOH | H | H |
| 4-30 | H | H | $SO_3H$ | SH |

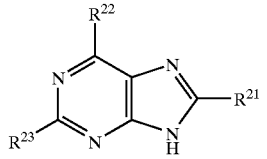

| | $R^{21}$ | $R^{22}$ | $R^{23}$ |
|---|---|---|---|
| 4-31 | SH | OH | H |
| 4-32 | SH | H | COOH |
| 4-33 | H | OH | SH |
| 4-34 | $SO_3H$ | SH | SH |
| 4-35 | H | SH | $SO_3H$ |
| 4-36 | $NH_2$ | H | SH |
| 4-37 | $NH_2$ | SH | H |
| 4-38 | H | $NH_2$ | SNa |
| 4-39 | SH | $NH_2$ | H |

The amount of the compound represented by the formula (4) is preferably $10^{-6}$ to $10^{-1}$ mol, more preferably $10^{-5}$ to $10^{-2}$ mol, per liter of the developer.

Hereafter, the compounds of the formula (a) will be explained. In the formula, $R^1$ and $R^2$ each represents a hydroxy group, an amino group, an acylamino group, an alkylsulfonylamino group, an arylsulfonylamino group, an alkoxycarbonylamino group, a mercapto group or an alkylthio group, X represent an atomic group required to constitute a 5- or 6-membered ring together with the two vinyl carbon atoms on which $R^1$ and $R^2$ substitute and the carbonyl carbon. Hereafter, the compounds of the formula (a) will be explained in detail.

In the formula, $R^1$ and $R^2$ each independently represent a hydroxy group, an amino group (including a group containing, as a substituent, an alkyl group having 1–10 carbon atoms such as methyl, ethyl group, n-butyl group and hydroxyethyl group), an acylamino group (e.g., acetylamino group, benzoylamino group), an alkylsulfonylamino group (e.g., methanesulfonyl-amino group), an arylsulfonylamino group (e.g., benzene-sulfonylamino group, p-toluenesulfonylamino group), an alkoxycarbonylamino group (e.g., methoxycarbonylamino group), a mercapto group or an alkylthio group (e.g., methylthio group, ethylthio group). Preferred examples of $R^1$ and $R^2$ include a hydroxy group, an amino group, an alkylsulfonylamino group and an arylsulfonylamino group.

X is constituted by carbon atom, oxygen atom or nitrogen atom, and constitutes a 5- or 6-membered ring together with the two vinyl carbon atoms on which $R^1$ and $R^2$ substitute and the carbonyl carbon. Specific examples of X include those comprising a combination of —O—, —C($R^3$)($R^4$)—, —C($R^5$)═, —C(═O)—, —N($R^6$)— and —N═, wherein $R^3$, $R^4$, $R^5$ and $R^6$ represent a hydrogen atom, an alkyl group having 1–10 carbon atoms which may be substituted (examples of the substituent include a hydroxy group, a carboxy group and a sulfo group), an aryl group having 6–15 carbon atoms which may be substituted (examples of the substituent include an alkyl group, a halogen atom, a hydroxy group, a carboxy group and a sulfo group), a hydroxy group or a carboxy group. Further, the 5- or 6-membered ring may form a saturated or unsaturated condensed ring.

Examples of the 5- or 6-membered ring include dihydrofuranone ring, dihydropyrone ring, pyranone ring, cyclopentenone ring, cyclohexenone ring, pyrrolinone ring, pyrazolinone ring, pyridone ring, azacyclohexenone ring, uracil ring and so forth, and preferred examples of the 5- or 6-membered ring are dihydrofuranone ring, cyclopentenone ring, cyclohexenone ring, pyrazolinone ring, azacyclohexenone ring and uracil ring.

Specific examples of the compounds represented by the formula (a) are mentioned below. However, the compounds represented by the formula (a) are not limited to these.

α-1

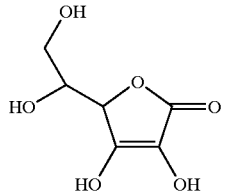

α-2

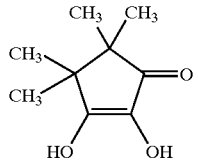

α-3

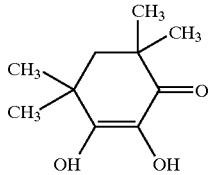

α-4

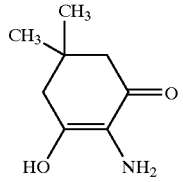

α-5

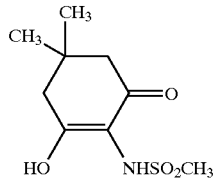

α-6

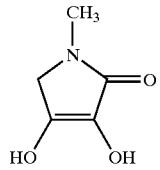

-continued

α-7

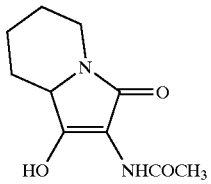

α-8

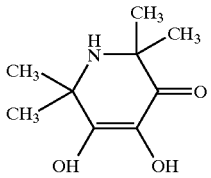

α-9

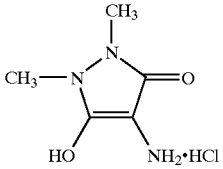

α-10

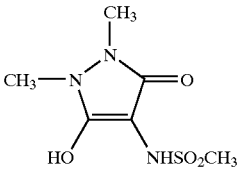

α-11

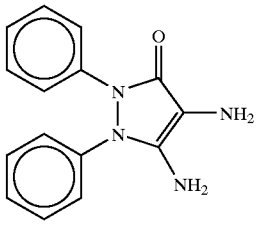

α-12

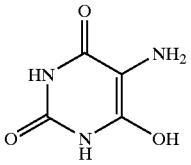

α-13

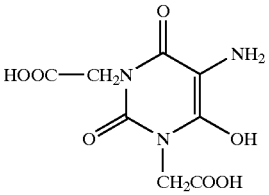

α-14

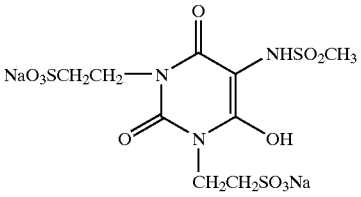

-continued

α-15

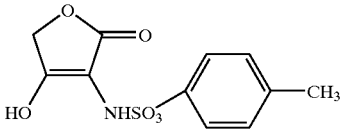

α-16

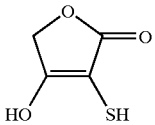

α-17

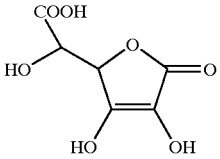

α-18

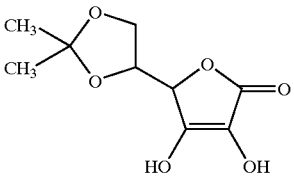

α-19

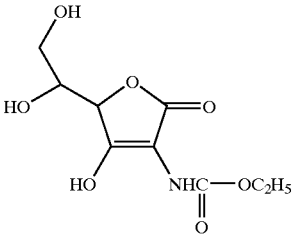

α-20

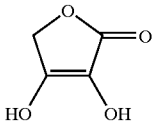

α-21

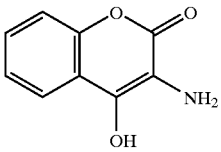

α-22

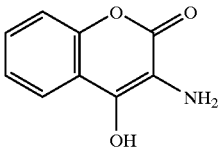

Among these compounds, ascorbic acid and erythorbic acid (steroisomer, a-1) are preferred. The amount of the compound of the formula (a) is, when used as a preservative, preferably 15 g/liter, particularly preferably 1–10 g/liter.

Processing chemicals such as developing solution (developer) and fixing solution (fixer) and processing methods that can be used for the silver halide photographic light-sensitive material according to the present invention are described below, but of course the present invention should not be construed as being limited to the following description and specific examples.

For the development of the silver halide photographic light-sensitive material of the present invention, any of known methods can be used, and known developers can be used.

A developing agent for use in developer (hereinafter, starter developer and replenisher developer are collectively referred to as developer) used for the present invention is not particularly limited, but it is preferable to add a dihydroxybenzene compound, ascorbic acid derivative or hydroquinonemonosulfonate, and they can be used each alone or in combination. In particular, a dihydroxybenzene type developing agent and an auxiliary developing agent exhibiting superadditivity are preferably contained in combination, and combinations of a dihydroxybenzene compound or an ascorbic acid derivative with a 1-phenyl-3-pyrazolidone compound, or combinations of a dihydroxybenzene compound or ascorbic acid compound with a p-aminophenol compound can be mentioned.

Examples of the dihydroxybenzene developing agent as a developing agent used for the present invention includes hydroquinone, chlorohydroquinone, isopropylhydroquinone, methylhydroquinone and so forth, and hydroquinone is particularly preferred. Examples of the ascorbic acid derivative developing agent include ascorbic acid, isoascorbic acid and salts thereof. Sodium erythorbate is particularly preferred in view of material cost.

Examples of the 1-phenyl-3-pyrazolidones or derivatives thereof as the developing agent used for the present invention include 1-phenyl-3-pyrazolidone, 1-phenyl-4,4-dimethyl-3-pyrazolidone, 1-phenyl-4-methyl-4-hydroxymethyl-3-pyrazolidone and so forth.

Examples of the p-aminophenol type developing agent that can be used for the present invention include N-methyl-p-aminophenol, p-aminophenol, N-(β-hydroxyphenyl)-p-amino-phenol, N-(4-hydroxyphenyl)glycine, o-methoxy-p-(N,N-di-methylamino) phenol, o-methoxy-p-(N-methylamino) phenol etc. and N-methyl-p-aminophenol and aminophenols described in JP-A-9-297377 and JP-A-9-297378 are preferred.

The dihydroxybenzene type developing agent is preferably used in an amount of generally 0.05–0.8 mol/L. When a dihydroxybenzene compound and a 1-phenyl-3-pyrazolidone compound or p-aminophenol compound are used in combination, the former is preferably used in an amount of 0.05–0.6 mol/L, more preferably 0.10–0.5 mol/L, and the latter is preferably used in an amount of 0.06 mol/L or less, more preferably 0.003–0.03 mol/L.

The ascorbic acid derivative developing agent is preferably used in an amount of generally 0.01–0.5mol/L, more preferably 0.05–0.3 mol/L. When an ascorbic acid derivative and a 1-phenyl-3-pyrazolidone compound or p-aminophenol compound are used in combination, the ascorbic acid derivative is preferably used in an amount of from 0.01–0.5 mol/L, and the 1-phenyl-3-pyrazolidone compound or p-aminophenol compound is preferably used in an amount of 0.005–0.2 mol/L.

The developer used in processing the silver halide photographic light-sensitive material of the present invention may contain additives (e.g., a developing agent, alkali agent, pH buffer, preservative, chelating agent etc.) that are commonly used. Specific examples thereof are described below, but the present invention is not limited to them.

Examples of the buffer for use in the developer used in development include carbonates, boric acids described in JP-A-62-186259, saccharides (e.g., saccharose) described in JP-A-60-93433, oximes (e.g., acetoxime), phenols (e.g., 5-sulfosalicylic acid), tertiary phosphates (e.g., sodium salt and potassium salt) etc., and carbonates and boric acids are preferably used. The buffer, in particular the carbonate, is preferably used in an amount of 0.05 mol/L or more, particularly preferably 0.08–1.0 mol/L.

Examples of the preservative that can be used for the present invention include sodium sulfite, potassium sulfite, lithium sulfite, ammonium sulfite, sodium bisulfite, sodium methabisulfite, formaldehyde-sodium bisulfite and so forth. A sulfite is used in an amount of preferably 0.2 mol/L or more, particularly preferably 0.3 mol/L or more, but if it is added in an unduly large amount, silver staining in the developer is caused. Accordingly, the upper limit is preferably 1.2 mol/L. The amount is particularly preferably 0.35–0.7 mol/L.

As the preservative for a dihydroxybenzene type developing agent, a small amount of the aforementioned ascorbic acid derivative may be used together with the sulfite. Sodium erythorbate is particularly preferably used in view of material cost. It is preferably added in an amount of 0.03–0.12, particularly preferably 0.05–0.10, in terms of molar ratio with respect to the dihydroxybenzene type developing agent. When an ascorbic acid derivative is used as the preservative, the developer preferably does not contain a boron compound.

Examples of additives to be used other than those described above include a development inhibitor such as sodium bromide and potassium bromide, an organic solvent such as ethylene glycol, diethylene glycol, triethylene glycol and dimethylformamide, a development accelerator such as an alkanolamine including diethanolamine, triethanolamine etc. and an imidazole and derivatives thereof, and an agent for preventing uneven physical development such as a heterocyclic mercapto compound (e.g., sodium 3-(5-mercaptotetrazol-1-yl)benzenesulfonate, 1-phenyl-5-inercaptotetrazole etc.) and the compounds described in JP-A-62-212651.

Further, a mercapto compound, indazole compound, benzotriazole compound or benz imidazole compound may be added as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)-thio) butanesulfonate, 5-amino-1,3,4-thiadiazole-2-thiol and so forth. The addition amount thereof is generally 0.01–10 mmol, preferably 0.1–2 mmol, per liter of the developer.

Further, various kinds of organic or inorganic chelating agents can be used individually or in combination in the developer used for the present invention.

As the inorganic chelating agents, sodium tetrapolyphosphate, sodium hexametaphosphate and so forth can be used.

As the organic chelating agents, organic carboxylic acid, aminopolycarboxylic acid, organic phosphonic acid, aminophosphonic acid and organic phosphonocarboxylic acid can be mainly used.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, tartaric acid etc.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycol ether-tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether-diaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acids described in U.S. Pat. Nos. 3,214,454 and 3,794,591 and West German Patent Publication No. 2,227,369, and the compounds described in Research Disclosure, Vol. 181, Item 18170 (May, 1979) and so forth.

Examples of the aminophosphonic acid include aminotris (methylenephosphonic acid), ethylenediaminetetramethylenephosphonic acid, aminotrimethylenephosphonic acid and so forth, and the compounds described in Research Disclosure, No. 18170 (supra), JP-A-57-208554, JP-A-54-61125, JP-A-55-29883, JP-A-56-97347 and so forth can also be mentioned.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, Research Disclosure, No. 18170 (supra) and so forth.

Among these chelating agents, diethylenetriamines are preferred. Among the diethylenetriamines, diethylenetriaminepentaacetic acid and metal salts thereof are particularly preferred.

The organic and/or inorganic chelating agents are not limited to those described above. The organic and/or inorganic chelating agents may be used in the form of an alkali metal salt or an ammonium salt. The amount of the chelating agent added is preferably from $1\times10^{-4}$ to $1\times10^{-1}$ mol, more preferably from $1\times10^{-3}$ to $1\times10^{-2}$ mol, per liter of the developer.

Further, a silver stain inhibitor may be added to the developer, and examples thereof include, for example, the compounds described in JP-A-56-24347, JP-B-56-46585, JP-B-62-2849, JP-A-4-362942 and JP-A-8-6215, the compounds described in JP-A-7-175177, polyoxyalkylphosphates described in U.S. Pat. No. 5,457,011 and so forth. These silver stain inhibitors may be used individually or in combination of two or more of these. The addition amount thereof is preferably 0.05–10 mmol, more preferably 0.1–5 mmol, per liter of the developer.

The developer may also contain the compounds described in JP-A-61-267759 as a dissolution aid.

Further, the developer may also contain a toning agent, surfactant, defoaming agent, hardening agent or the like, if necessary.

The developer preferably has a pH of 9.0–11.0, more preferably 9.2–11.0, particularly preferably 9.5–11.0. The alkali agent used for adjusting pH may be a usual water-soluble inorganic alkali metal salt (e.g., sodium hydroxide, potassium hydroxide, sodium carbonate, potassium carbonate etc.).

Increase of pH in developer resulting from addition of 0.1 mol of sodium hydroxide to 1 L of the developer is preferably 0.3 or more, more preferably 0.3–1.0.

As for the cation of the developer, potassium ion less inhibits development and causes fewer indentations, called fringes, on peripheries of blackened portions, compared with sodium ion. When the developer is stored as a concentrated solution, potassium salt is generally preferred, because of its higher solubility. However, since, in the fixer, potassium ion causes fixing inhibition on the same level as silver ion, a high potassium ion concentration in the developer disadvantageously causes increase of the potassium ion concentration in the fixer because of carrying over of the developer by the silver halide photographic light-sensitive material. In view of the above, the molar ratio of potassium ion to sodium ion in the developer is preferably between 20:80 and 80:20. The ratio of potassium ion to sodium ion can be freely controlled within the aforementioned range by a counter cation such as those derived from a pH buffer, pH adjusting agent, preservative, chelating agent or the like.

During a running test, degrease of developing agent greatly affects the photographic properties. Therefore, as a method for examining decrease of developing agent in developer, the following method was contemplated.

A developer in a volume of 600 mL is put into a plastic bottle of 1 L volume and left for a certain period of time at room temperature without lid. The amount of the developing agent in a fresh developer (Fr) and the same after the period are measured. A decrease ratio is obtained by dividing the decreased amount with Fr, and multiplied with 100 to be represented in %. If the decrease ratio is more than 50%, fluctuation of photographic properties becomes significant during the running test, and if it is 5% or less, fluctuation of photographic properties (especially Dmax) is also significant. Thus, it is difficult to use a developer showing such a decrease ratio. The decrease ratio is preferably 7–50%, more preferably 8–40%.

The replenishing amount of the developer is generally 330 mL or less, preferably 30–330 mL, most preferably 120–330 mL, per $m^2$ of the silver halide photographic light-sensitive material. The replenisher developer may have the same composition and/or concentration as the starter developer, or it may have a different composition and/or concentration from the starter developer.

Examples of the fixing agent in the fixing processing agent that can be used for the present invention include ammonium thiosulfate, sodium thiosulfate and ammonium sodium thiosulfate. The amount of the fixing agent may be varied appropriately, but it is generally about 0.7–3.0 mol/L.

The fixer that can be used for the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, aluminum lactate and so forth. These are preferably contained in an amount of 0.01–0.15 mol/L in terms of aluminum ion concentration in the solution used.

When the fixer is stored as a concentrated solution or a solid agent, it may be constituted by a plurality of parts including a hardening agent or the like as a separate part, or it may be constituted as a one-part agent containing all components.

The fixing processing agent may contain, if desired, a preservative (e.g., sulfite, bisulfite, metabisulfite etc. in an amount of 0.015 mol/L or more, preferably 0.02–0.3 mol/L), pH buffer (e. g., acetic acid, sodium acetate, sodium carbonate, sodium hydrogencarbonate, phosphoric acid, succinic acid, adipic acid etc. in an amount of generally 0.1–1 mol/L, preferably 0.2–0.7 mol/L), and a compound having aluminum-stabilizing ability or hard water-softening ability (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives and salts thereof, saccharides etc. in an amount of 0.001–0.5 mol/L, preferably 0.005–0.3 mol/L). However, in view of environmental protection recently concerned, it is preferred that a boron compound is not contained.

In addition, the fixing processing agent may contain a compound described in JP-A-62-78551, pH adjusting agent (e.g., sodium hydroxide, ammonia, sulfuric acid etc.), surfactant, wetting agent, fixing accelerator etc. Examples or the surfactant include anionic surfactants such as sulfated products and sulfonated products, polyethylene surfactants and amphoteric surfactants described in JP-A-57-6840. Known deforming agents may also be used. Examples of the wetting agent include alkanolamines and alkylene glycols. Examples of the fixing accelerator include alkyl- or aryl-substituted thiosulfonic acids and salts thereof described in JP-A-6-308681, thiourea derivatives described in JP-B-45-35754, JP-B-58-122535 and JP-B-58-122536, alcohols having a triple bond within the molecule, thioether compounds described in U.S. Pat. No. 4,126,459, mercapto compounds described in JP-A-64-4739, JP-A-1-4739, JP-A-l-159645 and JP-A-3-101728, mesoionic compounds and thiocyanates described in JP-A-4-170539.

pH of the fixer used for the present invention is preferably 4.0 or more, more preferably 4.5–6.0. pH of the fixer rises with processing by the contamination of developer. In such a case, pH of a hardening fixer is preferably 6.0 or less, more preferably 5.7 or less, and that of a non-hardening fixer is preferably 7.0 or less, more preferably 6.7 or less.

The replenishing rate of the fixer is preferably 390 mL or less, more preferably 320–80 mL, per $m^2$ of the silver halide photographic light-sensitive material. The composition and/or the concentration of the replenisher fixer may be the same as or different from those of the starter fixer.

The fixer can be reclaimed for reuse according to known fixer reclaiming methods such as electrolytic silver recovery. As reclaiming apparatuses, there are FS-2000 produced by Fuji Photo Film Co., Ltd. and so forth.

Further, removal, of dyes and so forth using an adsorptive filter such as those comprising activated carbon is also preferred.

When the developing and fixing processing chemicals used in the present invention are solutions, they are preferably preserved in packaging materials of low oxygen permeation as disclosed in JP-A-61-73147. Further, when these solutions are concentrated solutions, they are diluted with water to a predetermined concentration in the ratio of 0.2–3 parts of water to one part of the concentrated solutions.

Even if the developing processing chemicals and fixing processing chemicals used in the present invention are made as solids, the same effects as solutions can be obtained. Solid processing chemicals are described below.

Solid chemicals that can be used for the present invention may be made into known shapes such as powders, granular powders, granules, lumps, tablets, compactors, briquettes, plates, bars, paste or the like. These solid chemicals may be covered with water-soluble coating agents or films to separate components that react with each other on contact, or they may have a multilayer structure to separate components that react with each other, or both types may be used in combination.

Although known coating agents and auxiliary granulating agents can be used, polyvinylpyrrolidone, polyethylene glycol, polystyrenesulfonic acid and vinyl compounds are preferably used. Further, JP-A-5-45805, column 2, line 48 to column 3, line 13 can be referred to.

When a multilayer structure is used, components that do not react with each other on contact may be sandwiched with components that react with each other and made into tablets and briquettes, or components of known shapes may be made into a similar layer structure and packaged. Methods therefor are disclosed in JP-A-61-259921, JP-A-4-16841, JP-A-4-78848, JP-A-5-93991 and so forth.

The bulk density of the solid processing chemicals is preferably 0.5–6.0 q/$cm^3$, in particular, the bulk density of tablets is preferably 1.0–5.0 g/$cm^3$, and that of granules is preferably 0.5–1.5 g/$cm^3$.

Solid processing chemicals used for the present invention can be produced by using any known method, and one can refer to, for example, JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605, JP-A-8-286329 and so forth.

More specifically, the rolling granulating method, extrusion granulating method, compression granulating method, cracking granulating method, stirring granulating method, spray drying method, dissolution coagulation method, briquetting method, roller compacting method and so forth can be used.

The solubility of the solid chemicals used in the present invention can be adjusted by changing state of surface (smooth, porous etc.) or partially changing the thickness, or making the shape into a hollow doughnut type. Further, it is also possible to provide different solubilities to a plurality of granulated products, or it is also possible for materials having different solubilities to use various shapes to obtain the same solubilities. Multilayer granulated products having different compositions between the inside and the surface can also be used.

Packaging materials of solid chemicals preferably have low oxygen and water permeabilities, and those of known shapes such as bag-like, cylindrical and box-like shapes can be used. Packaging materials of foldable shapes are preferred for saving storage space of waste packaging materials as disclosed in JP-A-6-242585 to JP-A-6-242588, JP-A-6-247432, JP-A-6-247448, JP-A-6-301189, JP-A-7-5664, and JP-A-7-5666 to JP-A-7-5669. Takeout ports of processing chemicals of these packaging materials may be provided with a screw cap, pull-top or aluminum seal, or packaging materials may be heat-sealed, or other known types may be used, and there are no particular limitations. Waste packaging materials are preferably recycled or reused in view of environmental protection.

Methods of dissolution and replenishment of the solid processing chemicals used for the present invention are not particularly limited, and known methods can be used. Examples of these known methods include a method in which a certain amount of processing chemicals are dissolved and replenished by a dissolving apparatus having a stirring function, a method in which processing chemicals are dissolved by a dissolving apparatus having a dissolving zone and a zone where a finished solution is stocked and the solution is replenished from the stock zone as disclosed in JP-A-9-80718, and methods in which processing chemicals are fed to a circulating system of an automatic processor and dissolved and replenished, or processing chemicals are fed is to a dissolving tank provided in an automatic processor with progress of the processing of silver halide photographic light-sensitive materials as disclosed in JP-A-5-119454, JP-A-6-19102 and JP-A-7-261357. In addition to the above methods, any of known methods can be used. The charge of processing chemicals may be conducted manually, or automatic opening and automatic charge may be conducted by using a dissolving apparatus or automatic processor provided with an opening mechanism as disclosed in JP-A-9-138495. The latter is preferred in view of the working environment. Specifically, there are methods of pushing through, unsealing, cutting off and bursting a takeout port of package, methods disclosed in JP-A-6-19102 and JP-A-6-95331 and so forth.

A silver halide photographic light-sensitive material is subjected to washing or stabilizing processing after being developed and fixed (hereinafter washing includes stabilization processing, and a solution used therefor is called water or washing water unless otherwise indicated). The water used for washing may be any of tap water, ion exchange water, distilled water and stabilized solution. The replenishing rate therefor is, in general, about 8–17 liters per $m^2$ of the silver halide photographic light-sensitive material, but washing can be carried out with a replenishing rate less than the above. In particular, with a replenishing rate of 3 liters or less (including zero, i.e., washing in a reservoir), not only water saving processing can be carried out but also piping for installation of an automatic processor becomes unnecessary. When washing is carried out with a reduced replenishing amount of water, it is more preferable to use a washing tank equipped with a squeegee roller or a crossover roller disclosed in JP-A-63-18350, JP-A-62-287252 and so forth. The addition of various kinds of oxidizing agents (e.g., ozone, hydrogen peroxide, sodium hypochlorite, activated halogen, chlorine dioxide, sodium carbonate hydrogen peroxide salt etc.) and filtration through filters may be combined to reduce load on environmental pollution which becomes a problem when washing is carried out with a small amount of water and to prevent generation of scale.

As a method of reducing the replenishing amount of the washing water, a multistage countercurrent system (e.g., two stages or three stages) has been known for a long time. The replenishing amount of the washing water in this system is preferably 50–200 mL per $m^2$ of the silver halide photographic light-sensitive material. This effect can also similarly be obtained in an independent multistage system (a method in which a countercurrent is not used and fresh solution is separately replenished to multistage washing tanks).

Further, means for preventing generation of scale may be included in a washing process used for the present invention. Means for preventing generation of scale is not particularly limited, and known methods can be used. There are, for example, a method of adding an antifungal agent (so-called scale preventive), a method of using electroconduction, a method of irradiating ultraviolet ray, infrared ray or far infrared ray, a method of applying a magnetic field, a method of using ultrasonic wave processing, a method of applying heat, a method of emptying tanks when they are not used and so forth. These scale preventing means may be used with progress of the processing of silver halide photographic light-sensitive materials, may be used at regular intervals irrespective of usage conditions, or may be conducted only during the time when processing is not conducted, for example, during night. In addition, washing water previously subjected to a treatment with such means may be replenished. It is also preferable to use different scale preventing means for every given period of time for inhibiting proliferation of resistant fungi.

As a water-saving and scale-preventing apparatus, an apparatus AC-1000 produced by Fuji Photo Film Co., Ltd. and a scale-preventing agent AB-5 produced by Fuji Photo Film Co., Ltd. may be used, and the method disclosed in JP-A-11-231485 may also be used.

The antifungal agent is not particularly restricted, and a known antifungal agent may be used. Examples thereof include, in addition to the aforementioned oxidizing agents, glutaraldehyde, chelating agent such as aminopolycarboxylic acid, cationic surfactant, mercaptopyridine oxide (e.g., 2-mercaptopyridine-N-oxide) and so forth, and a sole antifungal agent may be used, or a plurality of antifungal agents may be used in combination.

The electricity may be applied according to the methods described in JP-A-3-224685, JP-A-3-224687, JP-A-4-16280, JP-A-4-18980 and so forth.

In addition, a known water-soluble surfactant or defoaming agent may be added so as to prevent uneven processing due to bubbling, or to prevent transfer of stains. Further, the dye adsorbent described in JP-A-63-163456 may be provided in the washing with water system, so as to prevent stains due to a dye dissolved out from the silver halide photographic lightsensitive material.

Overflow solution from the washing with water step may be partly or wholly used by mixing it with the processing solution having fixing ability as described in JP-A-60-235133. In view of protection of the natural environment, it is also preferable to reduce the biochemical oxygen demand (BOD), chemical oxygen demand (COD), iodine consumption or the like in waste water before discharge by subjecting the solution to microbial treatment (for example, activated sludge treatment, treatment with a filter comprising a porous carrier such as activated carbon or ceramic carrying microorganisms such as sulfur-oxidizing bacteria etc.) or oxidation treatment with electrification or an oxidizing agent before discharge, or to reduce the silver concentration in waste water by passing the solution through a filter using a polymer having affinity for silver, or by adding a compound that forms a hardly soluble silver complex, such as trimercaptotriazine, to precipitate silver, and then passing the solution through a filter.

In some cases, stabilization may be performed subsequent to the washing with water, and as an example thereof, a bath containing the compounds described in JP-A-2-201357, JP-A-2-132435, JP-A-1-102553 and JP-A-46-44446 may be used as a final bath of the silver halide photographic light-sensitive material. This stabilization bath may also contain, if required, an ammonium compound, metal compound such as Bi or Al, fluorescent brightening agent, various chelating agents, layer pH-adjusting agent, hardening agent, bactericide, antifungal agent, alkanolamine or surfactant.

The additives such as antifungal agent and the stabilizing agent added to the washing with water or stabilization bath may be formed into a solid agent like the aforementioned development and fixing processing agents.

Waste solutions of the developer, fixer, washing water or stabilizing solution used for the present invention are preferably burned for disposal. The waste solutions can also be concentrated or solidified by a concentrating apparatus such as those described in JP-B-7-83867 and U.S. Pat. No. 5,439,560, and then disposed.

When the replenishing amount of the processing agents is reduced, it is preferable to prevent evaporation or air oxidation of the solution by reducing the opening area of the processing tank. A roller transportation-type automatic developing machine is described in, for example, U.S. Pat. Nos. 3,025,779 and 3,545,971, and in the present specification, it is simply referred to as a roller transportation type automatic processor. This automatic processor performs four steps of development, fixing, washing with water and drying, and it is most preferable to follow this four-step processing also in the present invention, although other steps (e.g., stopping step) are not excluded. Further, a rinsing bath (washing tank) may be provided between development and fixing and/or between fixing and washing with water.

In the development of the silver halide photographic light-sensitive material of the present invention, the dry-to-dry time from the start of processing to finish of drying is preferably 25–160 seconds, the development time and the fixing time are each generally 30 seconds or less, preferably 6–30 seconds, and the temperature of each solution is preferably 25–50° C., more preferably 30–40° C. The temperature and the time of washing with water are preferably 0–50° C. and 40 seconds or less, respectively. According to a method used for the present invention, the silver halide photographic light-sensitive material after development, fixing and washing with water may be passed between squeeze rollers for squeezing washing water, and then dried. The drying is generally performed at a temperature of from about 40° C. to about 100° C. The drying time may be appropriately varied depending on the ambient conditions. The drying method is not particularly limited, and any known method may be used. Hot-air drying and drying by a heat roller or far infrared rays as described in JP-A-4-15534, JP-A-5-2256 and JP-A-5-289294 may be used, and a plurality of drying methods may also be used in combination.

As the image setter and automatic developing machine used for the present invention, any combination of them may be used so long as any problem is not caused concerning transportation. As the image setter, any of P9000 and Lux Setter RC-5600V produced by Fuji Photo Film Co., Ltd, Image setter FT-R5055 produced by Dainippon Screen Mfg. Co., Ltd., Select Set 5000, Avantra 25 and Acuset 1000 produced by Agfa Gevaert AG, Dolev 450 and Dolev 800 produced by Scitex, Lino 630, Quasar, Herkules ELITE and Signasetter produced by Heidelberg Co., Luxel F-9000, and Panther Pro 62 produced by PrePRESS Inc. may be used.

The present invention will be specifically explained with reference to the following examples and comparative examples. The materials, amounts, ratios, types and procedures of processes and so forth shown in the following examples can be optionally changed so long as such change does not depart from the spirit of the present invention. Therefore, the scope of the present invention should not be construed in any limitative way based on the following examples.

EXAMPLE 1

In this example, silver halide photographic light-sensitive materials satisfying the requirements of the present invention and comparative silver halide photographic light-sensitive materials were prepared and evaluated. Production methods of emulsions and non-photosensitive silver halide grains used for the production of those silver halide photographic light-sensitive materials will be explained first, and then preparation and evaluation of the silver halide photographic light-sensitive materials will be explained.

<<Preparation of Emulsion A>>

| Solution 1 | |
|---|---|
| Water | 750 mL |
| Gelatin | 20 g |
| Sodium chloride | 3 g |
| 1,3-Dimethylimidazolidine-2-thione | 20 mg |
| Sodium benzenethiosulfonate | 10 mg |
| citric acid | 0.7 g |
| **Solution 2** | |
| Water | 300 mL |
| Silver nitrate | 150 g |

-continued

<<Preparation of Emulsion A>>

| Solution 3 | |
|---|---|
| Water | 300 mL |
| Sodium chloride | 22 g |
| Potassium bromide | 58 g |
| $K_3IrCl_6$ (0.005% in 20% KCl aqueous solution) | Amount shown in Table 1 |
| $(NH_4)_3[RhCl_5(H_2O)]$ (0.001% in 20% NaCl aqueous solution) | Amount shown in Table 1 |

$K_3IrCl_6$ (0.005%) and $(NH_4)_3[RhCl_5(H_2O)]$ (0.001%) used for Solution 3 were prepared by dissolving powder of each in 20% aqueous solution of KCl or 20% aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.19 μm. Subsequently, Solution 4 and Solution 5 shown below were added over 8 minutes. Further, the remaining 10% of Solution 2 and Solution 3 were added over 2 minutes to allow growth of the grains to a diameter of 0.21 μm. Further, 0.15 g of potassium iodide was added and ripening was allowed for 5 minutes to complete the grain formation.

| Solution 4 | |
|---|---|
| Water | 100 mL |
| Silver nitrate | 50 g |
| **Solution 5** | |
| Water | 100 mL |
| Sodium chloride | 8.6 g |
| Potassium bromide | 19.3 g |
| $K_4[Fe(CN)_6].3H_2O$ (potassium ferrocyanide) | Amount shown in Table 1 |

Then, the resulting grains were washed according to a conventional flocculation method. Specifically, after the temperature of the mixture was lowered to 35° C., 3 g of Anionic precipitating agent 1 shown below was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg to 7.5, added with 10 mg of sodium benzenethiosulfonate, 3 mg of sodium benzenethiosulfinate, 15 mg of sodium thiosulfate pentahydrate and 4 mg of chloroauric acid to perform chemical sensitization at 55° C. for obtaining optimal sensitivity, and then added with 100 mg of 4-hydroxy-6-methyl-1,3,3a,7-tetra-zaindene as a stabilizer and 100 mg of an antiseptic (Proxcel, ICI Co., Ltd.).

Finally, there was obtained an emulsion of cubic silver iodochlorobromide grains containing 55 mol % of silver bromide and 0.08 mol % of silver iodide and having an average grain size of 0.21 μm with a variation coefficient of 9%. The emulsion finally showed pH of 5.7, pAg of 7.5, electric conductivity of 40 μS/m, density of 1.2–1.25×$10^3$ kg/$m^3$ and viscosity of 50 mPa·s.

Anionic Precipitating Agent 1

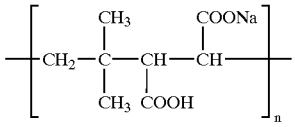

Average molecular weight: 120,000

| <<Preparation of Emulsion B>> | |
|---|---|
| Solution 1 | |
| Water | 750 mL |
| Gelatin | 20 g |
| Sodium chloride | 1 g |
| 1,3-Dimethylimidazolidine-2-thione | 20 mg |
| Sodium benzenthiosulfonate | 10 mg |
| Citric acid | 0.7 g |
| Solution 2 | |
| Water | 300 mL |
| Silver nitrate | 150 g |
| Solution 3 | |
| Water | 300 mL |
| Sodium chloride | 22 g |
| Potassium bromide | 58 g |
| $K_3IrCl_6$ (0.005% in 20% KCl aqueous solution) | Amount shown in Table 1 |
| $(NH_4)_3[RhCl_5(H_2O)]$ (0.001% in 20% NaCl aqueous solution) | Amount shown in Table 1 |

$K_3IrCl_6$ (0.005%) and $(NH_4)_3[RhCl_5(H_2O)]$ (0.001%) used for Solution 3 were prepared by dissolving powder of each in 20% aqueous solution of KCl or 20% aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.17 μm. Subsequently, 500 mg of 4-hydroxy-6-methyl-1,3,3a,7-tetrazaindene was added, and Solution 4 and Solution 5 shown below were further added over 8 minutes. Further, the remaining 10% of Solution 2 and Solution 3 were added over 2 minutes to allow growth of the grains to a diameter of 0.19 μm. Further, 0.15 g of potassium iodide was added and ripening was allowed for 5 minutes to complete the grain formation.

| Solution 4 | |
|---|---|
| Water | 100 mL |
| Silver nitrate | 50 g |
| Solution 5 | |
| Water | 100 mL |
| Sodium chloride | 8.6 mg |
| Potassium bromide | 19.3 mg |
| $K_4[Fe(CN)_6].3H_2O$ (potassium ferrocyanide) | Amount shown in Table 1 |

Then, the resulting grains were washed according to a conventional flocculation method. Specifically, after the temperature of the mixture was lowered to 35+ C., 3 g of Anionic precipitating agent 1 was added to the mixture, and pH was lowered by using sulfuric acid until the silver halide was precipitated (lowered to the range of pH 3.2±0.2) . Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg to 7.5, added with 10 mg of sodium benzenethiosulfonate, 3 mg of sodium benzenethiosulfinate, 2 mg of triphenylphosphine selenide and 4 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI Co., Ltd.).

Finally, there was obtained an emulsion of cubic silver iodochlorobromide grains containing 55 mol % of silver bromide and 0.08 mol % of silver iodide and having an average grain size of 0.19 μm with a variation coefficient of 10%. The emulsion finally showed pH of 5.7, pAg of 7.5, electric conductivity of 40 μS/m, density of 1.2×$10^3$ kg/$m^3$ and viscosity of 50 mPa·s.

<<Preparation of Emulsions C to H>>

These emulsions were prepared in the same manner as the preparation of Emulsion A except that the halogen compositions, grain sizes, kinds and addition amounts of doped heavy metals were changed as shown in Table 1. The halogen compositions were controlled by changing addition amounts of sodium chloride and potassium bromide in Solutions 3 and 5, and the grain sizes were controlled by changing addition amounts of sodium chloride and preparation temperatures for Solution 1.

| <<Preparation of Non-photosensitive silver halide grains (i)>> | |
|---|---|
| Solution 1 | |
| Water | 1 L |
| Gelatin | 20 g |
| Sodium chloride | 3.0 g |
| 1,3-Dimethylimidazolidine-2-thione | 20 mg |
| Sodium benzenethiosulfonate | 8 mg |
| Solution 2 | |
| Water | 400 mL |
| Silver nitrate | 100 g |
| Solution 3 | |
| Water | 400 mL |
| Sodium chloride | 13.5 g |
| Potassium bromide | 45.0 g |
| $(NH_4)_3[RhCl_5(H_2O)]$ | 8.6 mg ($4 \times 10^{-5}$ mol/Ag mol) |

Solutions 1, 2 and 3 maintained at 70° C. and pH 4.5 were simultaneously added over 15 minutes with stirring to form nucleus grains. Subsequently, Solution 4 and Solution 5 shown above were added over 15 minutes, and 0.15 g of potassium iodide was added to complete the grain formation.

Then, the resulting grains were washed with water according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.7 and pAg to 7.5, added with phenoxyethanol as an antiseptic to finally obtain a dispersion of non-post ripened cubic silver chloroiodobromide grains (i) containing 30 mol % of silver chloride and 0.08 mol % of silver iodide in average and having an average grain size of 0.45 μm with a variation coefficient of 10%. The emulsion finally showed pH of 5.7, pAg of 7.5, electric conductivity of 40 μS/m, density of 1.3–1.35×$10^3$ kg/$m^3$ and viscosity of 50 mPa·s.

<<Preparation of Coating Solutions>>

The silver halide photographic light-sensitive materials prepared in this example had a structure where UL layer, emulsion layer, lower protective layer and upper protective layer were formed in this order on one surface of a polyethylene terephthalate film support mentioned below having moisture proof undercoat layers comprising vinylidene chloride on the both surfaces, and an electroconductive layer and back layer were formed in this order on the opposite surface.

Compositions of coating solutions used for forming the layers are shown below.

Coating solution for UL layer

| | |
|---|---|
| Gelatin | 0.3 g/$m^2$ |
| Polyethyl acrylate latex | 150 mg/$m^2$ |
| Compound (Cpd-7) | 40 mg/$m^2$ |
| Compound (Cpd-14) | 10 mg/$m^2$ |

-continued

| | |
|---|---|
| 5-Methylbenzotriazole | 40 mg/$m^2$ |
| Antiseptic (Proxcel, ICI Co., Ltd.) | 1.5 mg/$m^2$ |
| Coating solution for emulsion layer | |
| Emulsion (type shown in Table 2) | Amount shown in Table 2 |
| Sensitizing dye A | 5.7 × $10^{-4}$ mol/Ag mol |
| KBr | 3.4 × $10^{-4}$ mol/Ag mol |
| Compound (Cpd-1) | 2.0 × $10^{-4}$ mol/Ag mol |
| Compound (Cpd-2) | 2.0 × $10^{-4}$ mol/Ag mol |
| Compound (Cpd-3) | 8.0 × $10^{-4}$ mol/Ag mol |
| 4-Hydroxy-6-methyl-1,3,3a,7-tetrazaindene | 1.2 × $10^{-4}$ mol/Ag mol |
| Hydroquinone | 1.2 × $10^{-2}$ mol/Ag mol |
| Citric acid | 3.0 × $10^{-4}$ mol/Ag mol |
| Hydrazine compound (compound shown in Table 2) | Amount shown in Table 2 |
| Nucleation accelerator (compound shown in Table 2) | Amount shown in Table 2 |
| 2,4-Dichloro-6-hydroxy-1,3,5-triazine sodium salt | 90 mg/$m^2$ |
| Aqueous latex (Cpd-6) | 100 mg/$m^2$ |
| Polyethyl acrylate latex | 150 mg/$m^2$ |
| Colloidal silica (particle size: 10 μm) | 15 weight % as for gelatin |
| Compound (Cpd-7) | 4 weight % as for gelatin |
| Latex of copolymer of methyl acrylate, 2-acrylamido-2-methypropanesulfonic acid sodium salt and 2-acetoxyethyl methacrylate (weight ratio = 88:5:7) | 150 mg/$m^2$ |
| Core/shell type latex (core: styrene/butadiene copolymer (weight ratio = 37/63), shell: styrene/2-acetoxyethyl acrylate copolymer (weight ratio = 84/16), core/shell ratio = 50/50) | 150 mg/$m^2$ |

pH of the coating solution was adjusted to 5.6 by using citric acid.

The coating solution for emulsion layer prepared as described above was coated on the support mentioned below so that the coated silver amount and coated gelatin amount should become the amounts mentioned in Table 2.

Sensitizing dye A

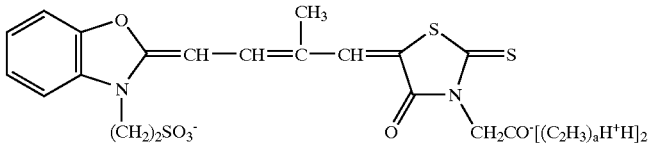

Cpd-1

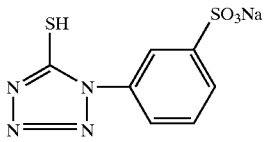

Cpd-2

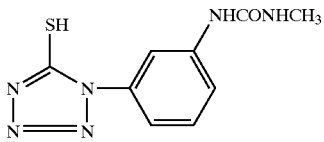

Cpd-3

-continued

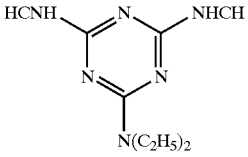

Cpd-5

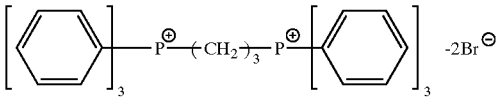

Cpd-6

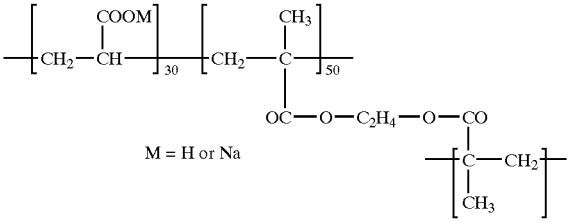

Cpd-7

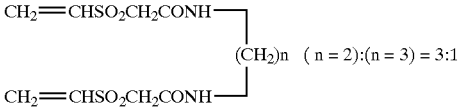

Hz-1

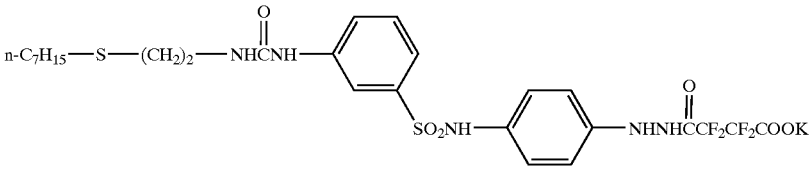

| Coating solution for lower protective layer | |
|---|---|
| Gelatin | 0.5 g/m$^2$ |
| Non-photosensitive silver halide grains as silver amount | 0.1 g/m$^2$ |
| compound (Cpd-12) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-13) | 3 mg/m$^2$ |
| Compound (Cpd-20) | 5 mg/m$^2$ |
| Antiseptic (Proxcel, ICI Co., Ltd.) | 1.5 mg/m$^2$ |
| **Coating solution for upper protective layer** | |
| Gelatin | 0.3 g/m$^2$ |
| Amorphous silica matting agent (average particle size: 3.5 $\mu$m) | 25 mg/m$^2$ |
| Compound (Cpd-8) (gelatin dispersion) | 20 mg/m$^2$ |
| Colloidal silica (particle size: 10–20 $\mu$m, Snowtex C, Nissan Chemical) | 30 mg/m$^2$ |
| Compound (Cpd-9) | 50 mg/m$^2$ |
| Sodium dodecylbenzenesulfonate | 20 mg/m$^2$ |
| Compound (Cpd-10) | 20 mg/m$^2$ |
| Compound (Cpd-11) | 20 mg/m$^2$ |
| Antiseptic (Proxcel, ICI Co, Ltd.) | 1 mg/m$^2$ |
| **Coating solution for back layer** | |
| Gelatin | 3.0 g/m$^2$ |
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-Divinylsulfonyl-2-propanol | 60 mg/m$^2$ |
| Polymethyl methacrylate microparticles | 30 mg/m$^2$ |

-continued

| | |
|---|---|
| (mean particle sizes: 6.5 μm) | |
| Liquid paraffin | 78 mg/m$^2$ |
| Compound (Cpd-7) | 120 mg/m$^2$ |
| Compound (Cpd-20) | 5 mg/m$^2$ |
| Colloidal silica (particle size: 10 pm) | 15 weight % |
| as for gelatin | |
| Calcium nitrate | 20 mg/m$^2$ |
| Antiseptic (Proxcel, ICI Co., Ltd.) | 12 mg/m$^2$ |
| Coating solution for electroconductive layer | |
| Gelatin | 0.1 g/m$^2$ |
| Sodium dodecylbenzenesulfonate | 20 mg/m$^2$ |
| $SnO_2$/Sb (weight ratio = 9:1, average particle size: 0.25 μm) | 200 mg/m$^2$ |
| Antiseptic (Proxcel, ICI Co., LtcL) | 0.3 mg/m$^2$ |

Viscosity of the coating solutions for the layers was adjusted by adding Thickener Z mentioned below.

Cpd-8

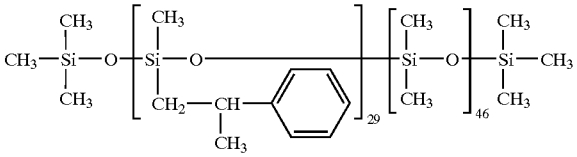

Cpd-9

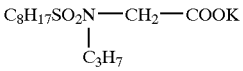

Cpd-10

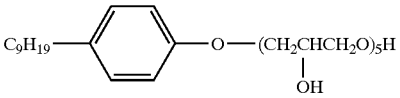

Cpd-11

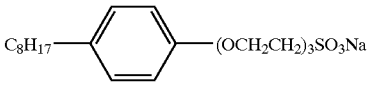

Cpd-12

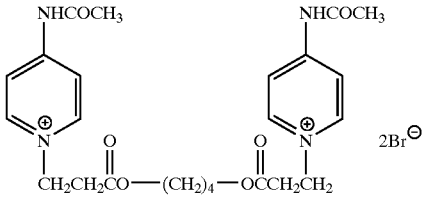

Cpd-13

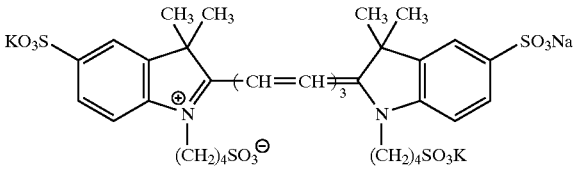

-continued

Cpd-14

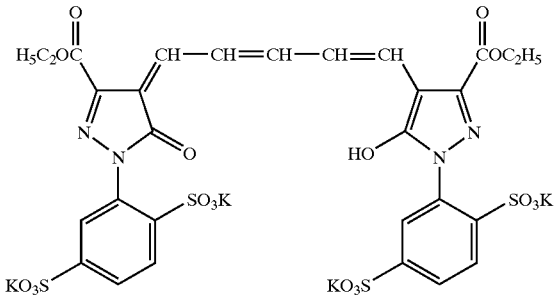

Thickener Z

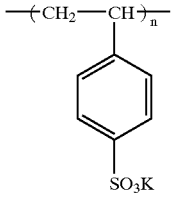

Cpd-15

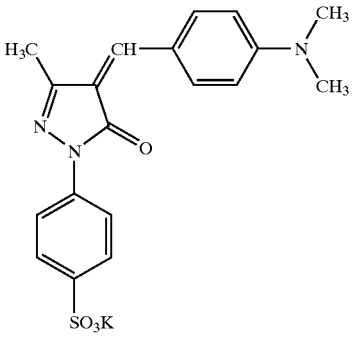

Cpd-16

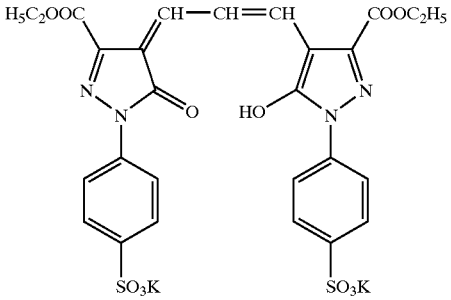

-continued

Cpd-17

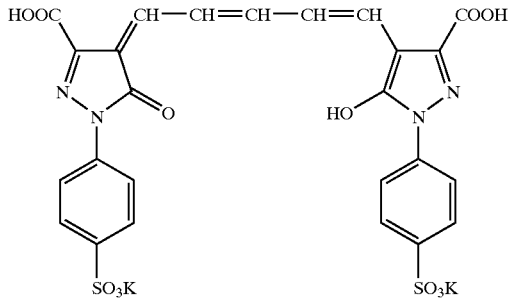

Cpd-18

$CH_3(CH_2)_{11}—CH═CHSO_3Na$

Cpd-19

$CH_3(CH_2)_{11}—CH_2—CH_2SO_3Na$

Cpd-20

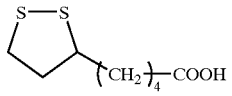

<<Support>>

On both surfaces of a biaxially stretched polyethylene terephthalate support (thickness: 100 μm), coating solutions for first undercoat layer and second undercoat layer having the following compositions were coated.

| Coating solution for first undercoat layer | |
|---|---|
| core/shell type vinylidene chloride copolymer (i) | 15 g |
| 2,4-Dichloro-6-hydroxy-s-triazine | 0.25 g |
| Polystyrene microparticles (mean particle size: 3 μm) | 0.05 g |
| Compound (Cpd-21) | 0.20 g |
| Colloidal silica (particle size: 70–100 μm Snowtex ZL, Nissan Chemical) | 0.12 g |
| Water | Amount making total amount 100 g |

The coating solution was adjusted to pH 6 by further addition of 10 weight % of KOH and coated so that a dry thickness of 0.9 μm should be obtained after drying at a drying temperature of 180° C. for 2 minutes.

| Coating solution for second undercoat layer | |
|---|---|
| Gelatin | 1 g |
| Methylcellulose | 0.05 g |
| Compound (Cpd-22) | 0.02 g |
| $C_{12}H_{25}O(CH_2CH_2O)_{10}H$ | 0.03 g |
| Antiseptic (Froxcel, ICI Co., Ltd.) | $3.5 \times 10^{-3}$ g |
| Acetic acid | 0.2 g |
| Water | Amount making total amount 100 g |

This coating solution was coated so that a dry thickness of 0.1 μm should be obtained after drying at a drying temperature of 170° C. for 2 minutes.

Core/Shell Type Vinylidene Chloride Copolymer (i)

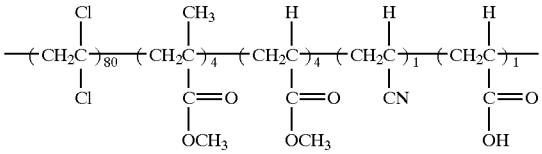

| VDC | MMa | MA | AN | AA |
|---|---|---|---|---|

| | |
|---|---|
| Core: | VDC/MMA/MA (80 weight %) |
| Shell: | VDC/AN/AA (20 weight %) |
| Average particle size: | 70 nm |

Compound (Cpd-21)

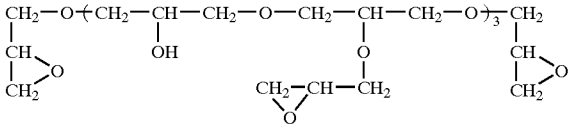

Compound (Cpd-22)

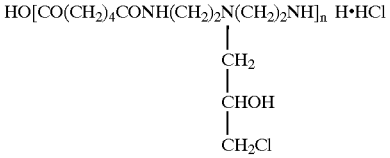

n = 10

<<Method for Coating on Support>>

First, on the aforementioned support coated with the undercoat layers, for the emulsion layer side, four layers of UL layer, emulsion layer, lower protective layer and upper protective layer were simultaneously coated as stacked layers in this order from the support at 35° C. by the slide bead coating method while adding a hardening agent solution and passed through a cold wind setting zone (5° C.). Then, on the side opposite to the emulsion layer side, an electroconductive layer and a back layer were simultaneously coated as stacked layers in this order from the support by the curtain coating method while adding a hardening agent solution, and passed through a cold wind setting zone (5° C.). After the coated support was passed through each setting zone, the coating solutions showed sufficient setting. Subsequently, the support coated with the layers was dried for the both surfaces in a drying zone of the drying conditions mentioned below. The coated support was transported without any contact with rollers and the other members after the coating of the back surface until it was rolled up. The coating speed was 200 m/min.

<<Drying Conditions>>

After the setting, the coated layers were dried with a drying wind at 30° C. until the water/gelatin weight ratio became 800%, and then with a drying wind at 35° C. and relative humidity of 30% for the period where the ratio became 200% from 800%. The coated layers were further blown with the same wind, and 30 second after the point where the surface temperature became 34° C. (regarded as completion of drying), the layers were dried with air at 48° C. and relative humidity of 2% for 1 minute. In this operation, the drying time was 50 seconds from the start to the water/gelatin ratio of 800%, 35 seconds from 800% to 200% of the ratio, and 5 seconds from 200% of the ratio to the end of the drying.

This silver halide photographic light-sensitive material was rolled up at 25° C. and relative humidity of 55%, cut under the same environment, conditioned for moisture content at 25° C. and relative humidity of 50% for 8 hours and then sealed in a barrier bag conditioned for moisture content for 6 hours together with a cardboard conditioned for moisture content at 25° C. and relative humidity of 50% for 2 hours to prepare each of the samples mentioned in Table 2.

Humidity in the barrier bag was measured and found to be 45%, The obtained samples had a film surface pH of 5.5–5.8 for the emulsion layer side and 6.0–6.5 for the back side. Absorption spectra of the emulsion layer side and back layer side are shown in FIG. 1.

<<Light Exposure and Development>>

Each of the obtained samples was exposed with xenon flash light for an emission time of $10^{-6}$ second through, an interference filter having a peak at 667 nm and a step wedge.

Then, each sample was processed with development conditions of 35° C. for 30 seconds by using a developer (ND-1, Fuji Photo Film Co., Ltd.), a fixer (NF-1, Fuji Photo Film Co., Ltd.) and an automatic developing machine (FG-680AG, Fuji Photo Film Co., Ltd.).

<<Evaluation>>

Sensitivity, gradation (gamma), practice density and processing property of the samples were measured by the methods described below.

(Sensitivity)

Sensitivity was represented by a reciprocal of exposure giving a density of fog +1.5 as a relative value based on the sensitivity of Sample No. 1, which was taken as 100. A larger value means higher sensitivity.

(Gradation γ)

A characteristic curve drawn in orthogonal coordinates of optical density (y-axis) and common logarithm of light exposure (x-axis) using equal unit lengths for the both axes was prepared, and inclination of a straight line connecting two points on the curve corresponding to optical densities of 0.3 and 3.0 was determined as gamma.

(Practice Density)

Test steps were outputted by using an image setter (RC5600V, Fuji Photo Film Co., Ltd.) at 175 lines/inch with changing the light quantity and developed under the conditions described above. The exposure was performed at an LV value giving 50% of medium half tone dots, and density of a Dmax portion was measured as practice density. The half tone % and the practice density were measured by using a densitometer (Macbeth TD904).

(Processing Stability of Silver Halide Photographic Light-sensitive Material)

As for each of the samples prepared as shown in Table 2, 20 sheets of the sample in the Daizen size (50.8×61.0 cm) blackened for 15% were processed per day by using the developer QR-D1 with replenishing the used solution in an amount of 80 mL per one sheet of the Daizen size. This daily operation was performed for 6 days in a week, and this running was continued for 15 weeks. By processing a small amount of films as described above, a developer undergone small amount processing was obtained.

Further, as for each of the samples prepared as shown in Table 2, 300 sheets of the sample in the Daizen size (50.8×61.0 cm) blackened for 85% were processed per day by using the developer QR-D1 with replenishing the used solution in an amount of 80 mL per one sheet of the Daizen size. This daily operation was performed for consecutive 4 days. By processing a large amount of films as described above, a developer undergone large amount processing was obtained.

Practice density was evaluated by using these developers. The exposure was performed at an LV value giving 50% of medium half tone dots, and the developer undergone small amount processing and the developer undergone large amount processing were used to obtain practice density (small amount) and practice density (large amount) as well as half tone % (half tone % after small amount processing and half tone % after large amount processing).

The results of these evaluations are summarized in Table 2 From the results shown in Table 2, it can be seen that the samples satisfying the requirements of the present invention showed high sensitivity and practice density as well as superior processing property.

TABLE 1

| | | | Heavy metal | | | | | |
|---|---|---|---|---|---|---|---|---|
| Emulsion | Halogen composition of silver halide | Grain size (μm) | Type | Amount* (mol/Ag mol) | Type | Amount* (mol/Ag mol) | Type | Amount* (mol/Ag mol) |
| A | $AgBr_{56}Cl_{44.9}I_{0.1}$ | 0.21 μm | $(NH_4)_3[RhCl_5(H_2O)]$ | $4.7 \times 10^{-7}$ | $K_3IrCl_6$ | $5.5 \times 10^{-7}$ | $K_4[Fe(CN)_6]\cdot 3H_2O$ | $3 \times 10^{-5}$ |
| B | $AgBr_{55}Cl_{44.9}I_{0.1}$ | 0.17 μm | $(NH_4)_3[RhCl_6(H_2O)]$ | $11.3 \times 10^{-7}$ | $K_8IrCl_6$ | $5.5 \times 10^{-7}$ | $K_4[Fe(CN)_6]\cdot 3H_2O$ | $3 \times 10^{-5}$ |
| C | $AgBr_{55}Cl_{44.9}I_{0.1}$ | 0.21 μm | $(NH_4)_3[RhCl_6(H_2O)]$ | $3.0 \times 10^{-7}$ | $K_3IrCl_6$ | $5.5 \times 10^{-7}$ | $K_4[Fe(CN)_6]\cdot 3H_2O$ | — |
| D | $AgBr_{55}Cl_{44.9}I_{0.1}$ | 0.21 μm | $(NH_4)_3[RhCl_5(H_2O)]$ | $3.2 \times 10^{-7}$ | $K_3IrCl_6$ | $5.5 \times 10^{-7}$ | $K_4[Fe(CN)_6]\cdot 3H_2O$ | $8 \times 10^{-7}$ |
| E | $AgBr_{55}Cl_{44.9}I_{0.1}$ | 0.21 μm | $K_2(Ru(NO)Cl_5]$ | $2.3 \times 10^{-7}$ | $K_3IrCl_6$ | $5.5 \times 10^{-7}$ | $K_4[Ru(CN)_6]$ | $4 \times 10^{-6}$ |
| F | $AgBr_{30}Cl_{69.9}I_{0.1}$ | 0.21 μm | $(NH_4)_3[RhCl_6(H_2O)]$ | $3.0 \times 10^{-7}$ | $K_3IrCl_6$ | $5.5 \times 10^{-7}$ | $K_4[Fe(CN)_6]\cdot 3H_2O$ | $3 \times 10^{-5}$ |
| G | $AgBr_{46}Cl_{84.9}I_{0.1}$ | 0.21 μm | $(NH_4)_3[RhCl_5(H_2O)]$ | $4.1 \times 10^{-7}$ | $K_3IrCl_6$ | $5.5 \times 10^{-7}$ | $K_4[Fe(CN_6]\cdot 3H_2O$ | $3 \times 10^{-5}$ |
| H | $AgBr_{70}Cl_{29.9}I_{0.1}$ | 0.21 μm | $(NH_4)_3[RhCl_5(H_2O)]$ | $4.8 \times 10^{-7}$ | $K_3IrCl_6$ | $5.5 \times 10^{-7}$ | $K_4[Fe(CN_6]\cdot 3H_2O$ | $3 \times 10^{-5}$ |

*Amount with respect to the total Ag melar amount of completed grains

TABLE 2

| Sample No. | Emulsion | Emulsion layer: Silver amount ($g/m^3$) | Emulsion layer: Gelatin amount ($g/m^2$) | Hydrazine compound: Type | Hydrazine compound: Amount (mol/Ag mol) | Nucleation accelerator: Type | Nucleation accelerator: Amount (mol/Ag mol) | Photographic property: Sensitivity | Photographic property: Gradation γ | Photographic property: Practice density | Processing property: Practice density (small amount | Processing property: Half tone % after small amount processing | Processing property: Practice density (large amount | Processing property: Half tone % after large amount processing | Note |
|---|---|---|---|---|---|---|---|---|---|---|---|---|---|---|---|
| 1-1 | A | 2.9 | 1.2 | Hz-1 | $2.7 \times 10^{-4}$ | — | — | 100 | 17.8 | 4.3 | 4.4 | 64 | 3.9 | 47 | Comparative |
| 1-2 | C | 2.9 | 1.2 | Hz-1 | $2.7 \times 10^{-4}$ | — | — | 92 | 10.3 | 4.0 | 4.3 | 65 | 3.6 | 46 | Comparative |
| 1-3 | A | 2.9 | 1.2 | A-83 | $8.9 \times 10^{-4}$ | — | — | 98 | 15.1 | 4.3 | 4.5 | 54 | 4.0 | 48 | Invention |
| 1-4 | C | 2.9 | 1.2 | A-83 | $8.9 \times 10^{-4}$ | — | — | 90 | 12.2 | 4.2 | 4.4 | 54 | 3.5 | 48 | Comparative |
| 1-5 | A | 2.9 | 1.2 | A-17 | $4.5 \times 10^{-4}$ | — | — | 108 | 20.4 | 4.5 | 4.8 | 51 | 4.4 | 49 | Invention |
| 1-6 | C | 2.9 | 1.2 | A-17 | $4.5 \times 10^{-4}$ | — | — | 95 | 12.9 | 4.2 | 4.3 | 51 | 3.7 | 49 | Comparative |
| 1-7 | D | 2.9 | 1.2 | A-17 | $4.5 \times 10^{-4}$ | — | — | 102 | 16.1 | 4.3 | 4.4 | 51 | 4.0 | 49 | Invention |
| 1-8 | E | 2.9 | 1.2 | A-17 | $4.5 \times 10^{-4}$ | — | — | 106 | 22.1 | 4.5 | 4.6 | 51 | 4.5 | 49 | Invention |
| 1-9 | F | 2.9 | 1.2 | A-17 | $4.0 \times 10^{-4}$ | — | — | 99 | 15.2 | 4.3 | 4.5 | 51 | 4.0 | 49 | Invention |
| 1-10 | G | 2.9 | 1.2 | A-17 | $4.3 \times 10^{-4}$ | — | — | 102 | 18.3 | 4.4 | 4.6 | 51 | 4.3 | 49 | Invention |
| 1-11 | H | 2.9 | 1.2 | A-17 | $5.5 \times 10^{-4}$ | — | — | 100 | 14.5 | 4.3 | 4.4 | 51 | 4.0 | 49 | Invention |
| 1-12 | A | 2.9 | 1.2 | A-17 | $1.2 \times 10^{-4}$ | Cpd-5 | $5.0 \times 10^{-4}$ | 108 | 25.2 | 4.5 | 4.6 | 52 | 4.4 | 50 | Invention |
| 1-13 | A:B = 1:2 (molar ratio of silver) | 2.9 | 1.2 | A-17 | $6.0 \times 10^{-4}$ | — | — | 102 | 20.2 | 4.8 | 4.9 | 52 | 4.7 | 49 | Invention |

EXAMPLE 2

The same experiments as those of Example 1 were performed for the samples mentioned in Table 3 by using G101C produced by Agfa Gevaert AG (developer), G333 produced by Agfa Gevaert AG (fixer) and a replenishing amount of used solution of 100 mL per one sheet of the Daizen size.

The results of these evaluations are summarized in Table 3. From the results shown in Table 3, it can be seen that the samples satisfying the requirements of the present invention showed superior processing property.

TABLE 3

| Sample No. | Emulsion | Emulsion layer: Silver amount ($g/m^3$) | Emulsion layer: Gelatin amount ($g/m^2$) | Hydrazine compound: Type | Hydrazine compound: Amount (mol/Ag mol) | Nucleation accelerator: Type | Nucleation accelerator: Amount (mol/Ag mol) | Photographic property: Sensitivity | Photographic property: Gradation γ | Photographic property: Practice density | Processing property: Practice density (small amount | Processing property: Half tone % after small amount processing | Processing property: Practice density (large amount | Processing property: Half tone % after large amount processing | Note |
|---|---|---|---|---|---|---|---|---|---|---|---|---|---|---|---|
| 2-1 | C | 2.9 | 1.2 | Hz-1 | $3.5 \times 10^{-4}$ | — | — | 100 | 18.4 | 4.4 | 4.5 | 82 | 3.9 | 49 | Comparative |
| 2-2 | C | 2.9 | 1.2 | A-83 | $4.8 \times 10^{-4}$ | — | — | 98 | 13.8 | 4.3 | 4.4 | 55 | 3.7 | 48 | Comparative |
| 2-3 | A | 2.9 | 1.2 | Hz-1 | $3.9 \times 10^{-4}$ | — | — | 111 | 21.3 | 4.4 | 4.5 | 79 | 3.9 | 49 | Comparative |
| 2-4 | A | 2.9 | 1.2 | A-30 | $2.6 \times 10^{-4}$ | — | — | 115 | 21.3 | 4.4 | 4.5 | 52 | 4.3 | 49 | Invention |
| 2-6 | A | 2.9 | 1.2 | A-32 | $2.2 \times 10^{-4}$ | — | — | 117 | 20.8 | 4.4 | 4.5 | 51 | 4.4 | 50 | Invention |
| 2-6 | A | 2.9 | 1.2 | A-81 | $2.9 \times 10^{-4}$ | — | — | 114 | 22.6 | 4.4 | 4.5 | 51 | 4.4 | 50 | Invention |
| 2-7 | A | 2.9 | 1.2 | A-41 | $2.8 \times 10^{-4}$ | — | — | 116 | 20.5 | 4.4 | 4.5 | 51 | 4.5 | 50 | Invention |
| 2-8 | A | 2.9 | 1.2 | A-78 | $3.0 \times 10^{-4}$ | — | — | 118 | 21.8 | 4.4 | 4.5 | 50 | 4.5 | 49 | Invention |

EXAMPLE 3

Samples were prepared in the same manner as in Examples 1 except that each of carboxymethyltrimethylthiourea compound or dicarboxymethyldimethylthiourea compound, which are tetra-substituted thiourea compounds, was used instead of the sodium thiosulfate used for chemical sensitization of Emulsion A in Example 1 in the same molar amount as the sodium thiosulfate, and evaluated in the same manners as in Examples 1 and 2. As a result, the samples having the characteristics of the present invention showed good performances as in Examples 1 and 2.

EXAMPLE 4

The same experiment as that of Example 1 was performed by using RA2000 produced by Kodak Polychrome Graphics (developer), RA3000 produced by Kodak Polychrome Graphics (fixer) and a replenishing amount of used solution of 144 mL per one sheet of the Daizen size (50.8×61.0 cm). As a result, the samples having the characteristics of the present invention showed good performances as in Example 1.

EXAMPLE 5

The same experiment as that of Example 1 was performed by using Type 681 produced by Konica Corporation (developer) and Type 881 produced by Konica Corporation (fixer). As a result, the samples having the characteristics of the present invention showed good performances as in Example 1.

EXAMPLE 6

The same experiment as that of Example 1 was performed by using QR-D1 PD produced by Fuji Photo Film Co., Ltd. (solid developer described below) and UR-F1 PD produced by Fuji Photo Film Co., Ltd. (solid fixer described below). As a result, the samples having the characteristics of the present invention showed good performances as in Example 1.

EXAMPLE 7

The same experiment as that of Example 1 was performed by using 681Z produced by Konica Corporation (solid developer described below) and 881Z produced by Konica Corporation (solid fixer described below). As a result, the samples having the characteristics of the present invention showed good performances as in Example 1.

EXAMPLE 8

The same experiment as that of Example 1 was performed by using 731G produced by Konica Corporation (solid developer described below) and 921G produced by Konica Corporation (solid fixer described below). As a result, the samples having the characteristics of the present invention showed good performances as in Example 1.

EXAMPLE 9

When the processing procedures of Examples 1 to 8 were performed at a development temperature of 38° C. and fixing temperature of 37° C. for development time of 20 seconds, results similar to those obtained in Examples 1 to 6 were obtained, and thus the effect of the present invention was not degraded.

EXAMPLE 10

Even when the processing procedures of Examples 1 to 9 were performed with a transportation speed of silver halide photographic light-sensitive materials of 1500 mm/minute as a line speed by using an automatic developing machine, FG-680AS (Fuji Photo Film Co., Ltd.), the samples having the characteristics of the present invention similarly showed good performances.

EXAMPLE 11

When the same evaluations were performed by using, instead of Lux Setter RC-5600V produced by Fuji Photo Film Co., Ltd, any one of PI-2800 produced by Fuji Photo Film Co., Ltd, Image setter FT-R5055 produced by Dainippon Screen Mfg. Co., Ltd., Select Set 5000, Avantra 25 and Acuset 1000 produced by Agfa Gevaert AG, Dolev 450 and Dolev 800 produced by Scitex, Lino 630, Quasar, Herkules ELITE and Signasetter produced by Heidelberg Co., Ltd., Lux Setters Luxel F-9000 and F-6000 produced by Fuji Photo Film Co., Ltd. and Panther Pro 62 produced by PrePRESS Inc., the samples having the characteristics of the present invention showed good performances.

EXAMPLE 12

| <<Preparation of Emulsion A>> | |
|---|---|
| Solution 1 | |
| Water | 750 mL |
| Gelatin | 20 g |
| Sodium chloride | 3 g |
| 1,3-Dimethylimidazolidine-2-thione | 20 mg |
| Sodium benzenethiosulfonate | 10 mg |
| Citric acid | 0.7 g |
| Solution 2 | |
| Water | 300 mL |
| Silver nitrate | 150 g |
| Solution 3 | |
| Water | 300 mL |
| Sodium chloride | 38 g |
| Potassium bromide | 32 g |
| $K_3IrCl_6$ (0.005 weight % in 20 weight % KCl aqueous solution) | 5 mL |
| $(NH_4)_3[RhCl_5(H_2O)]$ (0.001 weight % in 20 weight % Nacl aqueous solution) | 7 mL |

$K_3IrCl_6$ (0.005 weight % in 20 weight % KCl aqueous solution) and $(NH_4)_3[RhCl_5(H_2O)]$ (0.01 weight% in 20 weight % NaCl aqueous solution) used for Solution 3 were prepared by dissolving powder of each in 20 weight % aqueous solution of KCl or 20 weight % aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.16 μm. Subsequently, Solution 4 and Solution 5 shown below were added over 8 minutes. Further, the remaining 10% of Solution 2 and Solution 3 were added over 2 minutes to allow growth of the grains to a diameter of 0.21 μm. Further, 0.15 g of potassium iodide was added and ripening was allowed for 5 minutes to complete the grain formation.

| | |
|---|---|
| Solution 4 | |
| Water | 100 mL |
| Silver nitrate | 50 g |
| Solution 5 | |
| Water | 100 mL |
| Sodium chloride | 13 g |
| Potassium bromide | 11 g |
| $K_4[Fe(CN)_6].3H_2O$ (potassium ferrocyanide) | 50 mg |

Then, the resulting grains were washed according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg to 7.5, added with 10 mg of sodium benzenethiosulfonate, 3 mg of sodium benzenethiosulfinate, 15 mg of sodium thiosulfate and 10 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI Co., Ltd.).

Finally, there was obtained an emulsion of cubic silver iodochlorobromide grains containing 30 mol % of silver bromide and 0.08 mol % of silver iodide and having an average grain size of 0.22 μm with a variation coefficient of 9%. The emulsion finally showed pH of 5.7, pAg of 7.5, electric conductivity of 40 μS/m, density of $1.2\times10^3$ kg/m$^3$ and viscosity of 50 mPa·s.

| <<Preparation of Emulsion B>> | |
|---|---|
| Solution 1 | |
| Water | 750 mL |
| Gelatin | 20 g |
| Sodium chloride | 1 g |
| 1,3-Dimethylimidazolidine-2-thione | 20 mg |
| Sodium benzenthiosulfonate | 10 mg |
| Citric acid | 0.7 g |
| Solution 2 | |
| Water | 300 mL |
| Silver nitrate | 150 g |
| Solution 3 | |
| Water | 300 mL |
| Sodium chloride | 38 g |
| Potassium bromide | 32 g |
| $K_3IrCl_6$ (0.005 weight % in 20 weight % KCl aqueous solution) | 5 mL |
| $(NH_4)_3[RhCl_5(H_2O)]$ (0.001 weight % in 20 weight % Nacl aqueous solution) | 15 mL |

$K_3IrCl_6$ (0.005 weight % in 20 weight % KCl aqueous solution) and $(NH_4)_3$ $[RhCl_5$ $(H_2O)]$ (0.001 weight % in 20 weight % NaCl aqueous solution) used for Solution 3 were prepared by dissolving powder of each in 20 weight % aqueous solution of KCl or 20 weight % aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.16 μm. Subsequently, 500 mg of 1,3,3a,7-tetrazaindene was added, and Solution 4 and Solution 5 shown below were further added over 8 minutes. Further, the remaining 10% of Solution 2 and Solution 3 were added over 2 minutes to allow growth of the grains to a diameter of 0.18 μm. Further, 0.15 g of potassium iodide was added and ripening was allowed for 5 minutes to complete the grain formation.

| | |
|---|---|
| Solution 4 | |
| Water | 100 mL |
| Silver nitrate | 50 g |
| Solution 5 | |
| Water | 100 mL |
| Sodium chloride | 13 g |
| Potassium bromide | 11 g |
| $K_4[Fe(CN)_6].3H_2O$ (potassium ferrocyanide) | 2 mg |

Then, the resulting grains were washed according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg to 7.5, added with 10 mg of sodium benzenethiosulfonate, 3 mg of sodium benzenethiosulfinate, 2 mg of triphenylphosphine selenide and 1 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI Co., Ltd.).

Finally, there was obtained an emulsion of cubic silver iodochlorobromide grains containing 70 mol % of silver chloride and 0.08 mol % of silver iodide and having an average grain size of 0.18 μm with a variation coefficient of 10%. The emulsion finally showed pH of 5.7, pAg of 7.5, electric conductivity of 40 μS/m, density of $1.2\times10^3$ kg/m$^3$ and viscosity of 50 mPa·s.

<<Preparation of Coating Solutions>>

The silver halide photographic light-sensitive materials prepared in this example had a structure where UL layer, emulsion layer, lower protective layer and upper protective layer were formed in this order on one surface of the same support as that used in Example 1, and an electroconductive layer and back layer were formed in this order on the opposite surface.

Compositions of coating solutions used for forming the layers are shown below.

| Coating solution for UL layer | |
|---|---|
| Gelatin | 0.5 g/m$^2$ |
| Polyethyl acrylate latex | 150 mg/m$^2$ |
| Compound (Cpd-7) | 40 mg/m$^2$ |
| Compound (Cpd-14) | 10 mg/m$^2$ |
| Antiseptic (Proxcel, ICI Co., Ltd.) | 1.5 mg/m$^2$ |

Coating Solution for Emulsion Layer

Emulsions A and B were mixed in a ratio of 1:2 and subjected to spectral sensitization by addition of $5.7\times10^{-4}$ mol/Ag mol of Sensitizing dye A, and the following components were further added.

| | |
|---|---|
| KBr | $3.4 \times 10^{-4}$ mol/Ag mol |
| Compound (Cpd-1) | $2.0 \times 10^{-4}$ mol/Ag mol |
| Compound (Cpd-2) | $2.0 \times 10^{-4}$ mol/Ag mol |
| Compound (Cpd-3) | $8.0 \times 10^{-4}$ mol/Ag mol |
| 4-Hydroxy-6-methyl-1,3,3a,7-tetrazaindene | $1.2 \times 10^{-4}$ mol/Ag mol |
| Hydroquinone | $1.2 \times 10^{-2}$ mol/Ag mol |
| Citric acid | $3.0 \times 10^{-4}$ mol/Ag mol |
| Hydrazine compound (compound shown in Table 5) | Amount shown in Table 5 |
| Nucleation accelerator (compound shown in Table 5) | Amount shown in Table 5 |
| 2,4-Dichloro-6-hydroxy-1,3,5-triazine sodium salt | 90 mg/m$^2$ |
| Aqueous latex (Cpd-6) | 100 mg/m$^2$ |
| Polyethyl acrylate latex | 150 mg/m$^2$ |
| Colloidal silica (particle size: 10 $\mu$m) | 15 weight % as for gelatin |
| Compound (Cpd-7) | 4 weight % as for gelatin |
| Latex of copolymer of methyl acrylate, 2-acrylamido-2-methypropanesulfonic acid sodium salt and 2-acetoxyethyl methacrylate (weight ratio = 88:5:7) | 150 mg/m$^2$ |
| Core/shell type latex (core: styrene/butadiene copolymer (weight ratio = 37/63), shell: styrene/2-acetoxyethyl acrylate copolymer (weight ratio = 84/16), core/shell ratio = 50/50) | 150 mg/m$^2$ |

pH of the coating solution was adjusted to 5.6 by using citric acid. The coating solution for emulsion layer prepared as described above was coated on the support mentioned above so that the coated silver amount and coated gelatin amount should become 3.4 g/m$^2$ and 1.5 g/m$^2$, respectively.

| Coating solution for lower protective layer | |
|---|---|
| Gelatin | 0.5 g/m$^2$ |
| Compound (Cpd-12) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-13) | 3 mg/m$^2$ |
| Antiseptic (Proxcel, ICI Co., Ltd.) | 1.5 mg/m$^2$ |
| **Coating solution for upper protective layer** | |
| Gelatin | 0.3 g/m$^2$ |
| Amorphous silica matting agent (average particle size: 3.5 $\mu$m) | 25 mg/m$^2$ |
| Compound (Cpd-8) (gelatin dispersion) | 20 mg/m$^2$ |
| Colloidal silica (particle size: 10–20 $\mu$m, Snowtex C, Nissan chemical) | 30 mg/m$^2$ |
| Compound (Cpd-9) | 50 mg/m$^2$ |
| Sodium dodecylbenzenesulfonate | 20 mg/m$^2$ |
| Compound (Cpd-10) | 20 mg/m$^2$ |

-continued

| | |
|---|---|
| Compound (Cpd-11) | 20 mg/m$^2$ |
| Antiseptic (Proxcel, ICI Co., Ltd.) | 1 mg/m$^2$ |
| **Coating solution for back layer** | |
| Gelatin | 3.3 g/m$^2$ |
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-Divinylsulfonyl-2-propanol | 60 mg/m$^2$ |
| Polymethyl methacrylate microparticles (mean particle sizes: 6.5 $\mu$m) | 30 mg/m$^2$ |
| Liquid paraffin | 78 mg/m$^2$ |
| Compound (Cpd-7) | 120 mg/m$^2$ |
| Compound (Cpd-20) | 5 mg/m$^2$ |
| Calcium nitrate | 20 mg/m$^2$ |
| Antiseptic (Proxcel, ICI Co., Ltd.) | 12 mg/m$^2$ |
| **Coating solution for electroconductive layer** | |
| Gelatin | 0.1 g/m$^2$ |
| Sodium dodecylbenzenesulfonate | 20 mg/m$^2$ |
| $SnO_2$/Sb (weight ratio = 9:1, average particle size: 0.25 $\mu$m) | 200 mg/m$^2$ |
| Antiseptic (Proxcel, ICI Co., Ltd.) | 0.3 mg/m$^2$ |

Viscosity of the coating solutions for the layers was adjusted by adding Thickener Z.

<<Method for Coating on Support>>

First, on the aforementioned support coated with the undercoat layers, for the emulsion layer side, four layers of UL layer, emulsion layer, lower protective layer and upper protective layer were simultaneously coated as stacked layers in this order from the support at 35° C. by the slide bead coating method while adding a hardening agent solution and passed through a cold wind setting zone (5° C.). Then, on the side opposite to the emulsion layer side, an electroconductive layer and a back layer were simultaneously coated as stacked layers in this order from the support by the curtain coating method while adding a hardening agent solution, and passed through a cold wind setting zone (5° C.). After the coated support was passed through each setting zone, the coating solutions showed sufficient setting. Subsequently, the support coated with the layers was dried for the both surfaces in a drying zone of the drying conditions mentioned below. The coated support was transported without any contact with rollers and the other members after the coating of the back surface until it was rolled up. The coating speed was 200 m/min.

<<Drying Conditions>>

After the setting, the coated layers were dried with a drying wind at 30° C. until the water/gelatin weight ratio became 800%, and then with a drying wind at 35° C. and relative humidity of 30% for the period where the ratio became 200% from 800%. The coated layers were further blown with the same wind, and 30 second after the point where the surface temperature became 34° C. (regarded as completion of drying), the layers were dried with air at 48° C. and relative humidity of 2% for 1 minute. In this operation, the drying time was 50 seconds from the start to the water/gelatin ratio of 800%, 35 seconds from 800% to 200% of the ratio, and 5 seconds from 200% of the ratio to the end of the drying.

This silver halide photographic light-sensitive material was rolled up at 25° C. and relative humidity of 55%, subjected to a heat treatment at 35° C. and relative humidity of 30% for 72 hours, then cut at 25° C. and relative humidity of 55%, conditioned for moisture content at 25° C. and relative humidity of 50% for 8 hours and then sealed in a barrier bag conditioned for moisture content for 6 hours together with a cardboard conditioned for moisture content at 25° C. and relative humidity of 50% for 2 hours to prepare each of the samples.

Humidity in the barrier bag was measured and found to be 45%. The obtained samples had a film surface pH of 5.5–5.8 for the emulsion layer side and 6.0–6.5 for the back side.

<<Developer>>

The developer and the fixer used for development of the samples are as follows.

| Developer (A) [composition per liter of concentrated solution] | |
|---|---|
| Potassium hydroxide | 60.0 g |
| Diethylenetriaminepentaacetic acid | 3.0 g |
| Potassium carbonate | 90.0 g |
| Sodium metabisulfite | 105.0 g |
| Potassium bromide | 10.5 g |
| Hydroquinone | 60.0 g |
| 5-Methylbenzotriazole | 0.53 g |
| 4-Hydroxymethyl-4-methyl-1-phenyl-3-pyrazolidone | 2.3 g |
| Sodium 3-(5-mercaptotetrazol-1-yl)-benzenesulfonate | 0.15 g |
| Sodium 2-mercaptobenzimidazole-5-sulfonate | 0.45 g |
| Sodium erysorbate | 9.0 g |
| Diethylene glycol | 7.5 g |
| pH 10.79 | |

Upon use, a mother solution was prepared by diluting 2 parts of the above concentrated solution with 1 part of water. The mother solution showed pH of 10.65. A replenisher was prepared by diluting 4 parts of the above concentrated solution with 3 parts of water. The replenisher showed pH of 10.62. A compound of the formula (3) shown in Table 4 was added to obtain a test solution.

| Fixer (B) [composition per liter of concentrated solution] | |
|---|---|
| Ammonium thiosulfate | 360 g |
| Disodium ethylenediaminetetraacetate dihydrate | 0.09 g |
| Sodium thiosulfate pentahydrate | 33.0 g |
| Sodium metasulfite | 57.0 g |
| Sodium hydroxide | 37.2 g |
| Acetic acid (100%) | 90.0 g |
| Tartaric acid | 8.7 g |
| Sodium gluconate | 5.1 g |
| Aluminum sulfate | 25.2 g |
| pH 4.85 | |

Upon use, 1 part of the above concentrated solution was diluted with 2 parts of water. pH of the solution used was 4.8.

<<Evaluation>>

(Photographic Property)

Photographic property was evaluated as follows. As for exposure, each sample was exposed with xenon flash light for an emission time of $10^{-5}$ second through an interference filter having a peak at 633 nm and a step wedge. As an index representing contrast of images (gradation), gamma value was obtained as follows. A point corresponding to fog+density of 0.1 and a point corresponding to fog+density of 3.0 on the characteristic curve were connected with a straight line, and the inclination of this straight line was used as the gamma value. That is, gamma (gradation) is given by an equation: gamma (gradation)=(3.0–0.1)/(log(Exposure giving density of 3.0)−log(Exposure giving density of 0.1)), and a larger gamma value indicates photographic characteristic of higher contrast. For light-sensitive materials used in graphic arts, the gamma value is preferably 10 or more, more preferably 15 or more.

(Practice Density)

On the light-sensitive materials prepared in this example, test steps were outputted by using an image setter RC5600V produced by Fuji Photo Film Co., Ltd. at 175 lines/inch with changing the light quantity and developed by using AP-560 produced by Fuji Photo Film Co., Ltd. as an automatic developing machine and the mother liquor of the developer mentioned above with the conditions of development temperature at 35° C. and development time for 30 seconds. Density of a Dmax portion obtained by exposure at an LV value giving 50% of medium half tone dots was measured as practice density. The half tone % and the practice density were measured by using a densitometer (Macbeth TD904).

(Running Property)

The light-sensitive material subjected to exposure giving 50% of medium half tone dots using in the evaluation of practice density was processed in an amount of 5 $m^2$ per day with a replenishing amount of the developer shown in Table 4 and a replenishing amount of the fixer of 323 mL/$m^2$, and this running was continued for one month. Then, practice Dm and 50% medium half tone dots were evaluated. Considering the subsequent process, the practice density should be 4.0 or more, preferably 4.0–5.0. The change in half tone % is preferably 3% or less, more preferably 2% or less.

(Silver Sludge)

After the above running, sludge in the development tank, development rack and developer in the automatic developing machine was evaluated as sensory evaluation with five grades. The grades 1 and 2 indicate practically unusable levels (practically unusable level means a level that requires washing within 1 week of usual operation), 3 means the lowest level for practical use, 4 means a level showing no substantial problem for practical use, and 5 means a level showing no sludge. The experimental results are shown in Table 4.

TABLE 4

| | Hydrazine | | | Photographic property | | | | |
|---|---|---|---|---|---|---|---|---|
| | | | | | Practice dendity and change in half tone % | | | |
| Test No. | compound in light-sensitive material | Compound of formula (3) in developer | Replenishing amount (ml/$m^2$) | Fresh developer γ value | Fresh developer | Developer after running | Silver staining | Note |
| 1 | — | — | 387 | 6 | Density 3.4 Half tone % 50 | Density 3.2 Half tone % 51 | 2 | Comparative |
| 2 | — | 22 | 323 | 5 | Density 3.4 Half tone % 50 | Density 3.3 Half tone % 52 | 4 | Comparative |
| 3 | Comparative I | 22 | 323 | 18 | Density 4.8 Half tone % 50 | Density 4.7 Half tone % 58 | 4 | Comparative |

TABLE 4-continued

| Test No. | Hydrazine compound in light-sensitive material | Compound of formula (3) in developer | Replenishing amount (ml/m$^2$) | Photographic property: Fresh developer γ value | Practice dendity and change in half tone %: Fresh developer | Developer after running | Silver staining | Note |
|---|---|---|---|---|---|---|---|---|
| 4 | Comparative I | 32 | 323 | 21 | Density 5.2 Half tone % 50 | Density 5.0 Half tone % 57 | 4 | Comparative |
| 5 | A-17 | 22 | 323 | 22 | Density 5.1 Half tone % 50 | Density 5.0 Half tone % 52 | 5 | Invention |
| 6 | A-17 | 22 | 162 | 22 | Density 5.1 Half tone % 50 | Density 4.8 Half tone % 52 | 5 | Invention |
| 7 | A-17 | 32 | 162 | 21 | Density 4.9 Half tone % 50 | Density 4.7 Half tone % 53 | 5 | Invention |
| 8 | A-17 | 25 | 162 | 22 | Density 5.0 Half tone % 50 | Density 4.7 Half torte % 52 | 4 | Invention |
| 9 | A-85 | 22 | 162 | 24 | Density 5.2 Half tone % 50 | Density 5.1 Half tone % 51 | 5 | Invention |
| 10 | A-85 | 25 | 162 | 23 | Density 5.1 Half tone % 50 | Density 5.0 Half tone % 51 | 4 | Invention |
| 11 | A-85 | 32 | 162 | 21 | Density 5.0 Half tone % 50 | Density 4.8 Half tone % 52 | 4 | Invention |
| 12 | A-85 | 25 | 162 | 22 | Density 5.1 Half tone % 50 | Density 5.0 Half tone % 52 | 5 | Invention |
| 13 | A-88 | 22 | 225 | 20 | Density 4.9 Half tone % 50 | Density 4.7 Half tone % 53 | 5 | Invention |
| 14 | A-93 | 32 | 162 | 19 | Density 4.9 Half tone % 50 | Density 4.6 Half tone % 52 | 4 | Invention |
| 15 | A-110 | 25 | 162 | 19 | Density 5.0 Half tone % 50 | Density 4.7 Half tone % 52 | 4 | Invention |

Comparative hydrazine compound 1

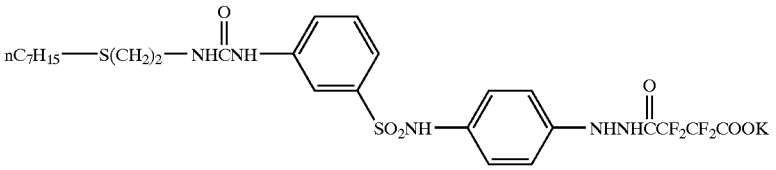

From the result shown in Table 4, it was found that the light-sensitive materials and development method of the present invention showed favorable results for change in photographic property and silver staining after the running even with small replenishing amounts.

In the experiment, AC-1000 produced by Fuji Photo Film Co., Ltd. as a water-saving and scale-preventing apparatus and AB-5 produced by Fuji Photo Film Co., Ltd. as a scale-preventing agent were used in combination. The replenishing amount was 1 L per one sheet of the Daizen size (61.0×50.8 cm).

EXAMPLE 13

The same experiment as that of Example 12 was performed by using Solid developer (C) mentioned below and Solid Fixer (D) mentioned below as a replenisher. As a result, the samples having the characteristics of the present invention showed good performances as in Example 12.

| Composition of Solid developer (C) | |
|---|---|
| Sodium hydroxide (beads, 99.5%) | 11.5 g |
| Potassium sulfite (bulk powder) | 63.0 g |
| Sodium sulfite (bulk powder) | 46.0 g |
| Potassium carbonate | 62.0 g |
| Hydroquinone (briquettes) | 40.0 g |

Together with the following components, briquettes were prepared.

| | |
|---|---|
| Diethylenetriaminepentaacetatic acid | 2.0 g |
| 5-Methylbenzotriazole | 0.35 g |
| 4-Hydroxymethyl-4-methyl-1-phenyl-3-pyrazolidone | 1.5 g |
| Sodium 3-(5-mercaptotetrazol-1-yl)-benzenesulfonate | 0.1 g |
| Sodium erysorbate | 6.0 g |
| Potassium bromide | 6.6 g |
| Water | Amount giving total volume of 1 L |
| pH | 10.65 |

As for forms of the raw materials, bulk powder means an industrial product itself, and as the beads of alkali metal salt, a marketed product was used.

As for the raw material in the form of briquette, it was made into a plate by compression with pressure using a briquetting machine and the plate was crushed and used The components used in small amounts were blended before the production of briquettes.

The above processing agents in amounts for 10 L were filled in foldable high density polyethylene containers, and takeout ports were sealed with aluminum seals. For dissolution and replenishment, a dissolution and replenishment apparatus provided with an automatic opening mechanism was used, which is disclosed in JP-A-80718 and JP-A-9-138495.

Composition of Solid Fixer (D)

| | |
|---|---|
| Agent A (solid) | |
| Ammonium thiosulfate (compact) | 125.0 g |
| Anhydrous sodium thiosulfate (bulk powder) | 19.0 g |
| Sodium metabisulfite (bulk powder) | 18.0 g |
| Anhydrous sodium acetate (bulk powder) | 42.0 g |
| Agent B (liquid) | |
| Disodium ethylenediaminetetraacetate dihydrate | 0.03 g |
| Tartaric acid | 2.9 g |
| Sodium gluconate | 1.7 g |
| Aluminum sulfate | 8.4 g |
| Sulfuric acid | 2.1 g |

These were dissolved in water to a volume of 50 mL.

Agent A and Agent B were dissolved in water to a volume of 1 L and used as Fixer (D).

pH was 4.8.

As the ammonium thiosulfate (compact), flakes produced by the spray drying method were compressed with pressure using a roller compacter, crushed into chips of irregular forms having a size of about 4–6 mm, blended with the anhydrous sodium thiosulfate and used. As for the other bulk powders, usual industrial products were used.

Agents A and B in amounts for 10 L were filled in foldable high density polyethylene containers, and takeout port of the container for Agent A was sealed with aluminum seal. Takeout port of the container for Agent B was stopped with a screw cap. For dissolution and replenishment, a dissolution and replenishment apparatus provided with an automatic opening mechanism was used, which is disclosed in JP-A-80718 and JP-A-9-138495.

EXAMPLE 14

The same experiment as that of Example 12 was performed by using the light-sensitive materials prepared in Example 12 and Developer (E) mentioned below.

Composition of Developer (E)

| | |
|---|---|
| Water | 600 mL |
| Potassium hydroxide | 29.0 g |
| Diethylenetriaminepentaacetic acid | 2.0 g |
| Potassium carbonate | 40.0 g |
| Sodium metabisulfite | 40.0 g |
| Potassium bromide | 3.0 g |
| Hydroquinone | 23.0 g |
| 4-Hydroxymethyl-4-methyl-1-phenyl-3-pyrazolidone | 0.4 g |
| Sodium erysorbate | 3.0 g |
| 5-Methylbenzotriazole | 0.04 g |
| Diethylene glycol | 20.0 g |

The components were added with water to a volume of 1 L and adjusted to pH 10.45. This solution was used as a base and added with each of the compounds of the formula (4) mentioned in Table 5 to obtain a test solution.

The experimental results are shown in Table 5.

TABLE 5

| | Hydrazine | | | Photographic property | | | | |
|---|---|---|---|---|---|---|---|---|
| | | | | | Practice dendity and change in half tone % | | | |
| Test No. | compound in light-sensitive material | Compound of formula (4) in developer | Replenishing amount (ml/m$^2$) | Fresh developer γ value | Fresh developer | Developer after running | Silver staining | Note |
| 1 | — | — | 387 | 5 | Density 3.2 Half tone % 50 | Density 3.0 Half tone % 52 | 2 | Comparative |
| 2 | — | 39 | 323 | 5 | Density 3.2 Half tone % 50 | Density 3.1 Half tone % 52 | 4 | Comparative |
| 3 | Comparative I | 39 | 323 | 17 | Density 4.5 Half tone % 50 | Density 4.5 Half tone % 59 | 4 | Comparative |
| 4 | Comparative I | 33 | 323 | 17 | Density 4.4 Half tone % 50 | Density 4.3 Half tone % 57 | 4 | Comparative |
| 5 | A-17 | 39 | 323 | 18 | Density 4.8 Half tone % 50 | Density 4.5 Half tone % 52 | 4 | Invention |
| 6 | A-17 | 39 | 162 | 18 | Density 4.6 Half tone % 50 | Density 4.2 Half tone % 52 | 3 | Invention |
| 7 | A-17 | 1 | 323 | 16 | Density 4.5 Half tone % 50 | Density 4.4 Half tone % 53 | 4 | Invention |
| 8 | A-17 | 5 | 323 | 15 | Density 4.6 Half tone % 50 | Density 4.3 Half torte % 51 | 4 | Invention |
| 9 | A-85 | 39 | 162 | 18 | Density 4.7 Half tone % 50 | Density 4.3 Half tone % 53 | 3 | Invention |
| 10 | A-85 | 5 | 323 | 17 | Density 4.7 Half tone % 50 | Density 4.6 Half tone % 52 | 4 | Invention |
| 11 | A-85 | 33 | 323 | 15 | Density 4.6 Half tone % 50 | Density 4.4 Half tone % 52 | 4 | Invention |
| 12 | A-85 | 1 | 323 | 15 | Density 4.5 Half tone % 50 | Density 4.4 Half tone % 52 | 4 | Invention |
| 13 | A-86 | 39 | 225 | 16 | Density 4.6 Half tone % 50 | Density 4.4 Half tone % 53 | 4 | Invention |

TABLE 5-continued

| Test No. | Hydrazine compound in light-sensitive material | Compound of formula (4) in developer | Replenishing amount (ml/m$^2$) | Photographic property: Fresh developer γ value | Practice dendity and change in half tone %: Fresh developer | Developer after running | Silver staining | Note |
|---|---|---|---|---|---|---|---|---|
| 14 | A-93 | 33 | 323 | 16 | Density 4.7<br>Half tone % 50 | Density 4.5<br>Half tone % 52 | 4 | Invention |
| 15 | A-110 | 1 | 162 | 16 | Density 4.6<br>Half tone % 50 | Density 4.1<br>Half tone % 53 | 3 | Invention |

Comparative hydrazine compound 1

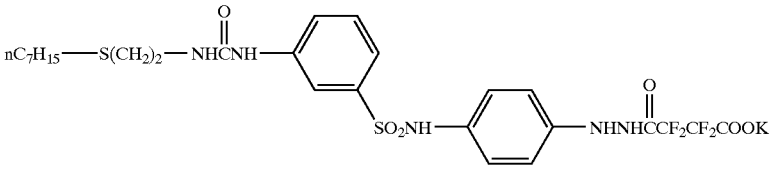

From the results shown in Table 5, it was found that the light-sensitive materials and development method of the present invention showed favorable results for photographic property and resistance to silver staining after the running even with small replenishing amounts.

EXAMPLE 15

The same experiments as those of Example 14 were performed by using a solid developer and solid fixer having the same compositions as those used in Example 14 except that the developer did not contain diethylene glycol. The components were densely filled in a polyethylene container as stacked layers in the following order.

Developer

| | |
|---|---|
| First layer | Hydroquinone |
| Second layer | Other components |
| Third layer | KBr |
| Fourth layer | $Na_2S_2O_5$ |
| Fifth layer | Potassium carbonate |
| Sixth layer | KOH pellets |

These components were dissolved to a volume of 3 L and used.

The fixer used included the following components filled in the same manner as the developer.

Fixer

| | | |
|---|---|---|
| First layer | $(NH_4)_2S_2O_3/Na_2S_2O_3$/SS | 160.0 g |
| Second layer | $Na_2S_2O_5$ | 15.0 g |
| Third layer | Anhydrous sodium acetate | 32.7 g |
| Fourth layer | Ethylenediaminetetraacetic acid | 0.03 g |
| | Succinic acid | 3.3 g |
| | Tartaric acid | 3.0 g |
| | Sodium gluconate | 1.8 g |
| Fifth layer | Ammonium alum | 23.0 g |
| pH of 1 L of used solution | | 4.80 |

EXAMPLE 16

When the processing procedures of Examples 12 to 15 were performed at a development temperature of 38° C., fixing temperature of 37° C. and with development time of 20 seconds, results similar to those obtained in Examples 12 to 14 were obtained, and thus the effect of the present invention was not degraded.

EXAMPLE 17

Even when the processing procedures of Examples 12 to 16 were performed with a transportation speed of silver halide photographic light-sensitive materials of 1500 mm/minute as a line speed by using an automatic developing machine, FG-680AS (Fuji Photo Film Co., Ltd ), the samples having the characteristics of the present invention gave similar results.

EXAMPLE 18

The same experiment as that of Example 14 was performed by using the light-sensitive materials prepared in Example 12 and Developer (F) mentioned below. As a result, results similar to those obtained in Example 14 were obtained.

Composition of Developer (F)

| | |
|---|---|
| Water | 600 mL |
| Potassium hydroxide | 20.0 g |
| Diethylenetriaminepentaacetic acid | 2.0 g |
| Potassium carbonate | 40.0 g |
| Sodium metabisulfite | 40.0 g |
| Potassium bromide | 3.0 g |
| 4-Hydroxymethyl-4-methyl-1-phenyl-3-pyrazolidone | 0.4 g |
| Sodium erysorbate | 45.0 g |
| 5-Methylbenzotriazole | 0.04 g |

The components were added with water to a volume of 1 L and adjusted to pH 9.9 for mother liquor and 10.2 for replenisher.

EXAMPLE 19

When the same evaluations as those of Examples 12 to 18 were performed by using, instead of Lux Setter RC-5600V produced by Fuji Photo Film Co., Ltd, any one of Image setter FT-R5055 produced by Dainippon Screen Mfg. Co., Ltd., Select Set 5000, Avantra 25 and Acuset 1000 produced by Agfa Gevaert AG, Dolev 450 and Dolev 800 produced by Scitex, Lino 630, Quasar, Herkules ELITE and Signasetter produced by Heidelberg Co. Ltd., Luxel F-9000, and Panther Pro 62 produced by PrePRESS Inc., similar effect was obtained with the samples according to the present invention.

As clearly seen from the results of Examples 12 to 19, according to the present invention, when a silver halide photographic light-sensitive material providing a high contrast image is processed in an automatic developing machine, change in photographic property due to running can be suppressed to be small, and generation of silver staining can also be suppressed, even with a small replenishing amount of developer.

The present disclosure relates to the subject matter contained in Japanese Patent Application No. 081631/2002 filed on Mar. 22, 2002 and Japanese Patent Application No. 081632/2002 filed on Mar. 22, 2002. These applications are expressly incorporated herein by reference in its entirety. It should be noted that the subject matters set forth in the following items are disclosed in the specification.

1. A silver halide photographic light-sensitive material comprising at least one silver halide emulsion layer on a support, wherein the silver halide emulsion layer contains silver halide containing a metal complex having a cyanide ligand, and the silver halide photographic light-sensitive material contains a hydrazine compound having an onium group in the molecule.

2. The silver halide photographic light-sensitive material according to item 1, wherein the hydrazine compound having an onium group in the molecule is represented by the formula (1) or (2) above.

3. The silver halide photographic light-sensitive material according to item 2, wherein the hydrazine compound having an onium group in the molecule is represented by the formula (1).

4. The silver halide photographic light-sensitive material according to item 3, wherein, in the formula (1), the atom in J directly bonding to $R^2$ is not a nitrogen atom.

5. The silver halide photographic light-sensitive material according to item 3, wherein, in the formula (1), the group represented by $G^1$ is —CO—, and the group represented by $R^2$ is an alkyl group that does not contain an onium group or a carbamoyl group that does not contain an onium group.

6. The silver halide photographic light-sensitive material according to item 3, wherein, in the formula (1), the group represented by $—G^1—R^2$ is $—COCF_2H$ or $—COCF_2CF_2COOM$ (M represents a hydrogen atom or a counter cation).

7. The silver halide photographic light-sensitive material according to item 3, wherein, in the formula (1), the bridging group represented by $R^1$ is an unsubstituted phenylene group.

8. The silver halide photographic light-sensitive material according to item 3, wherein the compound represented by the formula (1) is represented by the formula (1-a) above.

9. The silver halide photographic light-sensitive material according to item 3, wherein the compound represented by the formula (1) is represented by the formula (1-b) above.

10. The silver halide photographic light-sensitive material according to item 2, wherein the hydrazine compound having an onium group in the molecule is represented by the formula (2).

11. The silver halide photographic light-sensitive material according to item 1, which comprises a nucleation accelerator.

12. The silver halide photographic light-sensitive material according to item 1, wherein silver halide has a structure comprising a core and a surface layer, and the core contains 99 mol % or less of silver in the silver halide crystals and the metal complex containing one or more cyanide complex.

13. The silver halide photographic light-sensitive material according to item 1, wherein silver halide has a structure comprising a core and a surface layer, and the core contains 95 mol % or less of silver in the silver halide crystals and the metal complex containing one or more cyanide complex.

14. The silver halide photographic light-sensitive material according to item 1, wherein silver halide emulsion contains a metal complex having one or more cyanide ligands in an amount of $1\times10^{-6}$ mol to $5\times10^{-3}$ mol per mol of silver in the silver halide.

15. The silver halide photographic light-sensitive material according to item 1, wherein a ratio of sliver bromide relative to silver halide contained in the silver halide emulsion in the silver halide emulsion layer is 45–75 mol %.

16. A silver halide photographic light-sensitive material comprising at least one silver halide emulsion layer on a support, wherein the silver halide emulsion layer contains silver halide containing a Group VIII metal compound, and the silver halide photographic light-sensitive material contains a hydrazine compound having an onium group in the molecule represented by the formula (1) above.

17. The silver halide photographic light-sensitive material according to item 16, wherein, in the formula (1), the atom in J directly bonding to $R^1$ is not a nitrogen atom.

18. The silver halide photographic light-sensitive material according to item 16, wherein, in the formula (1), the bridging group represented by $R^1$ is an unsubstituted phenylene group.

19. The silver halide photographic light-sensitive material according to item 16, wherein the compound represented by the formula (1) is represented by the formula (1-a) above.

20. The silver halide photographic light-sensitive material according to item 16, wherein the compound represented by the formula (1) is represented by the formula (1-b) above.

21. The silver halide photographic light-sensitive material according to item 16, which comprises a nucleation accelerator.

22. The silver halide photographic light-sensitive material according to item 16, wherein the Group VIII metal compound is a rhodium compound, iridium compound, rhenium compound, ruthenium compound or osmium compound.

23. The silver halide photographic light-sensitive material according to item 16, wherein a ratio of sliver bromide relative to silver halide contained in the silver halide emulsion in the silver halide emulsion layer is 45–75 mol %.

24. A monochromatic silver halide photographic light-sensitive material which is developed with a developer having a pH of 9.0–11.0 and a replenishing amount of 330 $mL/m^2$ or less for the developer, wherein the monochromatic silver halide photographic light-sensitive material has one or more hydrophilic colloid layers on a support, at least one of the hydrophilic colloid layers is a silver halide emulsion layer, and the monochromatic silver halide photographic light-sensitive material contains at least one kind of a hydrazine compound having an onium group in the molecule.

25. The silver halide photographic light-sensitive material according to item 24, wherein the hydrazine compound having an onium group in the molecule is represented by the formula (1) or (2) above.

26. The silver halide photographic light-sensitive material according to item 25, wherein the hydrazine compound having an onium group in the molecule is represented by the formula (1).

27. The silver halide photographic light-sensitive material according to item 26, wherein, in the formula (1) the atom in J directly bonding to $R^1$ is not a nitrogen atom.

28. The silver halide photographic light-sensitive material according to item 26, wherein, in the formula (1), the group represented by $G^1$ is —CO—, and the group represented by $R^2$ is an alkyl group that does not contain an onium group or a carbamoyl group that does not contain an onium group.

29. The silver halide photographic light-sensitive material according to item 26, wherein, in the formula (1), the group represented by $—G^1—R^2$ is $—COCF_2H$ or $—COCF_2CF_2COOM$ (M represents a hydrogen atom or a counter cation).

30. The silver halide photographic light-sensitive material according to item 26, wherein, in the formula (1), the bridging group represented by $R^1$ is an unsubstituted phenylene group.

31. The silver halide photographic light-sensitive material according to item 26, wherein the compound represented by the formula (1) is represented by the formula (1-a) above.

32. The silver halide photographic light-sensitive material according to item 26, wherein the compound represented by the formula (1) is represented by the formula (1-b) above.

33. The silver halide photographic light-sensitive material according to item 25, wherein the hydrazine compound having an onium group in the molecule is represented by the formula (2).

34. The silver halide photographic light-sensitive material according to item 24, which comprises a nucleation accelerator.

35. A monochromatic silver halide photographic light-sensitive material which is developed with a developer having a pH of 9.0–11.0, wherein the monochromatic silver halide photographic light-sensitive material has one or more hydrophilic colloid layers on a support, at least one of the hydrophilic colloid layers is a silver halide emulsion layer, and the monochromatic silver halide photographic light-sensitive material contains at least one kind of a hydrazine compound having an onium group in the molecule represented by the formula (1) above.

36. The silver halide photographic light-sensitive material according to item 35, wherein replenishing amount of the developer is 330 $mL/m^2$ or less.

37. The silver halide photographic light-sensitive material according to item 35, wherein, in the formula (1), the atom in J directly bonding to $R^1$ is not a nitrogen atom.

38. The silver halide photographic light-sensitive material according to item 35, wherein, in the formula (1), the bridging group represented by $R^1$ is an unsubstituted phenylene group.

39. The silver halide photographic light-sensitive material according to item 35, wherein the compound represented by the formula (1) is represented by the formula (1-a) above.

40. The silver halide photographic light-sensitive material according to item 35, wherein the compound represented by the formula (1) is represented by the formula (1-b) above.

41. The silver halide photographic light-sensitive material according to item 35, which comprises a nucleation accelerator.

42. A method for development of a silver halide photographic light-sensitive material, which comprises developing the silver halide photographic light-sensitive material according to item 1 with a developer having a pH of 9.0–11.0.

43. The development method according to item 42, wherein replenishing amount of the developer is 330 $mL/m^2$ or less.

44. The development method according to item 42, wherein the developer contains a dihydroxybenzene type developing agent and a compound represented by the formula (a) above.

45. The development method according to item 44, wherein the developer contains the compound represented by the formula (a) as a developing agent.

46. The development method according to item 42, wherein the development is carried out in the presence of the developer and at least one kind of compound represented by the formula (3) or (4) above.

47. The development method according to item 42, wherein the development is carried out in the presence of a benzotriazole type compound.

48. The development method according to item 42, wherein the developer contains a diethylenetriamine compound.

49. The development method according to item 42, wherein replenishing amount of fixer is 390 $mL/m^2$ or less.

50. The development method according to item 42, wherein the developer is in the form of a solid processing chemical.

51. The development method according to item 42, wherein the development is carried out in an automatic developing machine, and hydrogen peroxide or at least one kind of bactericide is contained in a stabilization tank or tank for washing with water of the automatic developing machine.

52. The development method according to item 42, wherein processing time for the developer and the fixer is 30 seconds Or less.

53. A method for development of a silver halide photographic light-sensitive material, which comprises developing the silver halide photographic light-sensitive material according to item 16 with a developer having a pH of 9.0–11.0.

54. The development method according to item 53, wherein replenishing amount of the developer is 330 $mL/m^2$ or less.

55. The development method according to item 53, wherein the developer contains a dihydroxybenzene type developing agent and a compound represented by the formula (a) above.

56. The development method according to item 55, wherein the developer contains the compound represented by the formula (a) as a developing agent.

57. The development method according to item 53, wherein the development is carried out in the presence of the developer and at least one kind of compound represented by the formula (3) or (4) above.

58. The development method according to item 53, wherein the development is carried out in the presence of a benzotriazole type compound.

59. The development method according to item 53, wherein the developer contains a diethylenetriamine compound.

60. The development method according to item 53, wherein replenishing amount of fixer is 390 $mL/m^2$ or less.

61. The development method according to item 53, wherein the developer is in the form of a solid processing chemical.

62. The development method according to item 53, wherein the development is carried out in an automatic developing machine, and hydrogen peroxide or at least one kind of bactericide is contained in a stabilization tank or tank for washing with water of the automatic developing machine.

63. The development method according to item 53, wherein processing time for the developer and the fixer is 30 seconds or less.

64. A method for development of a silver halide photographic light-sensitive material, which comprises developing the monochromatic silver halide photographic light-sensitive material according to item 24 with a developer having a pH of 9.0–11.0 using a replenishing amount of 330 $mL/m^2$ or less for the developer.

65. The development method according to item 64, wherein the developer contains a dihydroxybenzene type developing agent and a compound represented by the formula (a) above.

66. The development method according to item 65, wherein the developer contains the compound represented by the formula (a) as a developing agent.

67. The development method according to item 64, wherein the development is carried out in the presence of the developer and at least one kind of compound represented by the formula (3) or (4) above.

68. The development method according to item 64, wherein the development is carried out in the presence of a benzotriazole type compound.

69. The development method according to item 64, wherein the developer contains a diethylenetriamine compound.

70. The development method according to item 64, wherein replenishing amount of fixer is 390 $mL/m^2$ or less.

71. The development method according to item 64, wherein the developer is in the form of a solid processing chemical.

72. The development method according to item 64, wherein the development is carried out in an automatic developing machine, and hydrogen peroxide or at least one kind of bactericide is contained in a stabilization tank or tank for washing with water of the automatic developing machine.

73. The development method according to item 64, wherein processing time for the developer and the fixer is 30 seconds or less.

74. A method for development of a silver halide photographic light-sensitive material, which comprises developing the monochromatic silver halide photographic light-sensitive material according to item 35 with a developer having a pH of 9.0–11.0.

75. The development method according to item 74, wherein replenishing amount of the developer is 330 $mL/m^2$ or less.

76. The development method according to item 74, wherein the developer contains a dihydroxybenzene type developing agent and a compound represented by the formula (a) above.

77. The development method according to item 76, wherein the developer contains the compound represented by the formula (a) as a developing agent.

78. The development method according to item 74, wherein the development is carried out in the presence of the developer and at least one kind of compound represented by the formula (3) or (4) above.

79. The development method according to item 74, wherein the development is carried out in the presence of a benzotriazole type compound.

80. The development method according to item 74, wherein the developer contains a diethylenetriamine compound.

81. The development method according to item 74, wherein replenishing amount of fixer is 390 $mL/m^2$ or less.

82. The development method according to item 74, wherein the developer is in the form of a solid processing chemical.

83. The development method according to item 74, wherein the development is carried out in an automatic developing machine, and hydrogen peroxide or at least one kind of bactericide is contained in a stabilization tank or tank for washing with water of the automatic developing machine.

84. The development method according to item 74, wherein processing time for the developer and the fixer is 30 seconds or less.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A silver halide photographic light-sensitive material comprising at least one silver halide emulsion layer on a support, wherein the silver halide emulsion layer contains silver halide containing a metal complex having a cyanide ligand, and the silver halide photographic light-sensitive material contains a hydrazine compound having an onium group in the molecule represented by the following formula:

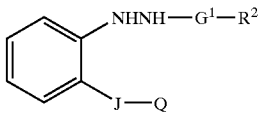

wherein $—G^1—R^2$ represents $—COCF_2H$ or $—COCF_2CF_2COOM$ (M represents a hydrogen atom or a counter cation), J represents an alkylene group, and Q represents a pyridinium group or a quinolinium group.

2. The silver halide photographic light-sensitive material according to claim 1, wherein the atom in J directly bonding to phenyl is not a nitrogen atom.

3. The silver halide photographic light-sensitive material according to claim 1, wherein the group represented by $G^1$ is —CO—, and the group represented by $R^2$ is an alkyl group that does not contain an onium group or a carbamoyl group that does not contain an onium group.

4. The silver halide photographic light-sensitive material according to claim 1, wherein silver halide has a structure comprising a core and a surface layer, and the core contains 99 mol % or less of silver in the silver halide crystals and the metal complex containing one or more cyanide complex.

5. The silver halide photographic light-sensitive material according to claim 1, wherein silver halide emulsion contains a metal complex having one or more cyanide ligands in an amount of $1\times10^{-6}$ mol to $5\times10^{-3}$ mol per mol of silver in the silver halide.

6. The silver halide photographic light-sensitive material according to claim 1, wherein a ratio of sliver bromide relative to silver halide contained in the silver halide emulsion in the silver halide emulsion layer is 45–75 mol %.

7. A silver halide photographic light-sensitive material comprising at least one silver halide emulsion layer on a support, wherein the silver halide emulsion layer contains silver halide containing a Group VIII metal compound, and the silver halide photographic light-sensitive material contains a hydrazine compound having an onium group in the molecule represented by the following formula:

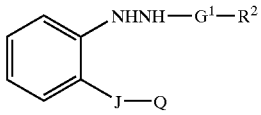

wherein $—G^1—R^2$ represents $—COCF_2H$ or $—COCF_2CF_2COOM$ (M represents a hydrogen atom or a counter cation), J represents an alkylene group, and Q represents a pyridinium group or a quinolinium group.

8. The silver halide photographic light-sensitive material according to claim 7, wherein the atom in J directly bonding to phenyl is not a nitrogen atom.

9. The silver halide photographic light-sensitive material according to claim 7, wherein the Group VIII metal compound is a rhodium compound, iridium compound, rhenium compound, ruthenium compound or osmium compound.

10. The silver halide photographic light-sensitive material according to claim 7, wherein a ratio of sliver bromide relative to silver halide contained in the silver halide emulsion in the silver halide emulsion layer is 45–75 mol %.

11. A monochromatic silver halide photographic light-sensitive material which is developed with a developer having a pH of 9.0–11.0 and a replenishing amount of 330 $mL/m^2$ or less for the developer, wherein the monochromatic silver halide photographic light-sensitive material has one or more hydrophilic colloid layers on a support, at least one of the hydrophilic colloid layers is a silver halide emulsion layer, and the monochromatic silver halide photographic light-sensitive material contains at least one kind of a hydrazine compound having an onium group in the molecule represented by the following formula:

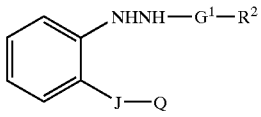

wherein $—G^1—R^2$ represents $—COCF_2H$ or $—COCF_2CF_2COOM$ (M represents a hydrogen atom or a counter cation), J represents an alkylene group, and Q represents a pyridinium group or a quinolinium group.

12. A monochromatic silver halide photographic light-sensitive material which is developed with a developer having a pH of 9.0–11.0, wherein the monochromatic silver halide photographic light-sensitive material has one or more hydrophilic colloid layers on a support, at least one of the hydrophilic colloid layers is a silver halide emulsion layer, and the monochromatic silver halide photographic light-sensitive material contains at least one kind of a hydrazine compound having an onium group in the molecule represented by the following formula:

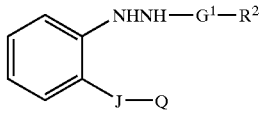

wherein $—G^1—R^2$ represents $—COCF_2H$ or $—COCF_2CF_2COOM$ (M represents a hydrogen atom or a counter cation), J represents an alkylene group, and Q represents a pyridinium group or a quinolinium group.

13. The silver halide photographic light-sensitive material according to claim 12, wherein replenishing amount of the developer is 330 $mL/m^2$ or less.

14. A method for development of a silver halide photographic light-sensitive material, which comprises developing the silver halide photographic light-sensitive material according to claim 1 with a developer having a pH of 9.0–11.0.

15. The development method according to claim 14, wherein replenishing amount of the developer is 330 $mL/m^2$ or less.

16. A method for development of a silver halide photographic light-sensitive material, which comprises developing the silver halide photographic light-sensitive material according to claim 7 with a developer having a pH of 9.0–11.0.

17. The development method according to claim 16, wherein replenishing amount of the developer is 330 $mL/m^2$ or less.

18. A method for development of a silver halide photographic light-sensitive material, which comprises developing the monochromatic silver halide photographic light-sensitive material according to claim 11, with a developer having a pH of 9.0–11.0 using a replenishing amount of 330 $mL/m^2$ or less for the developer.

* * * * *